US009367995B2

(12) United States Patent
Boese et al.

(10) Patent No.: US 9,367,995 B2
(45) Date of Patent: Jun. 14, 2016

(54) ELECTRONIC GAMING DEVICE WITH TURBO BOOST PROGRESSIVE GAMING FUNCTIONALITY

(71) Applicant: Cadillac Jack Inc., Duluth, GA (US)

(72) Inventors: Eric Steven Boese, Decatur, GA (US); Bradley Donald Schultz, Suwanee, GA (US); Jason Prometheus Pawloski, Atlanta, GA (US)

(73) Assignee: Cadillac Jack, Inc., Duluth, GA (US)

( * ) Notice: Subject to any disclaimer, the term of this patent is extended or adjusted under 35 U.S.C. 154(b) by 113 days.

(21) Appl. No.: 14/198,851

(22) Filed: Mar. 6, 2014

(65) Prior Publication Data

US 2015/0254932 A1 Sep. 10, 2015

(51) Int. Cl.
*G07F 17/32* (2006.01)
*G07F 17/34* (2006.01)

(52) U.S. Cl.
CPC ..... *G07F 17/3258* (2013.01); *G07F 17/323* (2013.01); *G07F 17/3218* (2013.01); *G07F 17/3262* (2013.01); *G07F 17/34* (2013.01)

(58) Field of Classification Search
None
See application file for complete search history.

(56) References Cited

U.S. PATENT DOCUMENTS

| | | | | |
|---|---|---|---|---|
| 2008/0108430 | A1* | 5/2008 | Evans | 463/27 |
| 2010/0113131 | A1* | 5/2010 | Aoki et al. | 463/20 |
| 2012/0094738 | A1* | 4/2012 | Aoki et al. | 463/20 |
| 2013/0045785 | A1* | 2/2013 | Gomez | 463/17 |

* cited by examiner

*Primary Examiner* — Jay Liddle
*Assistant Examiner* — Alex F. R. P. Rada, II
(74) *Attorney, Agent, or Firm* — Weide & Miller, Ltd.

(57) ABSTRACT

Examples disclosed herein relate to an electronic gaming device including a memory, a processor, and a plurality of reels. The memory may include one or more turbo boost progressive feature structures. A processor may generate one or more symbols to be located in the one or more areas. The processor may increase a progressive jackpot amount by a first amount where the first amount is a portion of a wager. The processor may increase the progressive jackpot amount by a second amount based on a turbo boost triggering event.

20 Claims, 39 Drawing Sheets

1200B 1230 1232 1234 1236 1238

| JOIN | NAME | COST | JACKPOT |
|---|---|---|---|
| ☐ (1240) | PROGRESSIVE JACKPOT 1 | 1 CREDIT | $1,000.00 |
| ☑ (1242) | PROGRESSIVE JACKPOT 2 | $1.00 | $10,000.00 |
| ☐ | PROGRESSIVE JACKPOT 3 | 5 CREDITS | $50,000.00 |
| ☑ | PROGRESSIVE JACKPOT 4 | $1.50 | $1,000,000.00 |
| ... | ... | ... | ... |
| ☐ | PROGRESSIVE JACKPOT N$^{TH}$ | 10 CREDITS | $10,000,000.00 |

1200C 1230 1232 1234 1236 1238

| JOIN | NAME | JACKPOT | |
|---|---|---|---|
| ☐ (1240) | PROGRESSIVE JACKPOT 1 | $1,000.00 | PAYOUT ALGORITHM = α |
| ☐ | PROGRESSIVE JACKPOT 2 | $10,000.00 | |
| ☐ | PROGRESSIVE JACKPOT 3 | $60,000.00 | |
| ☐ | PROGRESSIVE JACKPOT 4 | $1,000,000.00 | |
| ... | ... | ... | |
| ☐ | PROGRESSIVE JACKPOT N$^{TH}$ | $10,000,000.00 | |

FIG. 12C

1200D 1230 1232 1240

| JOIN | NAME | JACKPOT | |
|---|---|---|---|
| ☐ | PROGRESSIVE JACKPOT 1 | $1,000.00 | PAYOUT ALGORITHM = β |
| ☑ (1250) | PROGRESSIVE JACKPOT 2 | $10,000.00 | |
| ☐ | PROGRESSIVE JACKPOT 3 | $60,000.00 | |
| ☑ (1252) | PROGRESSIVE JACKPOT 4 | $1,000,000.00 | |
| ... | ... | ... | |
| ☐ | PROGRESSIVE JACKPOT N$^{TH}$ | $10,000,000.00 | |

FIG. 12D

ELECTRONIC GAMING DEVICE WITH TURBO BOOST PROGRESSIVE GAMING FUNCTIONALITY

FIELD

The subject matter disclosed herein relates to an electronic gaming device. More specifically, the disclosure relates to providing one or more turbo boost progressive functionalities on a gaming device.

INFORMATION

The gaming industry has numerous casinos located both worldwide and in the United States. A client of a casino or other gaming entity can gamble via various games of chance. For example, craps, roulette, baccarat, blackjack, and electronic games (e.g., a slot machine) where a person may gamble on an outcome.

Paylines of an electronic gaming device (e.g., a slot machine) are utilized to determine when predetermined winning symbol combinations are aligned in a predetermined pattern to form a winning combination. A winning event occurs when the player successfully matches the predetermined winning symbols in one of the predetermined patterns.

A player's entertainment while playing one or more games may be enhanced by utilizing one or more turbo boost progressive functionalities on the gaming device. By increasing the player's entertainment level, the player's enjoyment of the game may be enhanced, which may increase a player's game playing period.

BRIEF DESCRIPTION OF THE FIGURES

Non-limiting and non-exhaustive examples will be described with reference to the following figures, wherein like reference numerals refer to like parts throughout the various figures.

FIG. 12C is another illustration of subscription based progressive game play on a gaming device, according to one embodiment.

FIG. 12D is another illustration of subscription based progressive game play on a gaming device, according to one embodiment.

DETAILED DESCRIPTION

Figure 1:
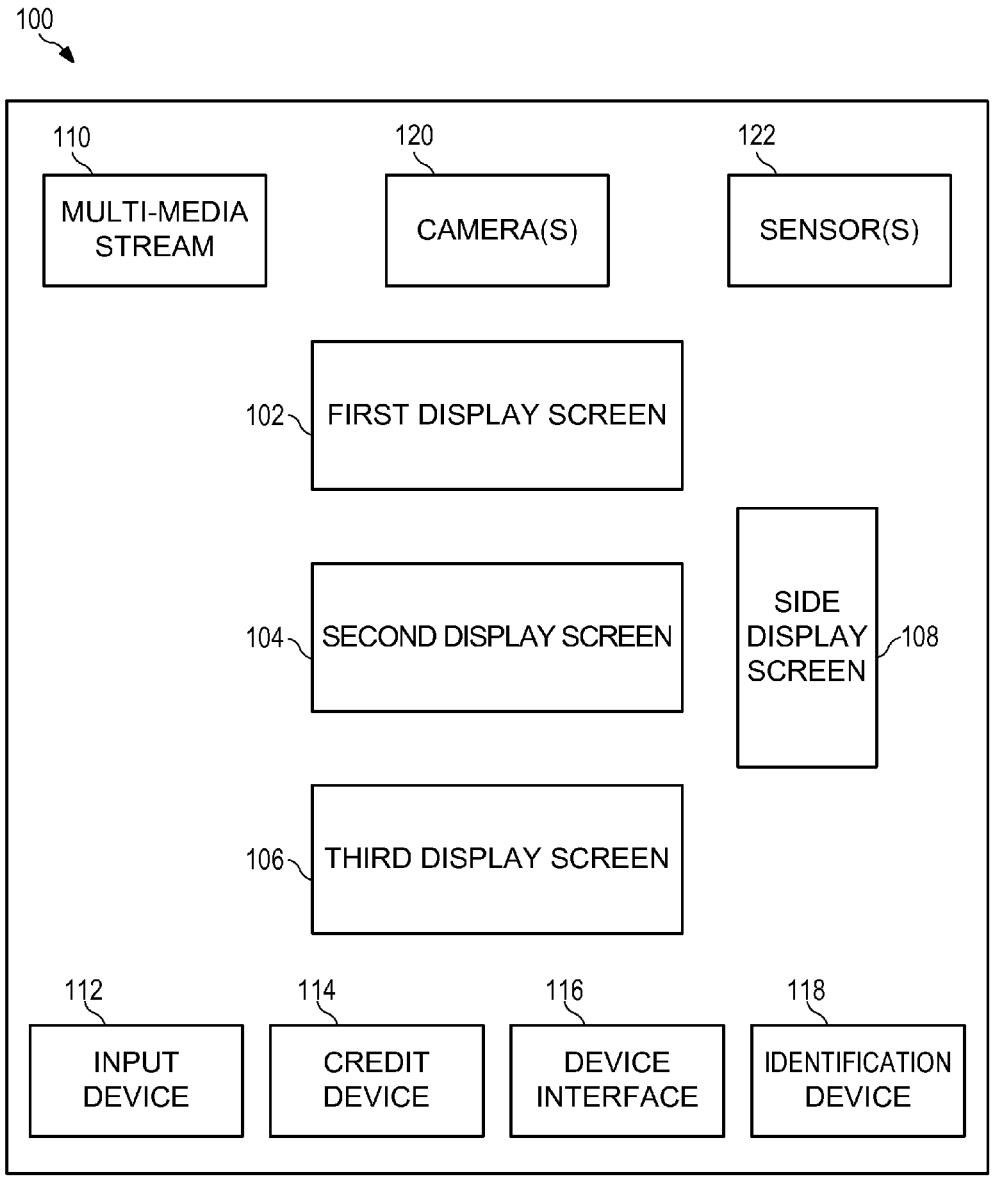
FIG. 1 is an illustration of the electronic gaming device, according to one embodiment.

FIG. 1 is an illustration of an electronic gaming device 100. Electronic gaming device 100 may include a multi-media stream 110, a first display screen 102, a second display screen 104, a third display screen 106, a side display screen 108, an input device 112, a credit device 114, a device interface 116, and an identification device 118. Electronic gaming device 100 may display one, two, a few, or a plurality of multi-media streams 110, which may be obtained from one or more gaming tables, one or more electronic gaming devices, a central server, a video server, a music server, an advertising server, another data source, and/or any combination thereof.

Multi-media streams may be obtained for an entertainment event, a wagering event, a promotional event, a promotional offering, an advertisement, a sporting event, any other event, and/or any combination thereof. For example, the entertainment event may be a concert, a show, a television program, a movie, an Internet event, and/or any combination thereof. In another example, the wagering event may be a poker tournament, a horse race, a car race, and/or any combination thereof. The advertisement may be an advertisement for a casino, a restaurant, a shop, any other entity, and/or any combination thereof. The sporting event may be a football game, a baseball game, a hockey game, a basketball game, any other sporting event, and/or any combination thereof. These multi-media streams may be utilized in combination with the gaming table video streams.

Input device 112 may be mechanical buttons, electronic buttons, mechanical switches, electronic switches, optical switches, a slot pull handle, a keyboard, a keypad, a touch screen, a gesture screen, a joystick, a pointing device (e.g., a mouse), a virtual (on-screen) keyboard, a virtual (on-screen) keypad, biometric sensor, or any combination thereof. Input device 112 may be utilized to select one or more turbo boost progressive gaming options, to make a wager, to make a turbo boost progressive wager, to control any object, to select one or more pattern gaming options, to obtain data relating to historical payouts, to select a row and/or column to move, to select a row area to move, to select a column area to move, to select a symbol (or image) to move, to modify electronic gaming device 100 (e.g., change sound level, configuration, font, language, etc.), to select a movie or song, to select live multi-media streams, to request services (e.g., drinks, slot attendant, manager, etc.), to select two-dimensional ("2D") game play, to select three-dimensional ("3D") game play, to select both two-dimensional and three-dimensional game play, to change the orientation of games in a three-dimensional space, to move a symbol (e.g., wild, multiplier, etc.), and/or any combination thereof. These selections may occur via any other input device (e.g., a touch screen, voice commands, etc.). Input device 112 may be any control panel.

Credit device 114 may be utilized to collect monies and distribute monies (e.g., cash, vouchers, etc.). Credit device 114 may interface with a mobile device to electronically transmit money and/or credits. Credit device 114 may interface with a player's card to exchange player points.

Device interface 116 may be utilized to interface electronic gaming device 100 to a bonus game device, a local area progressive controller, a wide area progressive controller, a progressive sign controller, a peripheral display device, signage, a promotional device, network components, a local network, a wide area network, remote access equipment, a slot monitoring system, a slot player tracking system, the Internet, a server, and/or any combination thereof.

Device interface 116 may be utilized to connect a player to electronic gaming device 100 through a mobile device, card, keypad, identification device 118, and/or any combination thereof. Device interface 116 may include a docking station by which a mobile device is plugged into electronic gaming machine 100. Device interface 116 may include an over the air connection by which a mobile device is connected to electronic gaming machine 100 (e.g., Bluetooth, Near Field technology, and/or Wi-Fi technology). Device interface 116 may include a connection to identification device 118.

Identification device 118 may be utilized to determine an identity of a player. Based on information obtained by identification device 118, electronic gaming device 100 may be reconfigured. For example, the language, sound level, music, placement of multi-media streams, one or more game functionalities (e.g., game type 1, game type 2, game type 3, etc.) may be presented, a turbo boost progressive gaming option may be presented, a repeat payline gaming option may be presented, a pattern gaming option may be presented, historical gaming data may be presented, a row rearrangement option may be presented, a column rearrangement option may be presented, a row area rearrangement option may be presented, a column area rearrangement option may be presented, a two-dimensional gaming option may be presented, a three-dimensional gaming option may be presented, and/or the placement of gaming options may be modified based on player preference data. For example, the player may only want to play games that include turbo boost progressive gaming options only. Therefore, only games which include turbo boost progressive gaming options would be presented to the player. In another example, the player may only want to play games that include historical information relating to game play. Therefore, only games which include historical gaming data would be presented to the player. These examples may be combined.

Identification device 118 may utilize biometrics (e.g., thumb print, retinal scan, or other biometric). Identification device 118 may include a card entry slot into input device 112. Identification device 118 may include a keypad with an assigned pin number for verification. Identification device 118 may include multiple layers of identification for added security. For example, a player could be required to enter a player tracking card, and/or a pin number, and/or a thumb print, and/or any combination thereof. Based on information obtained by identification device 118, electronic gaming device 100 may be reconfigured. For example, the language, sound level, music, placement of video streams, placement of images, and the placement of gaming options utilized may be modified based on a player's preference data. For example, a player may have selected baseball under the sporting event preferences; electronic gaming device 100 will then automatically display the current baseball game onto side display screen 108 and/or an alternate display screen as set in the player's options.

First display screen 102 may be a liquid crystal display ("LCD"), a cathode ray tube display ("CRT"), organic light-emitting diode display ("OLED"), plasma display panel ("PDP"), electroluminescent display ("ELD"), a light-emitting diode display ("LED"), or any other display technology. First display screen 102 may be used for displaying primary games or secondary (bonus) games, to display one or more warnings relating to one or more audio devices, one or more display devices, one or more electrical wires, one or more springs, one or more motors, one or more adjustable devices, and/or one or more sensors, advertising, player attractions, electronic gaming device 100 configuration parameters and settings, game history, accounting meters, events, alarms, and/or any combination thereof. Second display screen 104, third display screen 106, side display screen 108, and any other screens may utilize the same technology as first display screen 102 and/or any combination of technologies.

First display screen 102 may also be virtually combined with second display screen 104. Likewise second display screen 104 may also be virtually combined with third display screen 106. First display screen 102 may be virtually combined with both second display screen 104 and third display screen 106. Any combination thereof may be formed.

For example, a single large image could be partially displayed on second display screen 104 and partially displayed on third display screen 106, so that when both display screens are put together they complete one image. Electronic gaming device 100 may stream or play prerecorded multi-media data, which may be displayed on any display combination.

One or more cameras 120 and/or one or more sensors 122 may be utilized as one or more depth image sensing devices, which may be located in various locations, including but not limited to, above the base display, above second display, in one or more locations on gaming cabinet front, on a side of the gaming cabinet other than gaming cabinet front, and/or any other location.

In one embodiment, electronic gaming device 100 may not include separate one or more input devices, but instead may only utilize one or more depth image sensing devices. In another embodiment, a player may utilize one or more input devices and/or may utilize gestures that electronic gaming device 100, via one or more depth image sensing devices, recognizes in order to make inputs for a play of a game. A player may interact with electronic gaming device 100 via one or more depth image sensing devices for a plurality of various player inputs.

In one embodiment, one or more depth image sensing devices may include at least two similar devices. For example, each of the at least two similar devices may independently sense depth and/or image of a scene. In another example, such similar depth image sensing devices may then communicate information to one or more processors, which may utilize the information from each of the similar depth image sensing devices to determine the relative depth of an image from a captured scene.

In another embodiment, one or more depth image sensing devices may include at least two different devices. For example, and discussed in more detail below, one of the at least two different devices may be an active device and/or one of the at least two different devices may be a passive device. In one example, such an active device may generate a wave of measurable energy (e.g., light, radio, etc.). In another example, such a passive device may be able to detect reflected waves generated by such an active device. In another example, such an active device and such a passive device may each communicate data related to their respective activity to a processor, and such processor may translate such data in order to determine the depth and/or image of a scene occurring near electronic gaming device 100.

Electronic gaming device 100 may include at least one display device. Electronic gaming device 100 may include a base display and/or a second display. In one embodiment, base display may be the primary display for a first game and/or one or more turbo boost progressive games. In another embodiment, second display may be the primary display for a second, bonus game, and/or one or more turbo boost progressive games. For example, base display may display: a reel-type video slot game; and upon a bonus game triggering condition; second display may display a bonus game; and upon a turbo boost progressive game feature triggering event; first and/or second display (and/or Nth displays) may display a turbo boost progressive game feature.

In one embodiment, base display and second display may display separate portions of a common image. For example, second display may display a top portion of a wheel spinning while base display may display the bottom portion of the same wheel spinning.

Electronic gaming device 100 may also include one or more speakers. In one embodiment, one or more speakers may work in a synchronized manner to provide a surround sound effect. For example, as an object is displayed moving across base display from left to right, one or more speakers may produce sound in such a manner as to create an audible sense of similar left to right movement. In another embodiment, one or more speakers may work asynchronously. In a further embodiment, a first speaker may produce sounds associated with a first symbol appearing in a play of a game, and a second speaker may produce sounds associated with a second symbol appearing in a play of the game.

Figure 2:
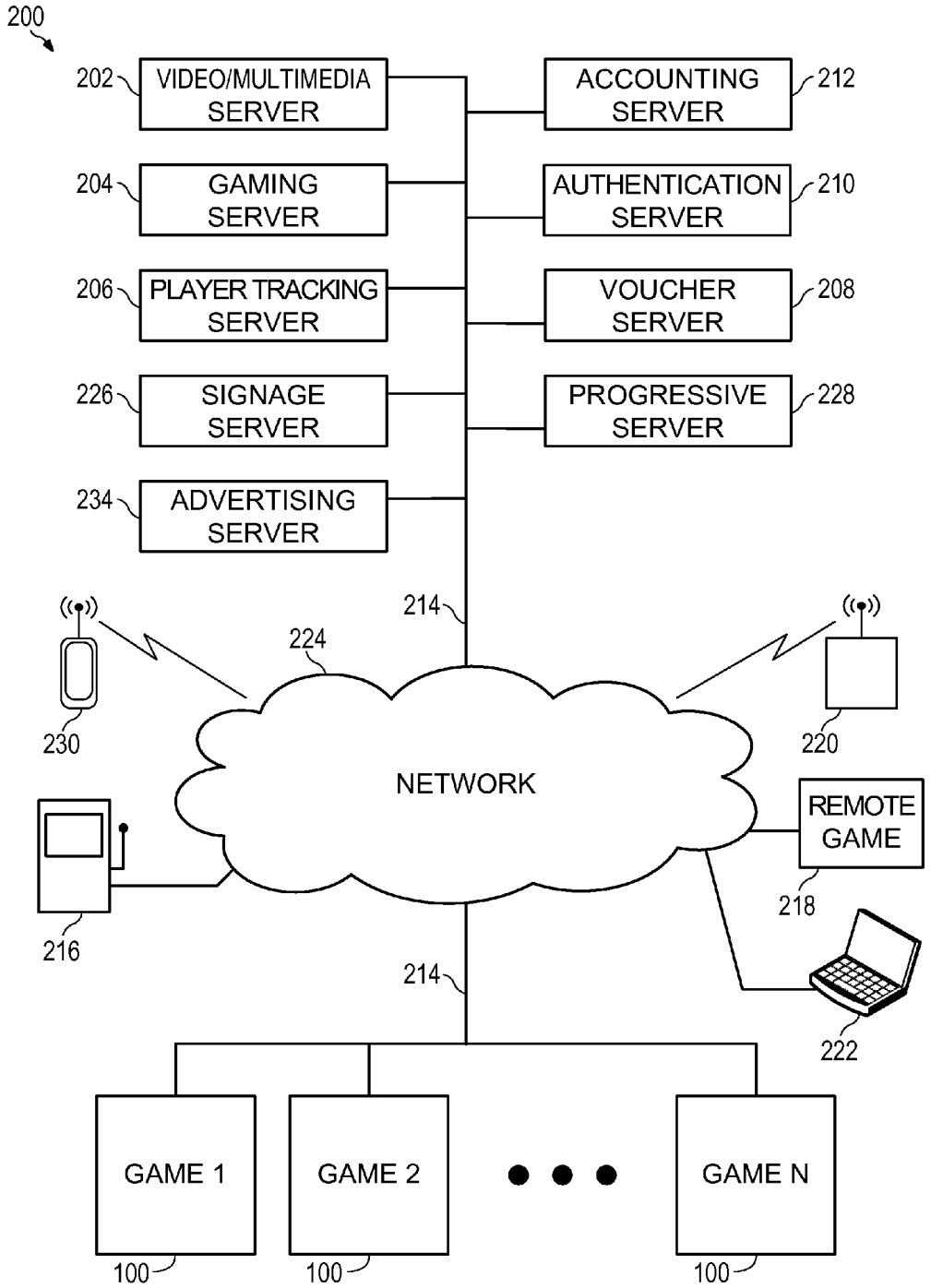
FIG. 2 is an illustration of an electronic gaming system, according to one embodiment.

In FIG. 2, an electronic gaming system 200 is shown. Electronic gaming system 200 may include a video/multimedia server 202, a gaming server 204, a player tracking server 206, a voucher server 208, an authentication server 210, and an accounting server 212.

Electronic gaming system 200 may include video/multimedia server 202, which may be coupled to network 224 via a network link 214. Network 224 may be the Internet, a private network, and/or a network cloud. One or more video streams may be received at video/multimedia server 202 from other electronic gaming devices 100. Video/multimedia server 202 may transmit one or more of these video streams to a mobile phone 230, electronic gaming device 100, a remote electronic gaming device at a different location in the same property 216, a remote electronic gaming device at a different location 218, a laptop 222, and/or any other remote electronic device 220. Video/multimedia server 202 may transmit these video streams via network link 214 and/or network 224.

For example, a remote gaming device at the same location may be utilized at a casino with multiple casino floors, a casino that allows wagering activities to take place from the hotel room, a casino that may allow wagering activities (including turbo boost progressive wagers) to take place from the pool area, etc. In another example, the remote devices may be at another location via a progressive link to another casino, and/or a link within a casino corporation that owns numerous casinos (e.g., MGM, Caesars, etc.).

Gaming server 204 may generate gaming outcomes. Gaming server 204 may provide electronic gaming device 100 with game play content. Gaming server 204 may provide electronic gaming device 100 with game play math and/or outcomes. Gaming server 204 may provide one or more of: a turbo boost progressive game feature functionality; a turbo boost progressive game feature evaluation functionality; a payout functionality; a base and/or bonus game play functionality; a base and/or bonus game play evaluation functionality, other game functionality, and/or any other virtual game functionality.

Player tracking server 206 may track a player's betting activity, a player's preferences (e.g., language, font, sound level, drinks, etc.). Based on data obtained by player tracking server 206, a player may be eligible for gaming rewards (e.g., free play), promotions, and/or other awards (e.g., complimentary food, drinks, lodging, concerts, etc.).

Voucher server 208 may generate a voucher, which may include data relating to gaming. Further, the voucher may include turbo boost progressive wagering data and/or payline structure option selections. In addition, the voucher may include game play data (or similar game play data), repeat payline data, pattern data, historical payout data, column data, row data, and/or symbols that were modified.

Authentication server 210 may determine the validity of vouchers, player's identity, and/or an outcome for a gaming event.

Accounting server 212 may compile, track, and/or monitor cash flows, voucher transactions, winning vouchers, losing vouchers, turbo boost progressive wagering data, and/or other transaction data. Transaction data may include the number of wagers, the size of these wagers, the date and time for these wagers, the identity of the players making these wagers, the frequency of the wagers, and/or verification data, and/or confirmation data. Accounting server 212 may generate tax information relating to these wagers. Accounting server 212 may generate profit/loss reports for players' tracked outcomes.

Network connection 214 may be used for communication between dedicated servers, thin clients, thick clients, back-office accounting systems, etc.

Laptop computer 222 and/or any other electronic devices (e.g., mobile phone 230, electronic gaming device 100, etc.) may be used for downloading new gaming device applications or gaming device related firmware through remote access.

Laptop computer 222 and/or any other electronic device (e.g., mobile phone 230, electronic gaming device 100, etc.) may be used for uploading accounting information (e.g., cashable credits, non-cashable credits, coin in, coin out, bill in, voucher in, voucher out, etc.).

Network 224 may be a local area network, a casino premises network, a wide area network, a virtual private network, an enterprise private network, the Internet, or any combination thereof. Hardware components, such as network interface cards, repeaters and hubs, bridges, switches, routers, firewalls, or any combination thereof may also be part of network 224.

A statistics server may be used to maintain data relating to historical game play and/or turbo boost progressive wagering data for one or more electronic gaming devices 100 and/or other events. This historical data may include winning amounts, winning data (e.g., person, sex, age, time on machine, amount of spins before winning event occurred, etc.), fastest winning event reoccurrence, longest winning event reoccurrence, average frequencies of winning events, average winning amounts, highest winning amount, lowest winning amount, locations for winning events, winning event dates, winning machines, winning game themes, and/or any other data relating to game play.

Searching server 232 may implement a search on one or more gaming devices to obtain gaming data. Searching server 232 may implement a messaging function, which may transmit a message to a third party (e.g., a player) relating to a search, a search status update, a game status update, a wager status update, a confirmation of a wager, a confirmation of a money transfer, and/or any other data relating to the player's account. The message can take the form of a text display on the gaming device, a pop up window, a text message, an email, a voice message, a video message and the like. Searching server 232 may implement a wagering function, which may be an automatic wagering mechanism. These functions of searching server 232 may be integrated into one or more servers.

Searching server 232 may include one or more searching structures, one or more searching algorithms, and/or any other searching mechanisms. In general, the search structures may cover which EGMs paid out the most money during a time period, which EGMs kept the most money from players during a time period, which EGMs are the most popular (e.g., top games), which EGMs are the least popular, which EGMs have the most amount of money bet during a period, which EGMs have the highest bet volume, which EGMs are more volatile (e.g., volatility, or deviation from the statistical norms of bet volume, bet amount, pay out, etc.) during a time period, and the like. These searches may also be associated with location queries, time queries, and/or people queries (e.g., where are the table games that most of my friends bet on, where are my favorite EGMs, what are players betting on the most today, when are most bets placed, etc.).

The searching structures may be predetermined searching structures. For example, the method may start searching a first device, then a second device, then a third device, up to an $N^{th}$ device based on one or more searching parameters (e.g., triggering event). In one example, the search may end once one or more triggering events are determined. In another example, the search may end once data has been received from a predetermined number (e.g., one, two, ten, one hundred, all) of the devices. In another example, the search may be based on a predetermined number of devices to be searched in combination with a predetermined number of search results to be obtained. In this example, the search structure may be a minimum of ten devices to be searched, along with a minimum of five gaming options to be determined.

In another example, the searching structures may be based on one or more specific games (e.g., a first EGM type, a second EGM type, etc.). Searching structure may search one or more of these games.

In another example, the searching structure may be based on a player's preferences, past transactional history, player input, a particular EGM, a particular casino, a particular location within a casino, game outcomes over a time period, payout over a time period, and/or any other criteria.

Figure 3:
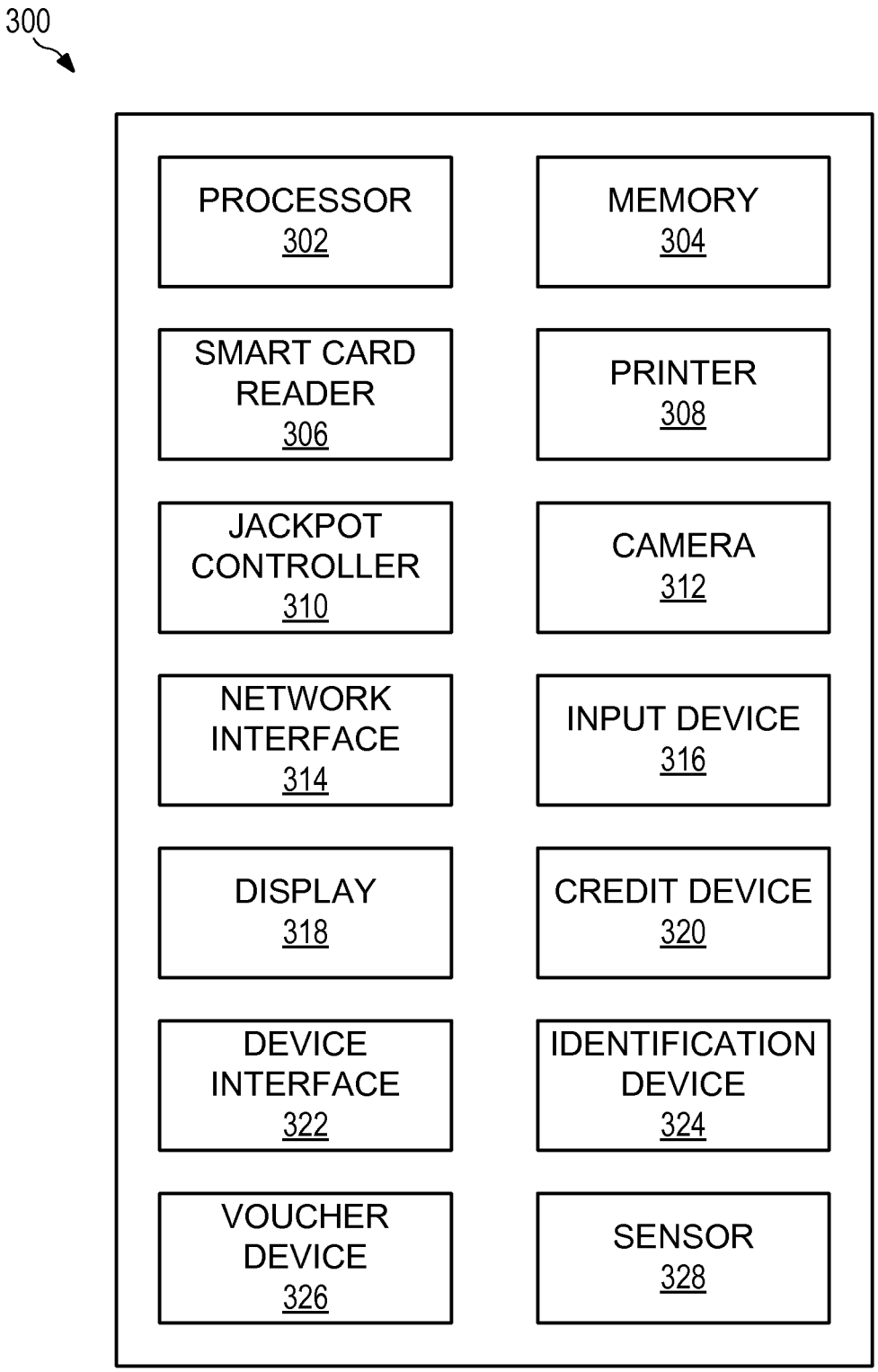
FIG. 3 is a block diagram of the electronic gaming device, according to one embodiment.

FIG. 3 shows a block diagram 300 of electronic gaming device 100. Electronic gaming device 100 may include a processor 302, a memory 304, a smart card reader 306, a printer 308, a jackpot controller 310, a camera 312, a network interface 314, an input device 316, a display 318, a credit device 320, a device interface 322, an identification device 324, and a voucher device 326.

Processor 302 may execute program instructions of memory 304 and use memory 304 for data storage. Processor 302 may also include a numeric co-processor, or a graphics processing unit (or units) for accelerated video encoding and decoding, and/or any combination thereof.

Processor 302 may include communication interfaces for communicating with electronic gaming device 100, electronic gaming system 200, and user interfaces to enable communication with all gaming elements. For example, processor 302 may interface with memory 304 to access a player's mobile device through device interface 322 to display contents onto display 318. Processor 302 may generate a voucher based on a wager confirmation, which may be received by an input device, a server, a mobile device, and/or any combination thereof. A voucher device may generate, print, transmit, or receive a voucher. Memory 304 may include communication interfaces for communicating with electronic gaming device 100, electronic gaming system 200, and user interfaces to enable communication with all gaming elements. For example, the information stored on memory 304 may be printed out onto a voucher by printer 308. Videos or pictures captured by camera 312 may be saved and stored on memory 304. Memory 304 may include a confirmation module, which may authenticate a value of a voucher and/or the validity of the voucher. Processor 302 may determine the value of the voucher based on generated voucher data and data in the confirmation module. Electronic gaming device 100 may include a player preference input device. The player preference input device may modify a game configuration. The modification may be based on data from the identification device.

Memory 304 may be non-volatile semiconductor memory, such as read-only memory ("ROM"), erasable programmable read-only memory ("EPROM"), electrically erasable programmable read-only memory ("EEPROM"), flash memory ("NVRAM"), Nano-RAM (e.g., carbon nanotube random access memory), and/or any combination thereof.

Memory 304 may also be volatile semiconductor memory such as, dynamic random access memory ("DRAM"), static random access memory ("SRAM"), and/or any combination thereof.

Memory 304 may also be a data storage device, such as a hard disk drive, an optical disk drive such as, CD, DVD, Blu-ray, a solid state drive, a memory stick, a CompactFlash card, a USB flash drive, a Multi-media Card, an xD-Picture Card, and/or any combination thereof.

Memory 304 may be used to store read-only program instructions for execution by processor 302, for the read-write storage for global variables and static variables, read-write storage for uninitialized data, read-write storage for dynamically allocated memory, for the read-write storage of the data structure known as "the stack," and/or any combination thereof.

Memory 304 may be used to store the read-only paytable information for which symbol combinations on a given payline that result in a win (e.g., payout) which are established for games of chance, such as slot games and video poker.

Memory 304 may be used to store accounting information (e.g., cashable electronic promotion in, non-cashable electronic promotion out, coin in, coin out, bill in, voucher in, voucher out, electronic funds transfer in, etc.).

Memory 304 may be used to record error conditions on an electronic gaming device 100, such as door open, coin jam, ticket print failure, ticket (e.g., paper) jam, program error, reel tilt, etc., and/or any combination thereof.

Memory 304 may also be used to record the complete history for the most recent game played, plus some number of prior games as may be determined by the regulating authority.

Smart card reader 306 may allow electronic gaming device 100 to access and read information provided by the player or technician, which may be used for setting the player preferences and/or providing maintenance information. For example, smart card reader 306 may provide an interface between a smart card (inserted by the player) and identification device 324 to verify the identity of a player.

Printer 308 may be used for printing slot machine payout receipts, turbo boost progressive wager payouts, turbo boost progressive wagering vouchers, slot machine wagering vouchers, non-gaming coupons, slot machine coupons (e.g., a wagering instrument with a fixed waging value that can only be used for non-cashable credits), drink tokens, comps, and/or any combination thereof.

Electronic gaming device 100 may include a jackpot controller 310, which may allow electronic gaming device 100 to interface with other electronic gaming devices either directly or through electronic gaming system 200 to accumulate a shared jackpot.

Camera 312 may allow electronic gaming device 100 to take images of a player or a player's surroundings. For example, when a player sits down at the machine his or her picture may be taken to include his or her image into the game play. A picture of a player may be an actual image as taken by camera 312. A picture of a player may be a computerized caricature (i.e., avatar) of the image taken by camera 312. The image obtained by camera 312 may be used in connection with identification device 324 using facial recognition. Camera 312 may allow electronic gaming device 100 to record video. The video may be stored on memory 304 or stored remotely via electronic gaming system 200. Videos obtained by camera 312 may then be used as part of game play, or may be used for security purposes. For example, a camera located on electronic gaming device 100 may capture videos of a potential illegal activity (e.g., tampering with the machine, crime in the vicinity, underage players, etc.).

Network interface 314 may allow electronic gaming device 100 to communicate with video/multimedia server 202, gaming server 204, player tracking server 206, voucher server 208, authentication server 210, and/or accounting server 212, and/or any other turbo boost progressive wagering related server (e.g., server to confirm another event (e.g., a horse race, football game, etc.)).

Input device 316 may be mechanical buttons, electronic buttons, a touch screen, and/or any combination thereof. Input device 316 may be utilized to make a wager, to make a turbo boost progressive wager, to select one or more game elements, to select one or more gaming options, to make an offer to buy or sell a voucher, to determine a voucher's worth, to cash in a voucher, to modify electronic gaming device 100 (e.g., change sound level, configuration, font, language, etc.), to modify one of one or more audio devices, one or more display devices, one or more electrical wires, one or more springs, one or more motors, one or more adjustable devices, and/or one or more sensors, to select a movie or music, to select live video streams (e.g., sporting event 1, sporting event 2, sporting event 3), to request services (e.g., drinks, manager, etc.), and/or any combination thereof.

Display 318 may show video streams from one or more content sources. Display 318 may encompass first display screen 102, second display screen 104, third display screen 106, side display screen 108, and/or another screen used for displaying video content.

Credit device 320 may be utilized to collect monies and distribute monies (e.g., cash, vouchers, etc.). Credit device 320 may interface with processor 302 to allow game play to take place. Processor 302 may determine any payouts, display configurations, animation, and/or any other functions associated with game play. Credit device 320 may interface with display 318 to display the amount of available credits for the player to use for wagering purposes. Credit device 320 may interface via device interface 322 with a mobile device to electronically transmit money and/or credits. Credit device 320 may interface with a player's pre-established account, which may be stored on electronic gaming system 200, to electronically transmit money and/or credit. For example, a player may have a credit card or other mag-stripe card on file with the location for which money and/or credits can be directly applied when the player is done. Credit device 320 may interface with a player's card to exchange player points.

Electronic gaming device 100 may include a device interface 322 that a user may employ with his or her mobile device (e.g., smart phone) to receive information from and/or transmit information to electronic gaming device 100 (e.g., watch a movie, listen to music, obtain verbal betting options, verify identification, transmit credits, etc.).

Identification device 324 may be utilized to allow electronic gaming device 100 to determine an identity of a player. Based on information obtained by identification device 324, electronic gaming device 100 may be reconfigured. For example, the language, sound level, music, placement of video streams, placement of images, placement of gaming options, and/or the tables utilized may be modified based on player preference data.

For example, a player may have selected a specific baseball team (e.g., Atlanta Braves) under the sporting event preferences, the electronic gaming device 100 will then automatically (or via player input) display the current baseball game (e.g., Atlanta Braves vs. Philadelphia Phillies) onto side display screen 108 and/or an alternate display screen as set in the player's options.

A voucher device 326 may generate, print, transmit, or receive a voucher. The voucher may represent a wagering option, a wagering structure, a wagering timeline, a value of wager, a payout potential, a payout, and/or any other wagering data. A voucher may represent an award, which may be used at other locations inside of the gaming establishment. For example, the voucher may be a coupon for the local buffet or a concert ticket.

Figure 4:
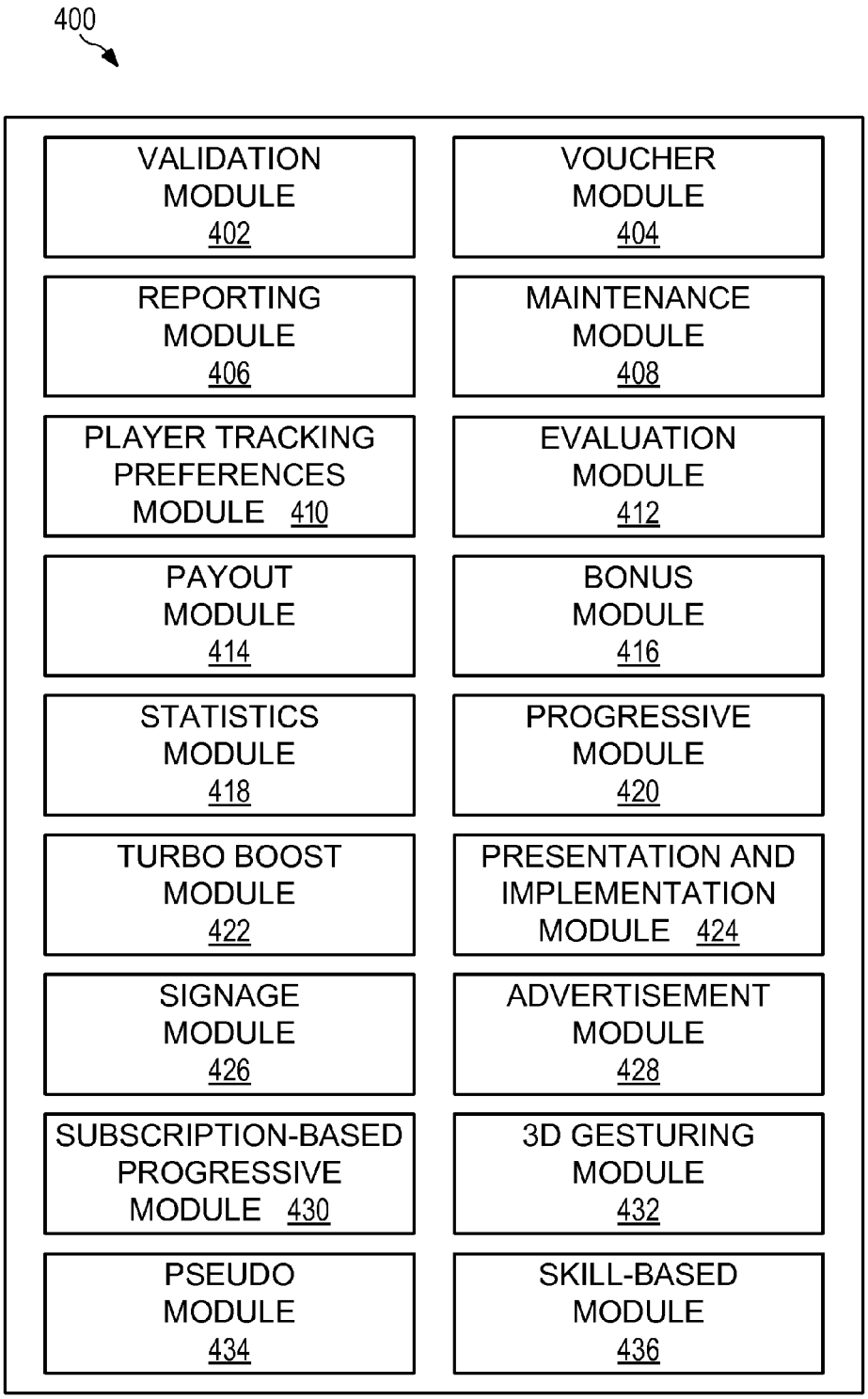
FIG. 4 is another block diagram of the electronic gaming device, according to one embodiment.

FIG. 4 shows a block diagram of memory 304, which includes various modules. Memory 304 may include a validation module 402, a voucher module 404, a reporting module 406, a maintenance module 408, a player tracking preferences module 410, an animation module, a game evaluation module 412, a payout module 414, a sensor module, a scene module, a sensor and scene evaluation module, a sensor and scene output module, a reference models module, an audio module, an audio device adjustment module, a display device adjustment module, a bonus module 416, a statistics module 418, a progressive module 420, a turbo boost progressive game module 422, a presentation and implementation module 424, a tracking module, a signage module 426, an advertisement module 428, a subscription-based progressive module 430, a 3D gesturing module 432, a pseudo module 434, and a skill-based module 436.

Validation module 402 may utilize data received from voucher device 326 to confirm the validity of the voucher.

Voucher module 404 may store data relating to generated vouchers, redeemed vouchers, bought vouchers, and/or sold vouchers.

Reporting module 406 may generate reports related to a performance of electronic gaming device 100, electronic gaming system 200, video streams, gaming objects, credit device 114, and/or identification device 118.

Maintenance module 408 may track any maintenance that is implemented on electronic gaming device 100 and/or electronic gaming system 200. Maintenance module 408 may schedule preventative maintenance and/or request a service call based on a device error.

Player tracking preferences module 410 may compile and track data associated with a player's preferences.

Animation module may generate, compile, transmit, and/or store one or more animations and/or presentations based on one or more scene data, one or more scenes, one or more reference models, one or more game play data, one or more player profiles, and/or any combination thereof.

Game evaluation module 412 may evaluate one or more outcomes for one or more events relating to game play.

Payout module 414 may determine one or more payouts which may relate to one or more inputs received from the player, electronic gaming device 100, and/or electronic gaming system 200.

Sensor module may generate, compile, transmit, and/or store any data relating to one or more scene data, one or more scene, and/or any other sensor data. This data may include one or more gestures (e.g., body movement made by one or more players).

Scene module may generate, compile, transmit, and/or store on one or more scene data, one or more scenes, one or more reference models, one or more game play data, one or more player profiles, and/or any combination thereof.

Sensor and scene evaluation module may evaluate any data stored on, transmitted to, and/or transmitted from sensor module and scene module. Sensor and scene evaluation module may obtain data including one or more gestures (e.g., body movement made by one or more players) from sensor module and compare this data to one or more body reference models, body part reference models, device reference models, gaming device reference models, floor plan reference models, and/or any other reference models from reference models module to determine one or more actions.

Sensor and scene output module may evaluate the combined output of sensor module and scene module.

Reference models module may generate, compile, transmit, and/or store one or more body reference models, body part reference models, device reference models, gaming device reference models, floor plan reference models, and/or any other reference models which can be utilized by any of the other modules.

Audio module may generate, compile, transmit, and/or store one or more audio structures, sound wave configurations, and/or any other audio data.

Audio device adjustment module may adjust one or more audio devices. These devices may be adjusted physically (e.g., moved) and/or by changing one or more device characteristics.

Display device adjustment module may adjust one or more display devices. These devices may be adjusted physically (e.g., moved) and/or by changing one or more device characteristics.

Bonus module 416 may generate a bonus game, evaluate the results of the bonus game, trigger bonus game presentations, generate bonus game payouts, and/or display any data relating to the bonus game.

Statistics module 418 may be used to maintain data relating to historical game play (including turbo boost progressive wagering data—(Turbo boost amount, turbo boost triggering time and date information, sponsor data, etc.)) for one or more electronic gaming devices 100. This historical data may include winning amounts, winning data (e.g., person, sex, age, time on machine, amount of spins before winning event occurred, etc.), fastest winning event reoccurrence, longest winning event reoccurrence, average frequencies of winning events, average winning amounts, highest winning amount, lowest winning amount, locations for winning events, winning event dates, winning machines, winning game themes, and/or any other data relating to game play.

Progressive module 420 may generate, transmit, compile, and/or store one or more data points relating to one or more progressives and/or subscription progressives (e.g., a progressive a player selects and pays to enter).

Turbo boost progressive game module 422 may generate, transmit, compile, and/or store one or more data points and/or presentations relating to one or more turbo boost progressive gaming options and/or turbo boost progressive gaming wagers.

Presentation and implementation module 424 may generate, transmit, compile, implement, and/or store one or more presentations.

Tracking module may generate, transmit, compile, and/or store one or more data points related to tracking one or more turbo boost progressive wagers and/or turbo boost progressive wager players.

Signage module 426 may generate, transmit, compile, initiate, and/or store one or more presentations for one or more signs.

Advertisement module 428 may generate, transmit, compile, present, implement, initiate, and/or store one or more advertisements.

Searching module may implement a search on one or more gaming devices to obtain gaming data. Searching module 432 may implement a messaging function, which may transmit a message to a third party (e.g., a player) relating to a search, a search status update, a game status update, a wager status update, a confirmation of a wager, a confirmation of a money transfer, and/or any other data relating to the player's account. The message can take the form of a text display on the gaming device, a pop up window, a text message, an email, a voice message, a video message and the like. Searching module 432 may implement a wagering function, which may be an automatic wagering mechanism. These functions of searching module may be integrated into one or more servers.

Searching module may include one or more searching structures, one or more searching algorithms, and/or any other searching mechanisms. In general, the search structures may cover which EGMs paid out the most money during a time period, which EGMs kept the most money from players during a time period, which EGMs are the most popular (e.g., top games), which EGMs are the least popular, which EGMs have the most amount of money bet during a period, which EGMs have the highest bet volume, which EGMs are more volatile (e.g., volatility, or deviation from the statistical norms of bet volume, bet amount, pay out, etc.) during a time period, and the like. These searches may also be associated with location queries, time queries, and/or people queries (e.g., where are the table games that most of my friends bet on, where are my favorite EGMs, what are players betting on the most today, when are most bets placed, etc.).

The searching structures may be predetermined searching structures. For example, the method may start searching a first device, then a second device, then a third device, up to an $N^{th}$ device based on one or more searching parameters (e.g., triggering event). In one example, the search may end once one or more triggering events are determined. In another example, the search may end once data has been received from a predetermined number (e.g., one, two, ten, one hundred, all) of the devices. In another example, the search may be based on a predetermined number of devices to be searched in combination with a predetermined number of search results to be obtained. In this example, the search structure may be a minimum of ten devices to be searched, along with a minimum of five gaming options to be determined.

In another example, the searching structures may be based on one or more specific games (e.g., a first EGM type, a second EGM type, etc.). Searching structure may search one or more of these games.

In another example, the searching structure may be based on a player's preferences, past transactional history, player input, a particular EGM, a particular casino, a particular location within a casino, game outcomes over a time period, payout over a time period, and/or any other criteria.

Wild module may generate a wild game, evaluate the results of the wild game, trigger wild game presentations, generate wild game payouts, and/or display any data relating to the wild game. Further, wild module may determine one or more outcomes of one or more interactions (e.g., collisions of one or more symbols).

Scatter module may generate a scatter game, evaluate the results of the scatter game, trigger scatter game presentations, generate scatter game payouts, and/or display any data relating to the scatter game.

Turbo boost progressive evaluation module may evaluate one or more outcomes for one or more events relating to turbo boost progressive game play. Further, turbo boost progressive evaluation module may determine one or more outcomes of one or more interactions.

Advertisement module 428 may generate, compile, transmit, and/or store advertisement information relating to one or more turbo boost progressives, subscription based progressive, and/or any other gaming feature. These advertisements may be presented on one or more display screens, an internet website, and/or any other advertisement avenue.

Subscription-based progressive module 430 may generate, compile, transmit, and/or store one or more subscription based progressive structures and/or any other data relating to one or more subscription based progressive structures and/or subscription based progressive game play.

3D gesturing module 432 may generate, compile, transmit, and/or store one or more data points, presentations, reference modules, and/or structure relating to any aspect of 3D gesturing.

Pseudo module 434 may generate, transmit, compile, and/or store one or more data points and/or presentations relating to one or more pseudo gaming options and/or pseudo gaming wagers.

Skill-based module 436 may generate, compile, store, and/or transmit one or more skill-based structures and/or one or more skill-based tournament structures. Skill-based evaluation module may evaluation one or more outcomes of one or more skill-based games and/or skill-based tournament games.

Installation verification module may verify the installation parameters on one or more of audio devices, one or more display devices, one or more electrical wires, one or more springs, one or more motors, one or more adjustable devices, and/or one or more sensors to one or more reference data points. Installation verification module may generate a warning when the data points are outside of a specific parameter range. One or more warnings may be transmitted to an external device, a server, a mobile device, and/or a warning display on electronic gaming device 100 based on the verification data.

Locking module may control the locking mechanism for one or more audio devices, one or more display devices, one or more electrical wires, one or more springs, one or more motors, one or more adjustable devices, and/or one or more sensors. Locking module may control any locking mechanism for electronic gaming device 100. Locking module may generate a warning when a locking data point is outside of a specific parameter. These warnings may be transmitted to an external device, a server, a mobile device, and/or a warning display on electronic gaming device 100.

It should be noted that one or more modules may be combined into one module. Further, there may be one evaluation module where the determined payout does not depend on whether there were any wild symbols, scatter symbols, treasure based game play, and/or any other specific symbols. Further, any module, device, and/or logic function in electronic gaming device 100 may be present in electronic gaming system 200. In addition, any module, device, and/or logic function in electronic gaming system 200 may be present in electronic gaming device 100.

In one embodiment, a system based on one or more turbo boost progressive games may be offered that are dependent on a function of a primary slot machine and/or any other device. For example, a second window may open on a primary game screen (and/or any other display and/or any other output device) that offers a wager on the outcome of the next game (e.g., spin, etc.). In one example, the wagering option may be whether the next game (e.g., spin, etc.) will be a winner or a loser. The player may make the wager and play the game. If the results of the game play is consistent with the player's bet, the player wins and is awarded a prize. In one example, the gaming system does not determine the outcome of the future game play before the wager and/or odds are accepted and/or created. In this example, this gaming option may not need to be approved as a gaming device and may not be subject to the rigorous standards of a regulated gaming device. In this example, an accounting system that accepts bets and pays winning bets may be utilized. In these examples, the player is betting on some characteristic of slot machine play and/or another verifiable event outcome.

In one example, the types of wagers that can be accepted are not relegated to the outcomes of the player's slot machine. In various examples, the possibilities for betting options are related to the events and/or occurrences that can be observed, recorded, and/or verified by the system. For example, one wagering option may be whether the turbo boost (and/or progressive) will be triggered and/or hit in the next 3 minutes and/or next 10 spins. In another example, one wagering option may be whether another person (e.g., a friend, a wife, a husband, a stranger, etc.) will win on the next spin. In this example, a loyalty card (and/or some other identification method) may be utilized to identify the player and/or a specific gaming device identification number may be utilized. In another example, one wagering option may be whether the mystery progressive will be hit (e.g., won) before it reaches a certain number (e.g., $300, $1,000, etc.).

In another example, the credits for the wager and the winnings may be moved to and from the primary gaming device through automatic fund transfer ("AFT") transactions from the system. Further, the system may act as the book maker for the bets. The system may meter and account for all transfers in total and by each game in which pseudo wagers have been made.

In another example, the system may determine the one or more event outcomes via SAS communications, communications with a class II server, and/or other communication protocol and/or other forms of communication methods. The system may record one or more outcomes for the wager and relays the results to the player and/or one or more EGMs. In addition, the system may allow for a ticket to be printed as a pseudo wager receipt but this may not be necessary as the pseudo wager information is already stored on the system. In addition, in cases where the pseudo wager cannot be completed, the pseudo wager may be returned to the player or to the player's account. In various examples, one or more rules may be implemented for pseudo wagers that depend on an event occurring over a time period and/or as other events happen to prevent the player from trying to cancel wagers as a limit is approached. For example, a player may want to cancel a bet that the next four spins will be winner once the second spin was not a winner. However, the system may not allow this.

Figure 5A:
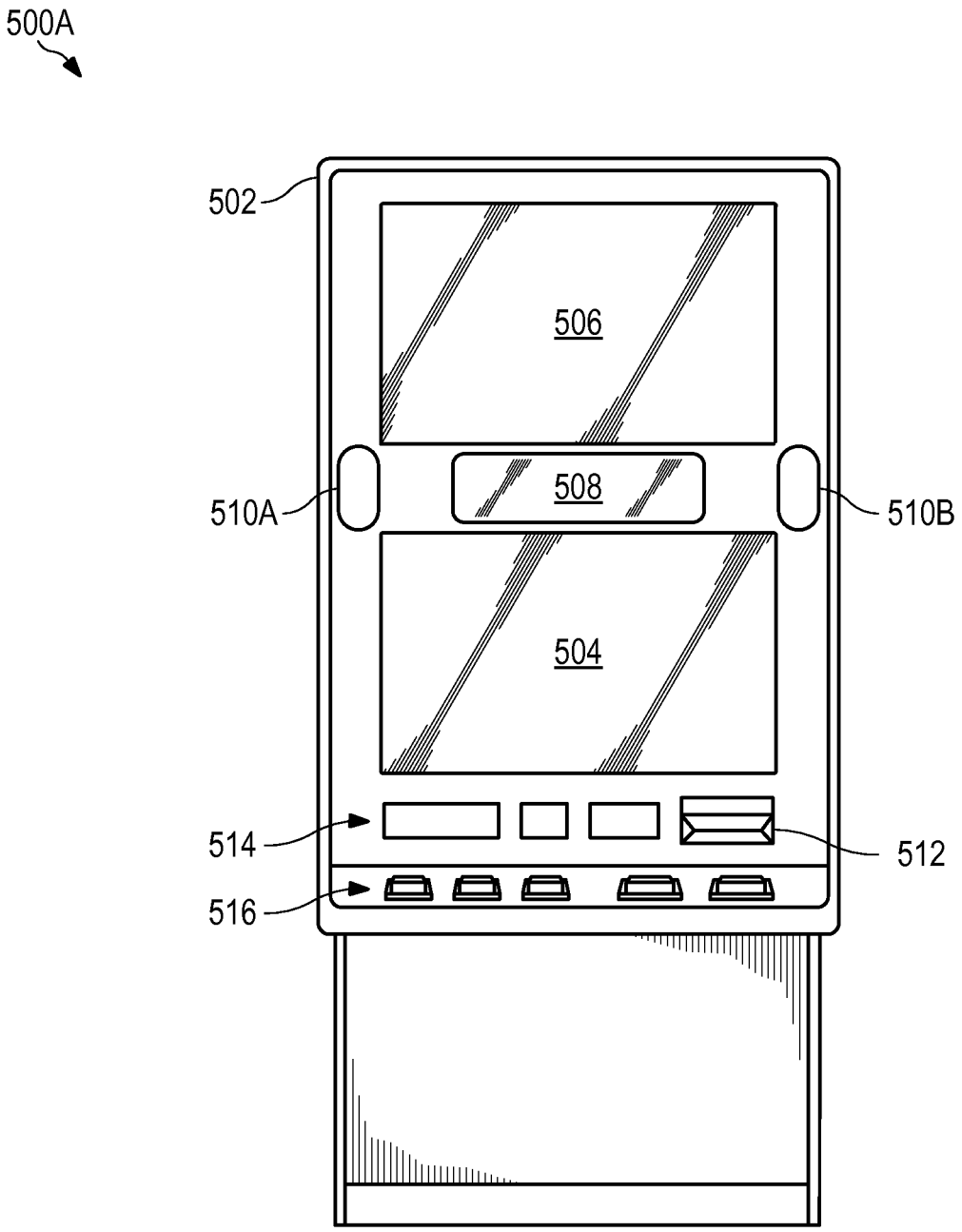
FIG. 5A is an illustration of turbo boost progressive game play on a gaming device, according to one embodiment.

In FIG. 5A, an illustration of a gaming device cabinet 500 is shown, according to one embodiment. A gaming device 502 may include an overhead display 506, a side display 508, a main game display 504, a left speaker 510A, a right speaker 510B, one or more output devices (e.g., a ticket in/ticket out device 512), and/or one or more input devices 516 (e.g., buttons, bill validators, etc.). In one example, overhead display 506 includes a leadership board sponsor and/or a ranking of tournament players. In this example, the XYZ company has sponsored the leadership board and the leadership board states "XYZ LEADER BOARD." In another example, leadership display may include data relating to one or more tournaments, such as, the time remaining (e.g., 1 HOUR 31 MINUTES REMAINING). In this example, side display 508 may display a current mode of operation. For example, a current mode may be a tournament mode, a normal mode, a practice mode, a team mode, an individual mode, any combination thereof, etc.

Figure 5B:
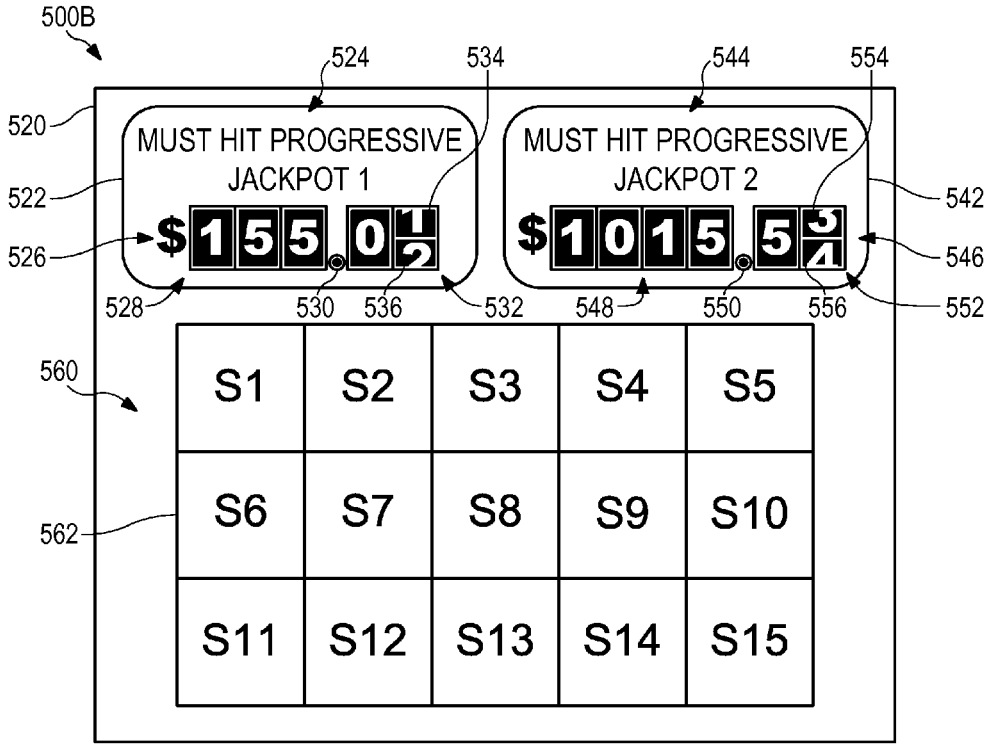
FIG. 5B is an illustration of a progressive game play on a gaming device, according to one embodiment.

In FIG. 5B, an illustration of a progressive game play on a gaming device is shown, according to one embodiment. A first image 500B may include a display 520, a first must-hit progressive jackpot area 522, a second must-hit progressive jackpot area 542, a reel area 560, and one or more reels 562 in the reel area 560. In one example, first must-hit progressive jackpot area 522 may include a first title area 524 (e.g., MUST HIT PROGRESSIVE JACKPOT 1), a first must-hit progressive jackpot amount area 526 which may include a first must-hit progressive jackpot dollar amount 528 which may include a dollar amount area (e.g., $155) and a first must-hit progressive jackpot cent area 532 (e.g., between 0.01 and 0.02) separated by a first must-hit progressive jackpot decimal 530. In this example, the first must-hit progressive dollar amount 528 may increase by a few cents for every spin activated (e.g., from 0.01 to 0.10, from 0.01 to 0.05, from 0.01 to 0.50, etc.) which may be dependent on the amount of the wager per spin. For example, a maximum credit wager may increase the first must-hit progressive dollar amount 528 by 10 cents. Whereas, a minimum credit wager may increase the first must-hit progressive dollar amount 528 by 1 cent and/or nothing. Whereas, an average wager (between the maximum and minimum wagering amounts) may increase the first must-hit progressive dollar amount 528 by 3 cents.

In this example, second must-hit progressive jackpot area 542 may include a second title area 544 (e.g., MUST HIT PROGRESSIVE JACKPOT 2), a second must-hit progressive jackpot amount area 546 which may include a second must-hit progressive jackpot dollar amount 548 which may include a dollar amount area (e.g., $1015) and a second must-hit progressive jackpot cent area 552 (e.g., between 0.03 and 0.04) separated by a second must-hit progressive jackpot decimal 550. In this example, the second must-hit progressive dollar amount 548 may increase by a few cents for every spin activated (e.g., from 0.01 to 0.10, from 0.01 to 0.05, from 0.01 to 0.50, 0.0 to 0.99, etc.) which may be dependent on the amount of the wager per spin. For example, a maximum credit wager may increase the second must-hit progressive dollar amount 548 by 35 cents. Whereas, a minimum credit wager may increase the second must-hit progressive dollar amount 548 by 1 cent and/or nothing. Whereas, average wager (between the maximum and minimum wagering amounts) may increase the second must-hit progressive dollar amount 548 by 15 cents. In various examples, one, a few, and/or a plurality of progressives may be turbo boost based progressives while one, a few, and/or a plurality of progressives may be non-turbo boost based progressives. In this example, the first must hit jackpot 1 is a turbo boost progressive while the second must hit jackpot 2 is a non-turbo boost progressive.

Figure 5C:
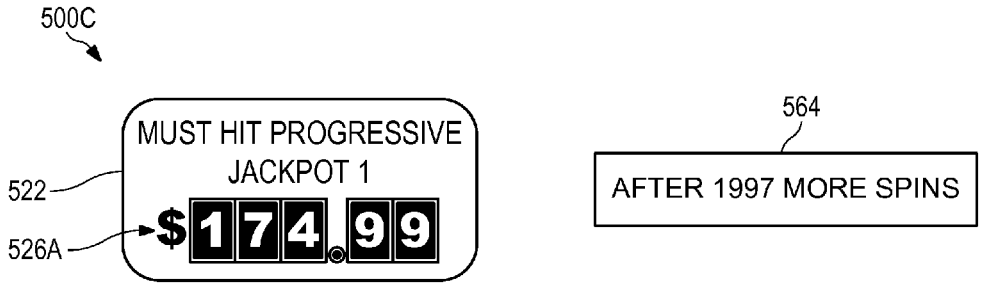
FIG. 5C is an illustration of progressive game play on a gaming device, according to one embodiment.

In FIG. 5C, an illustration of a progressive game play on a gaming device is shown, according to one embodiment. A second image 500C may include first must-hit progressive jackpot area 522 which may have a must win amount of $200. However, based on a random number generator (and/or any other random and/or predetermined method) the first must-hit progressive jackpot area 522 will be triggered and paid out at any amount over $175. In other words, even though the first must-hit progressive jackpot area 522 is advertised to be won before $200, the actual amount may be any number under $200. In this case, this amount is $175. Therefore, as can be seen in FIG. 5C, it would require 1997 more spins (based on 1 cent being added to the progressive amount for every spin) from the base case seen in FIG. 5B for first must-hit progressive jackpot area 522 to be 1 cent from being triggered and paid out.

Figure 5D:
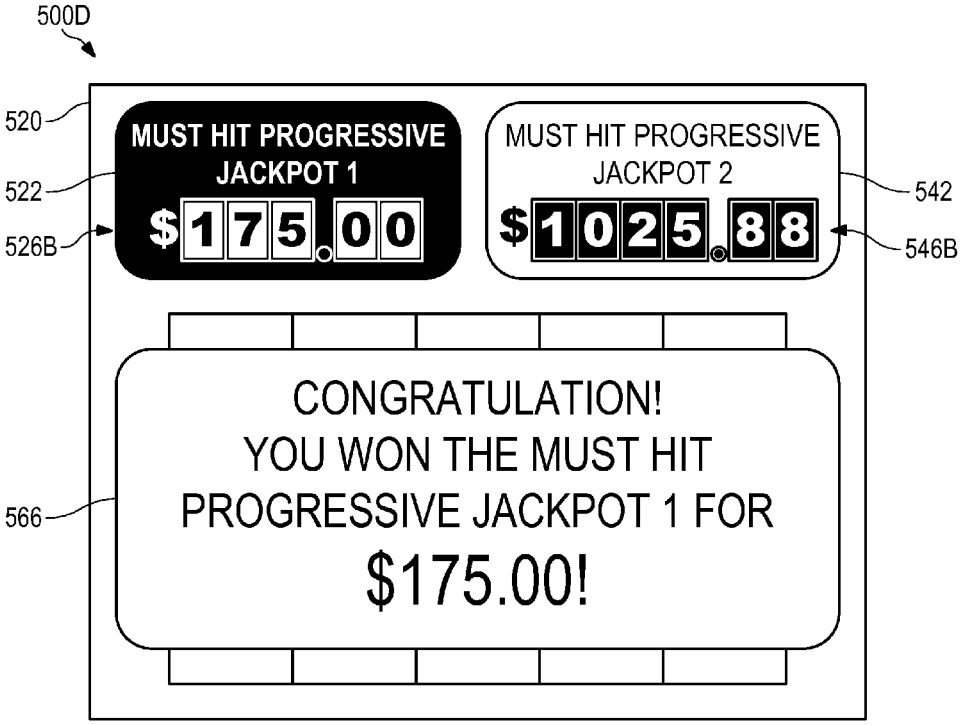
FIG. 5D is an illustration of turbo boost progressive game play on a gaming device, according to one embodiment.
Figure 5E:
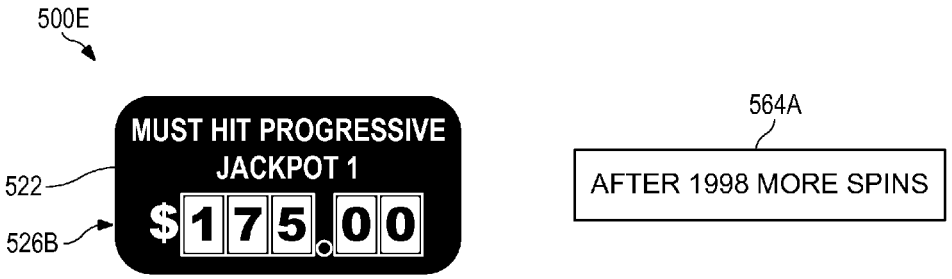
FIG. 5E is another illustration of turbo boost progressive game play on a gaming device, according to one embodiment.

In another example shown in FIG. 5D, the first must-hit progressive jackpot area 522 is triggered and paid out on the next spin because the progressive payout trigger amount (e.g., 175) has been triggered. Therefore, it would require 1998 more spins (based on 1 cent being added to the progressive amount for every spin) from the base case seen in FIG. 5B for first must-hit progressive jackpot area 522 to be triggered and paid out.

Figure 6A:
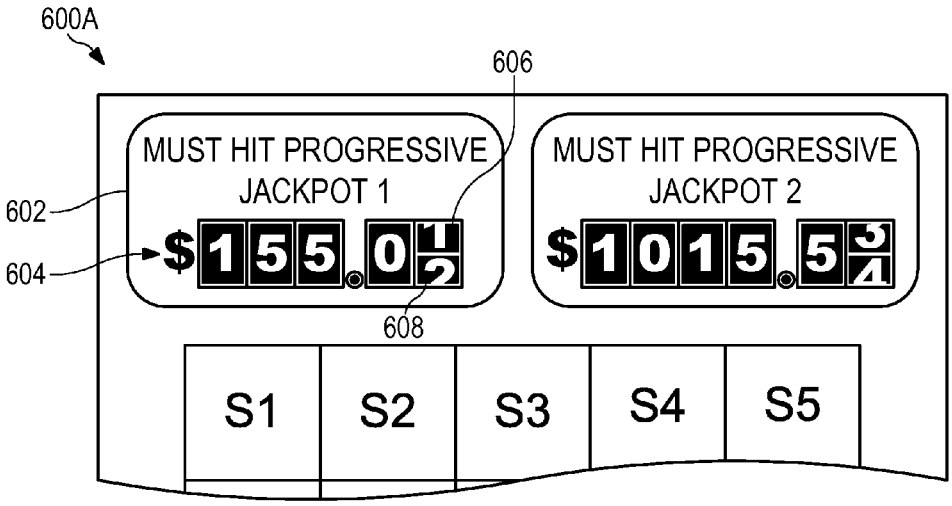
FIG. 6A is another illustration of turbo boost progressive game play on a gaming device, according to one embodiment.

In FIG. 6A, another illustration of turbo boost progressive game play on a gaming device is shown, according to one embodiment. A third image 600A may include a display, a first must-hit progressive jackpot area 602, a second must-hit progressive jackpot area, a reel area, and one or more reels in the reel area. In one example, first must-hit progressive jackpot area 602 may include a first title area (e.g., MUST HIT PROGRESSIVE JACKPOT 1), a first must-hit progressive jackpot amount area 604 which may include a first must-hit progressive jackpot dollar amount which may include a dollar amount area (e.g., $155) and a first must-hit progressive jackpot cent area (e.g., between 0.01 (reference number 606) and 0.02 (reference number 608)) separated by a first must-hit progressive jackpot decimal. In this example, the first must-hit progressive dollar amount 604 may increase by a few cents for every spin activated (e.g., from 0.01 to 0.10, from 0.01 to 0.03, from 0.01 to 0.15, 0.03 to 0.43, etc.) which may be dependent on the amount of the wager per spin. For example, a maximum credit wager may increase the first must-hit progressive dollar amount 604 by 5 cents. Whereas, a minimum credit wager may increase the first must-hit progressive dollar amount 604 by 1 cent and/or nothing. Whereas, an average wager (between the maximum and minimum wagering amounts) may increase the first must-hit progressive dollar amount 604 by 2 cents.

Figure 6B:
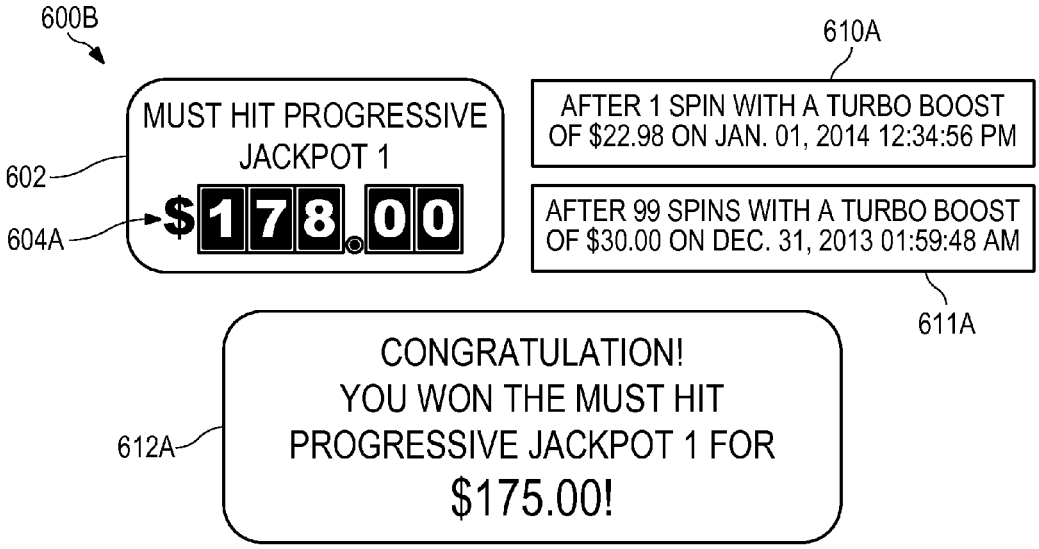
FIG. 6B is another illustration of turbo boost progressive game play on a gaming device, according to one embodiment.

In FIG. 6B, another illustration of turbo boost progressive game play on a gaming device is shown, according to one embodiment. In this example, after one spin a turbo boost message 612A is shown which states "CONGRATULATIONS! YOU WON THE MUST HIT PROGRESSIVE JACKPOT 1 FOR $175!" In this example, a turbo boost amount (e.g., $22.98) was added to the jackpot amount of $155.02 which was over the progressive jackpot payout trigger amount of $175. Therefore, the electronic gaming machine awarded the player either the $175.00 (trigger amount) or the $178.00 (actual amount–$155.02 (jackpot amount before spin)+$22.98 (turbo boost amount)=$178.00). In other examples, the turbo boost amount may be added to the jackpot value during the spin and/or before the spin. In one example, the turbo boost award may be rewarded before the primary game play is initiated. This turbo boost reward may be based on one or more player characteristics. For example, to encourage a player to continue playing (in one example, a player may only have a balance of $5 left and the player has been playing for an hour—therefore, the game may award a turbo boost bonus to entice the player to keep playing and/or may be utilized in an attract mode). Further, the turbo boost award may be rewarded during the primary game play and/or one or more turbo boost presentations may be initiated. In another example, the turbo boost amount may be recorded and shown as a history on the display. For example, a first history area 610A may state that "After Spin X the Turbo Boost was increased by $22.98 on X date and Y time." Further, a second history area 611A may state that After Spin A the Turbo Boost was increased by $30.00 on B date and C time."

Figure 6C:
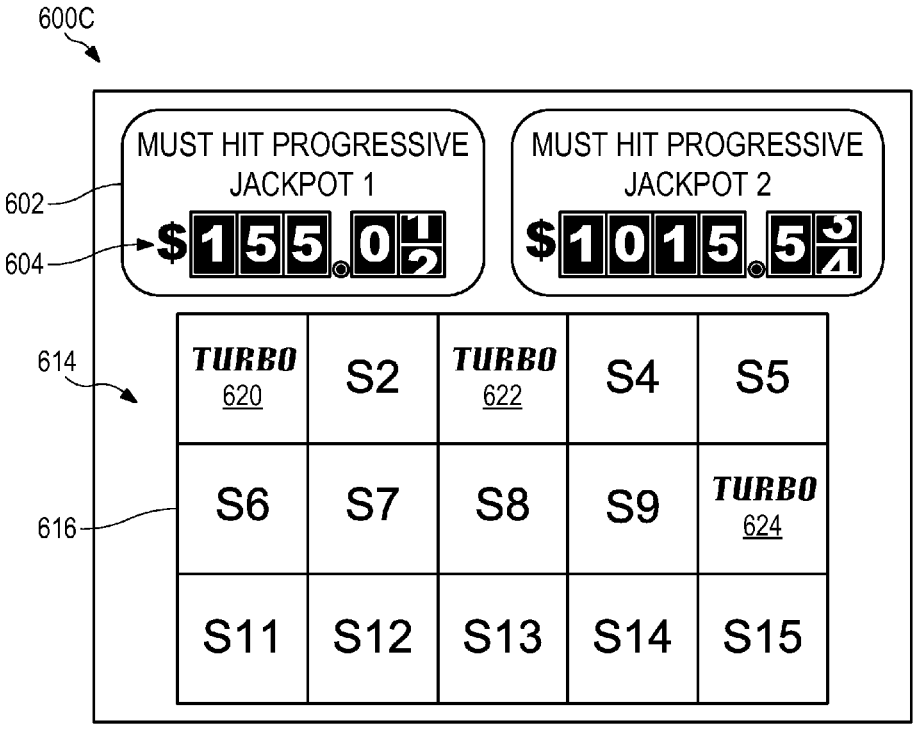
FIG. 6C is another illustration of turbo boost progressive game play on a gaming device, according to one embodiment.
Figure 6D:
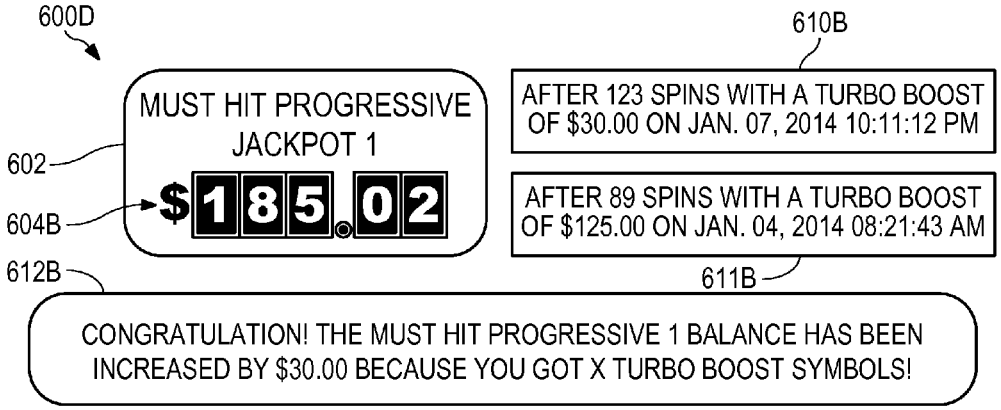
FIG. 6D is another illustration of turbo boost progressive game play on a gaming device, according to one embodiment.

In FIG. 6C, another illustration of turbo boost progressive game play on a gaming device is shown, according to one embodiment. In this example, the player has achieved via the electronic gaming device to display a first turbo symbol 620, a second turbo symbol 622, and a third turbo symbol 624 which generated a turbo boost for the must hit progressive jackpot 1 of $30.00. A second turbo boost message area 612B (see FIG. 6D) may state "CONGRATULATION! THE MUST HIT PROGRESSIVE JACKPOT 1 BALANCE HAS BEEN INCREASED BY $30.00 BECAUSE YOU GOT X TURBO BOOST SYMBOLS!" The amount of the turbo boost may be dependent on the number of turbo boost symbols, the location of the turbo boost symbols, and/or the relative positioning of the turbo boost symbols to other symbols including other turbo boost symbols. For example, if 4 turbo boost symbols were generated than a turbo boost award may be $50.00. Whereas, if 5 turbo boost symbols were generated than a turbo boost award may be $75. In another example, 4 turbo boost symbols located in the four corners of the active reels may generate a turbo boost award equaled to 10 turbo boost symbols. Further, 2 turbo boost symbols located adjacent to each other equals a turbo boost award of 3 turbo boost symbols. Where 4 turbo boost symbols located in a box formation may equal a turbo boost award equal to 8 turbo boost symbols. Further, a specific symbol configuration (e.g., a turbo boost symbol, a scatter symbol, and then another turbo boost symbol—a turbo boost symbol, a wild symbol, a scatter symbol, and then another wild symbol and then another turbo boost symbol) may generate addition turbo boost awards.

In this example, the must hit progressive jackpot 1 value has increased from $155.02 (see FIG. 6C) to $185.02 (see reference number 604B). Further, a first history area 610B may state that "After Spin X the Turbo Boost was increased by $30.00 on X date and Y time." Further, a second history area 611B may state that After Spin A the Turbo Boost was increased by $125.00 on B date and C time."

Figure 6E:
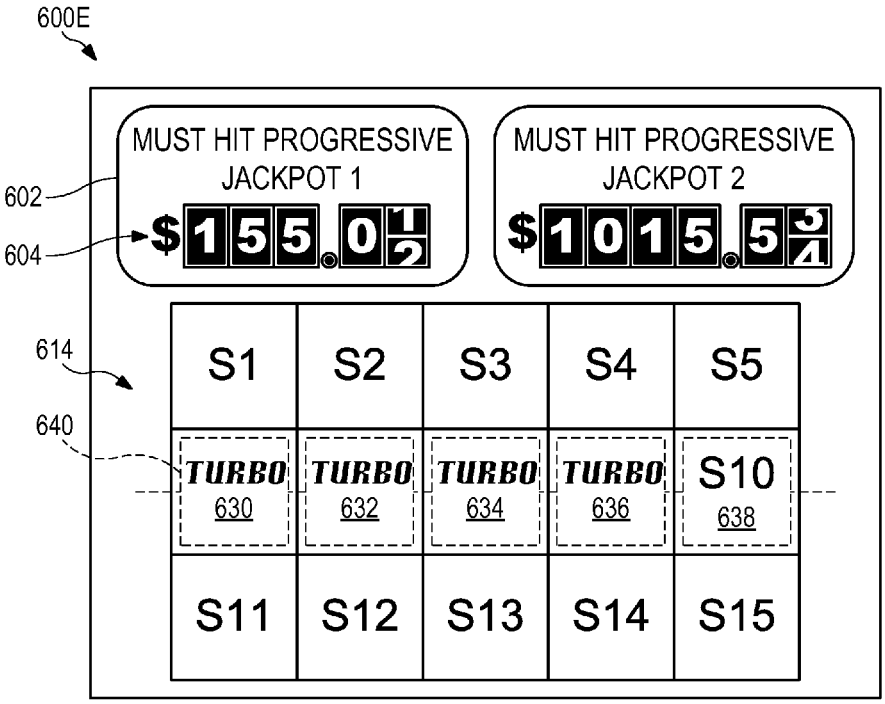
FIG. 6E is another illustration of turbo boost progressive game play on a gaming device, according to one embodiment.
Figure 6F:
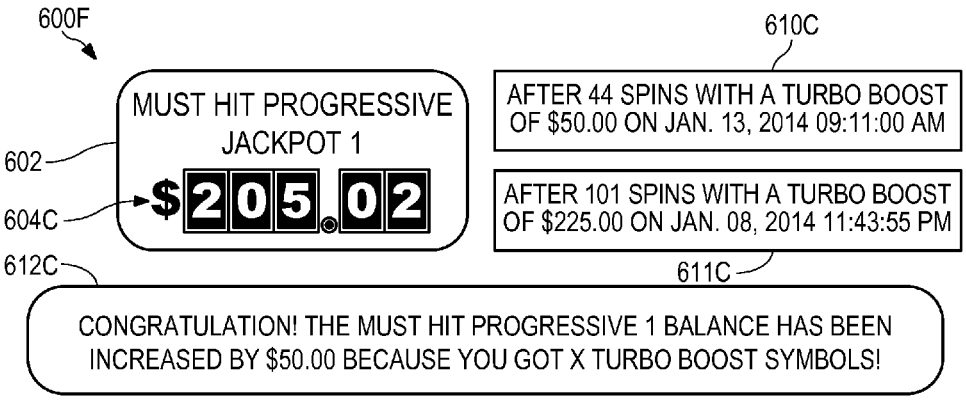
FIG. 6F is another illustration of turbo boost progressive game play on a gaming device, according to one embodiment.

In FIG. 6E, another illustration of turbo boost progressive game play on a gaming device is shown, according to one embodiment. In this example, the game play has generated a first turbo boost symbol 630, a second turbo boost symbol 632, a third turbo boost symbol 634, and a fourth turbo boost symbol 636. These turbo boost symbols are lined up in a row (see reference number 640) which may achieve a turbo boost progressive amount award of $50.00. Whereas, if these four turbo boost symbols where not lined up in a row the turbo boost progressive amount award may have only been $40.00. Further, since these four turbo boost symbols where lined up in a row and next to a special symbol 638, the turbo boost progressive amount award may have been increased 3× to $150.00. In this example, a third turbo boost message area 612C (see FIG. 6F) may state "CONGRATULATION! THE MUST HIT PROGRESSIVE JACKPOT 1 BALANCE HAS BEEN INCREASED BY $50.00 BECAUSE YOU GOT X TURBO BOOST SYMBOLS!" In another example, the special symbol next to a turbo boost symbol may generate a multiplier, free spins, and/or an instant winning of the progressive. In another example, the turbo boost symbols in a W shape may generate an award including an instant win of the progressive. Further, the turbo boost symbols in an S shape may generate a super turbo boost (e.g., larger award, a pick round, etc.) and/or bonus round. Further, a theme-based symbol (e.g., Superman, etc.) may generate a super turbo boost and/or bonus round. In addition, a theme-based symbol(s) in a shape (e.g., an O, an L, a Z, etc.) may generate a skill based bonus round.

In this example, the must hit progressive jackpot 1 value has increased from $155.02 (see FIG. 6F) to $200.02 (see reference number 604C). Further, a first history area 610C may state that "After Spin X the Turbo Boost was increased by $50.00 on X date and Y time." Further, a second history area 611C may state that After Spin A the Turbo Boost was increased by $225.00 on B date and C time."

Figure 6G:
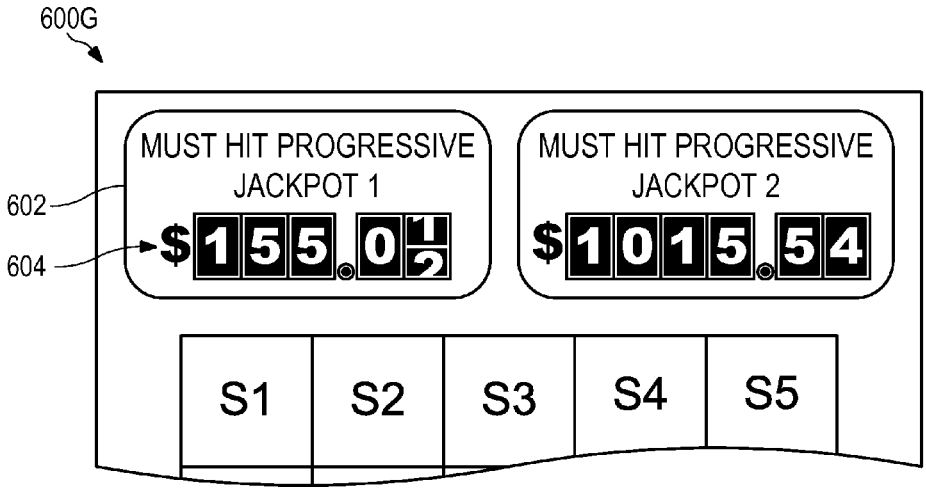
FIG. 6G is another illustration of turbo boost progressive game play on a gaming device, according to one embodiment.

In FIG. 6G, another illustration of turbo boost progressive game play on a gaming device is shown, according to one embodiment. In this example, the game play has increased the must hit progressive jackpot 1 value to over $155.00 which was a randomly determined and/or predetermined progressive jackpot turbo boost increase level. Once the progress jackpot value reaches this level (in this case $155.00), a turbo boost value is awarded to increase the jackpot by a predetermined, specific, and/or randomly determined number. In this case, the amount is $10.00 which was predetermined. Therefore, the progressive jackpot 1 amount increases from $155.02 to $165.02.

Figure 6H:
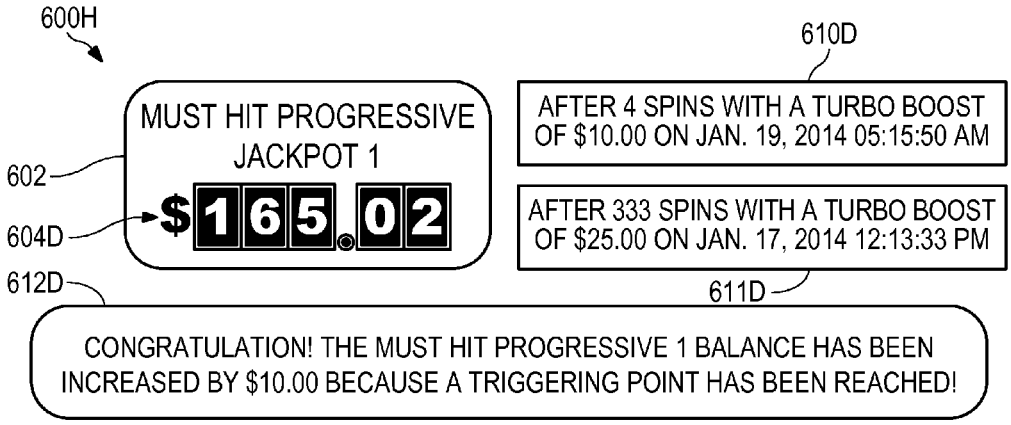
FIG. 6H is another illustration of turbo boost progressive game play on a gaming device, according to one embodiment.

In this example, a fourth turbo boost message area 612D (see FIG. 6H) may state "CONGRATULATION! THE MUST HIT PROGRESSIVE JACKPOT 1 BALANCE HAS BEEN INCREASED BY $10.00 BECAUSE A TRIGGERING POINT HAS BEEN REACHED!" In another example, one or more turbo boost awards may be in a stair-step function and/or step function and/or any pattern and/or any combination thereof. In one example, a first turbo boost award may be triggered at $105 which increases the progressive amount to $110 (e.g., $5 turbo boost award), a second turbo boost award may be triggered at $130 which increases the progressive amount to $137 (e.g., $7 turbo boost award), and a third turbo boost award may be triggered at $155 which increases the progressive amount to $165 (e.g., $10 turbo boost award). In various examples, the step function and/or any other function can have any number of levels (e.g., 1 to N).

In this example, the must hit progressive jackpot 1 value has increased from $155.02 (see FIG. 6G) to $165.02 (see reference number 604D). Further, a first history area 610D may state that "After Spin X the Turbo Boost was increased by $10.00 on X date and Y time." Further, a second history area 611D may state that After Spin A the Turbo Boost was increased by $35.00 on B date and C time."

Figure 6J:
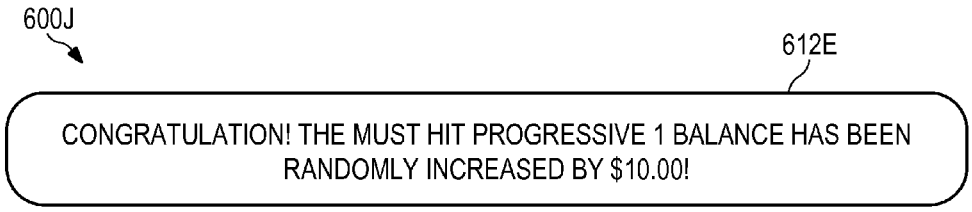
FIG. 6J is another illustration of turbo boost progressive game play on a gaming device, according to one embodiment.

In another example shown in FIG. 6J, turbo boost may be randomly awarded independent of another game outcome and/or any other gaming function. In various examples, the turbo boost award may be based on a different RNG, the time of day, a special event, a sponsor's contribution, the player, one or more player characteristics, the player's play period, a group's play period, the amount wagered on the turbo boost games during a specific period, a third party event (e.g., Superbowl), and/or any combination thereof.

Figure 6K:
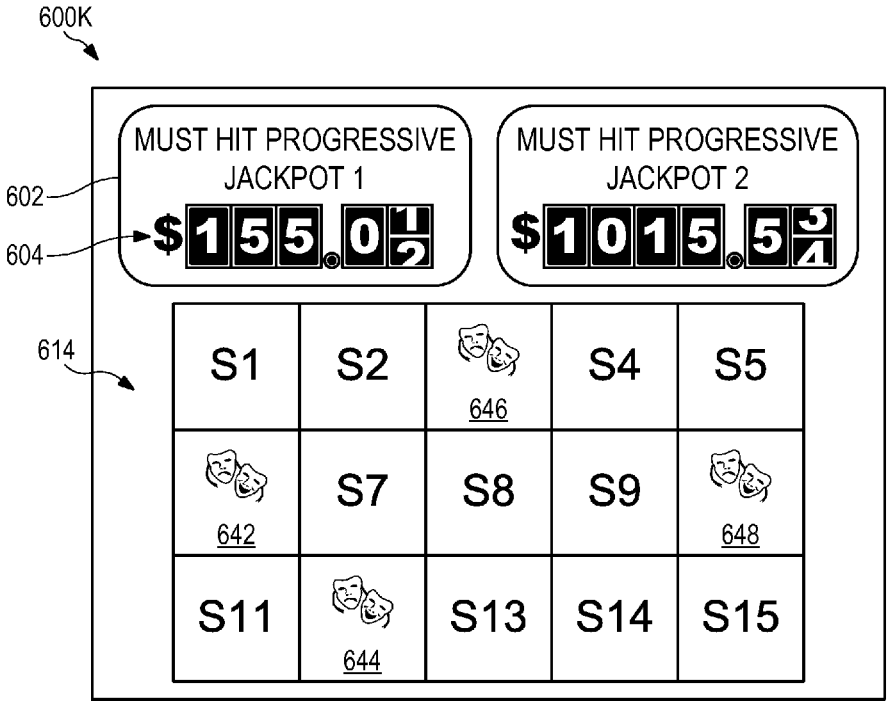
FIG. 6K is another illustration of turbo boost progressive game play on a gaming device, according to one embodiment.

In FIG. 6K, another illustration of turbo boost progressive game play on a gaming device is shown, according to one embodiment. In this example, a first symbol 642, a second symbol 644, a third symbol 646, and a fourth symbol 648 may be generated and displayed. In this example, the symbols (e.g., first symbol 642, second symbol 644, third symbol 646, and fourth symbol 648) may be special symbols, themed symbols, the same symbols, and/or different symbols. However, once a specific number (1-N and in this case 4) of symbols are generated and displayed on one or more active reels areas, a turbo boost amount is awarded. In this example, a turbo boost amount of $50 is awarded.

Figure 6L:
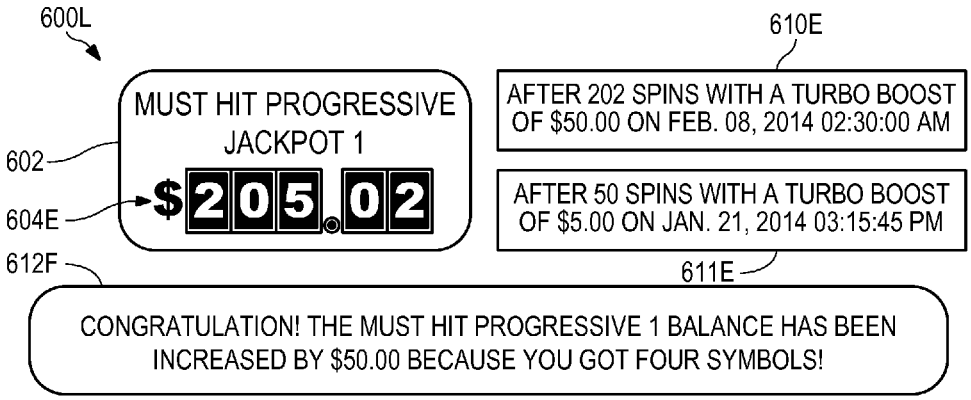
FIG. 6L is another illustration of turbo boost progressive game play on a gaming device, according to one embodiment.

In this example, a fifth turbo boost message area 612E (see FIG. 6L) may state "CONGRATULATION! THE MUST HIT PROGRESSIVE JACKPOT 1 BALANCE HAS BEEN INCREASED BY $50.00 BECAUSE FOUR SYMBOLS WERE DISPLAYED!"

In this example, the must hit progressive jackpot 1 value has increased from $155.02 (see FIG. 6K) to $205.02 (see reference number 604E). Further, a first history area 610E may state that "After Spin X the Turbo Boost was increased by $50.00 on X date and Y time." Further, a second history area 611E may state that After Spin A the Turbo Boost was increased by $500.00 on B date and C time."

Figure 6M:
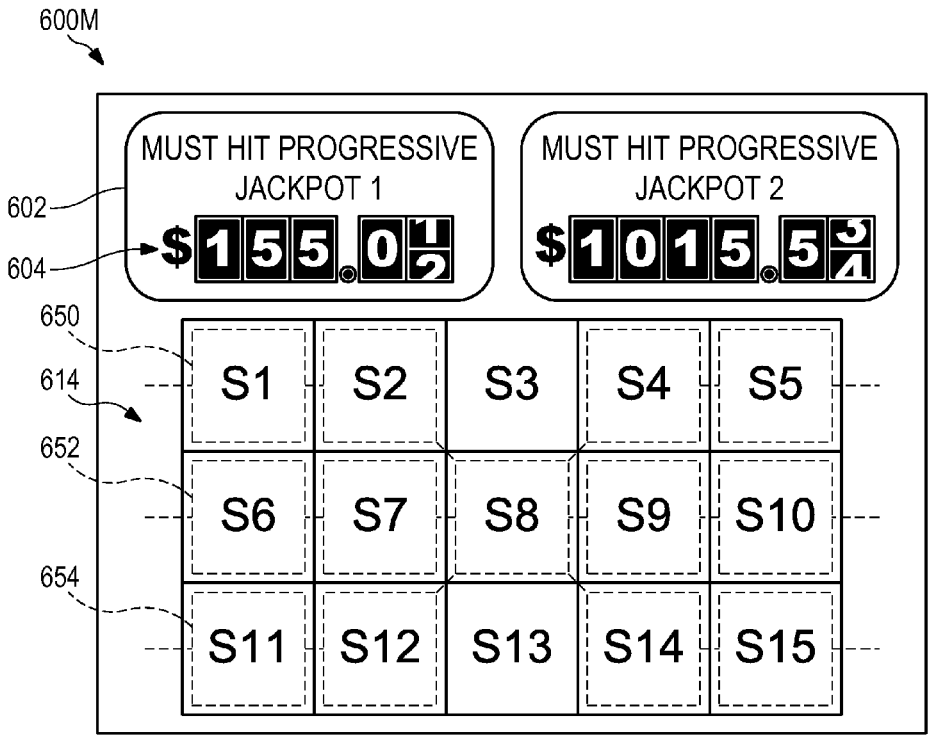
FIG. 6M is another illustration of turbo boost progressive game play on a gaming device, according to one embodiment.

In FIG. 6M, another illustration of turbo boost progressive game play on a gaming device is shown, according to one embodiment. In this example, three winning paylines (e.g., a first winning payline 650, a second winning payline 652, and a third winning payline 654) were achieved during game play which generated a turbo boost amount of $50.00. In other examples, different winning payline amounts can change the turbo boost award amount. For example, 5 winning paylines may generate an award of a $75 turbo boost amount. Further, 10 winning paylines may generate an award of $200 turbo boost amount, a multiplier, and a bonus game round.

Figure 6N:
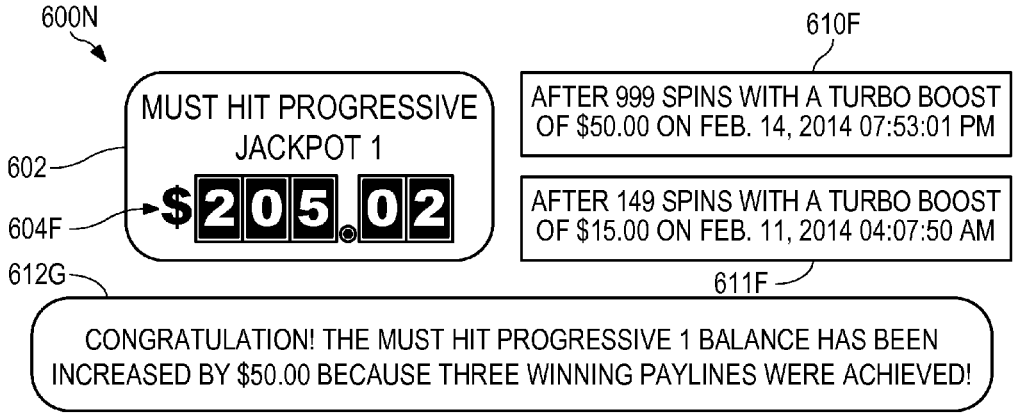
FIG. 6N is another illustration of turbo boost progressive game play on a gaming device, according to one embodiment.

In this example, a fifth turbo boost message area 612E (see FIG. 6N) may state "CONGRATULATION! THE MUST HIT PROGRESSIVE JACKPOT 1 BALANCE HAS BEEN INCREASED BY $50.00 BECAUSE THREE WINNING PAYLINES WERE ACHIEVED!"

In this example, the must hit progressive jackpot 1 value has increased from $155.02 (see FIG. 6M) to $205.02 (see reference number 604F). Further, a first history area 610F may state that "After Spin X the Turbo Boost was increased by $50.00 on X date and Y time." Further, a second history area 611D may state that After Spin A the Turbo Boost was increased by $15.00 on B date and C time."

Figure 6P:
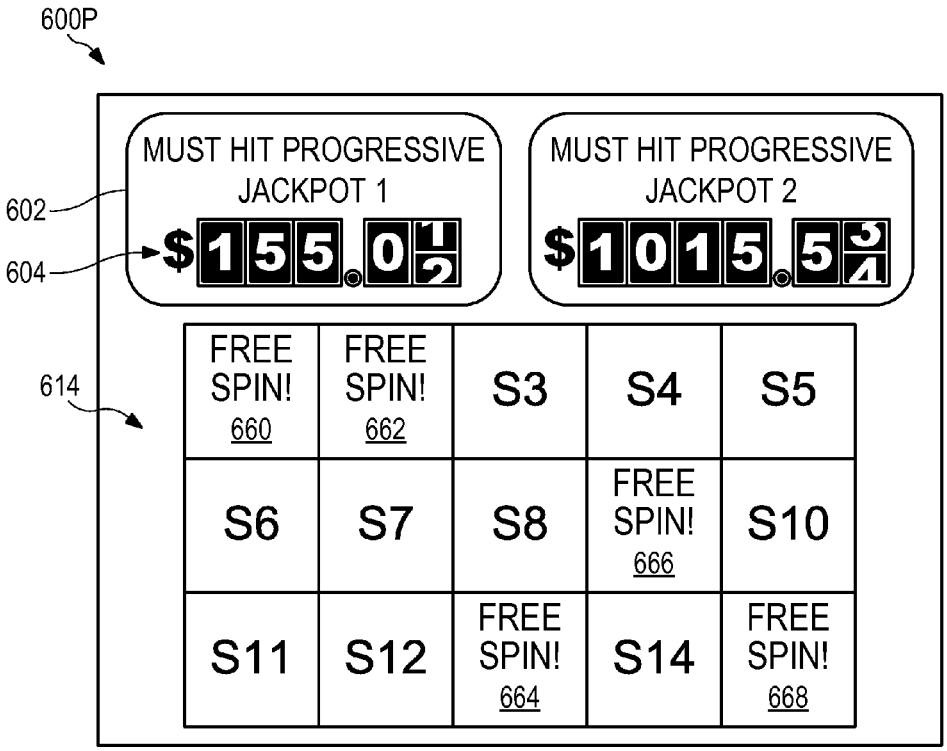
FIG. 6P is another illustration of turbo boost progressive game play on a gaming device, according to one embodiment.

In FIG. 6P, another illustration of turbo boost progressive game play on a gaming device is shown, according to one embodiment. In this example, five free spins (e.g., a first free spin 660, a second free spin 662, a third free spin 664, a fourth free spin 666, and a fifth free spin 668) were achieved during game play which generated a turbo boost amount of $50.00. In various examples, different number of free spin awards can change the turbo boost award amount. For example, 5 free spins may generate an award of a $75 turbo boost amount. Further, 10 free spins may generate an award of $200 turbo boost amount, a multiplier, and a bonus game round.

In this example, a sixth turbo boost message area 612H (see FIG. 6Q) may state "CONGRATULATION! THE MUST HIT PROGRESSIVE JACKPOT 1 BALANCE HAS BEEN INCREASED BY $50.00 BECAUSE FIVE FREE SPINS WERE AWARDED!"

In this example, the must hit progressive jackpot 1 value has increased from $155.02 (see FIG. 6P) to $205.02 (see reference number 604G). Further, a first history area 610G may state that "After Spin X the Turbo Boost was increased by $50.00 on X date and Y time." Further, a second history area 611G may state that After Spin A the Turbo Boost was increased by $15.00 on B date and C time."

Figure 6Q:
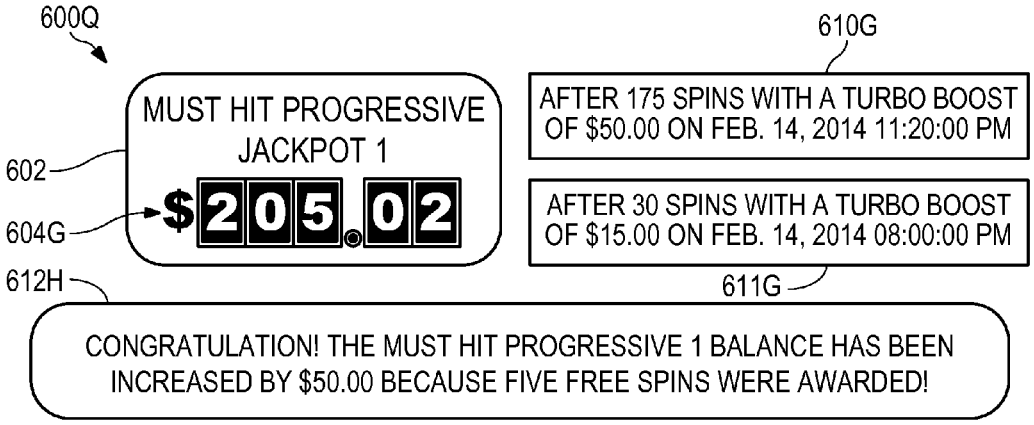
FIG. 6Q is another illustration of turbo boost progressive game play on a gaming device, according to one embodiment.

In FIG. 6Q, another illustration of turbo boost progressive game play on a gaming device, according to one embodiment. In this example, a 10× multiplier was achieved during game play which generated a turbo boost amount of $50.00. In various examples, different number of multiplier awards can change the turbo boost award amount. For example, a 5× multiplier may generate an award of a $75 turbo boost amount. Further, a 10× multiplier may generate an award of $200 turbo boost amount, a super multiplier, and a bonus game round.

Figure 6R:
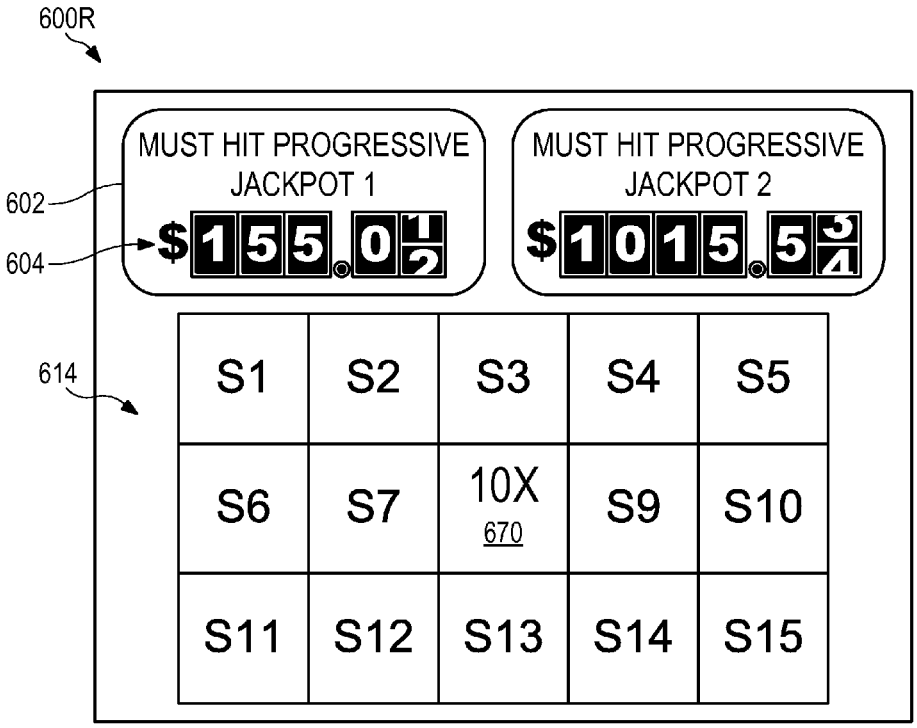
FIG. 6R is another illustration of turbo boost progressive game play on a gaming device, according to one embodiment.
Figure 6S:
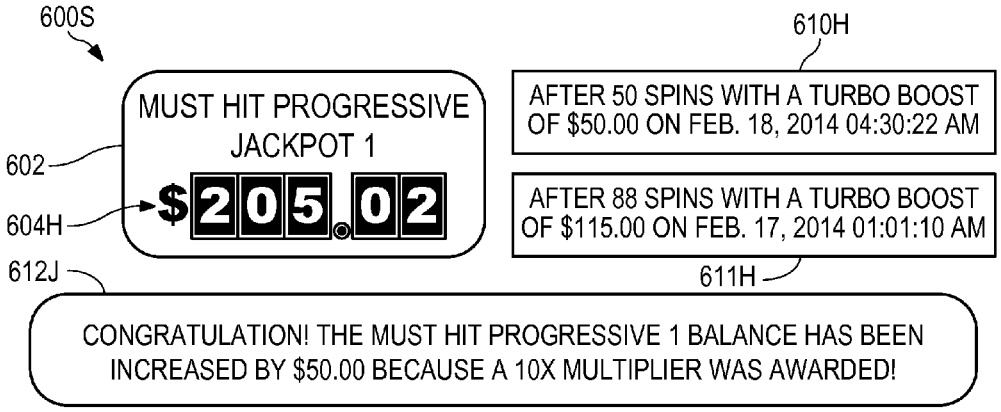
FIG. 6S is another illustration of turbo boost progressive game play on a gaming device, according to one embodiment.

In this example, a fifth turbo boost message area 612J (see FIG. 6S) may state "CONGRATULATION! THE MUST HIT PROGRESSIVE JACKPOT 1 BALANCE HAS BEEN INCREASED BY $50.00 BECAUSE A 10× MULTIPLIER WAS GENERATED!"

In this example, the must hit progressive jackpot 1 value has increased from $155.02 (see FIG. 6R) to $205.02 (see reference number 604H). Further, a first history area 610H may state that "After Spin X the Turbo Boost was increased by $50.00 on X date and Y time." Further, a second history area 611H may state that After Spin A the Turbo Boost was increased by $115.00 on B date and C time."

Figure 6T:
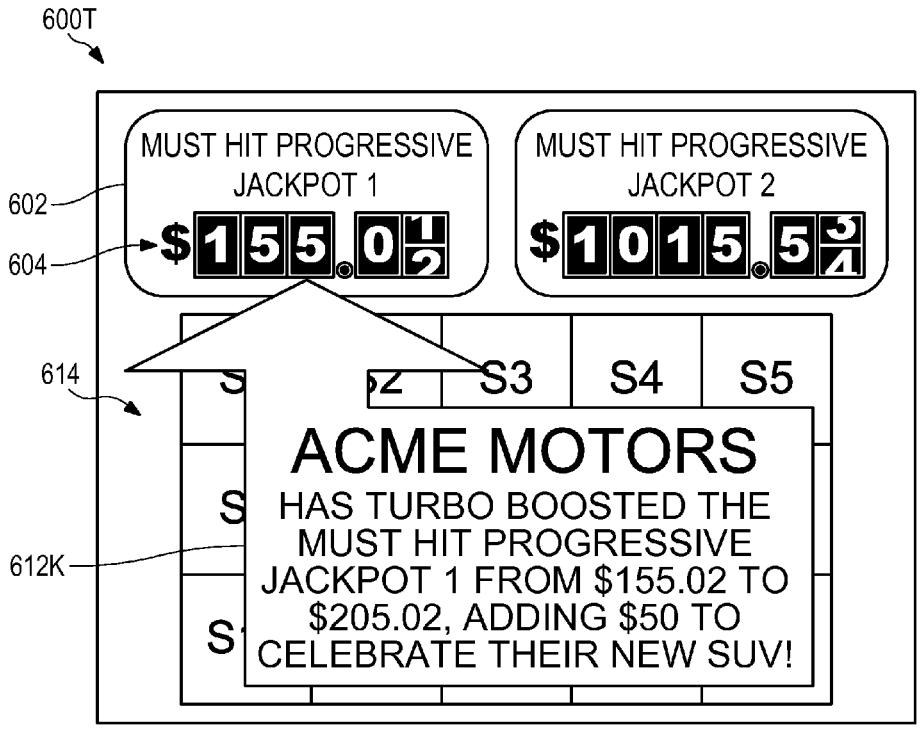
FIG. 6T is another illustration of turbo boost progressive game play on a gaming device, according to one embodiment.
Figure 6U:
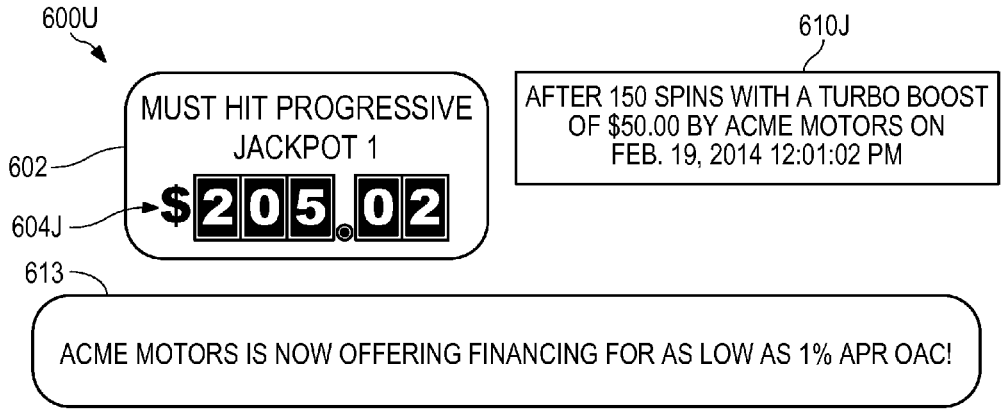
FIG. 6U is another illustration of turbo boost progressive game play on a gaming device, according to one embodiment.

In FIG. 6T, another illustration of turbo boost progressive game play on a gaming device is shown, according to one embodiment. In this example, an external party (e.g., advertiser, local group, etc.) may increase a progressive amount by paying for and/or subsidizing one or more turbo boost awards. In this example, ACME MOTORS has turbo boosted the must hit progressive by $50 to celebrate their new SUV lineup. A message area 612K may state "ACME MOTORS HAS TURBO BOOSTED THE MUST HIT PROGRESSIVE JACKPOT 1 VALUE FROM $155.02 TO $205.02, ADDING $50 TO CELEBRATE THEIR NEW SUV!" A first history area 610J may state that the turbo boost of $50 was sponsored by ACME MOTORS on X date and Y time. Further, a marketing message 613 could include one or more promotions and/or coupons from the third party (see FIG. 6U).

Figure 6V:
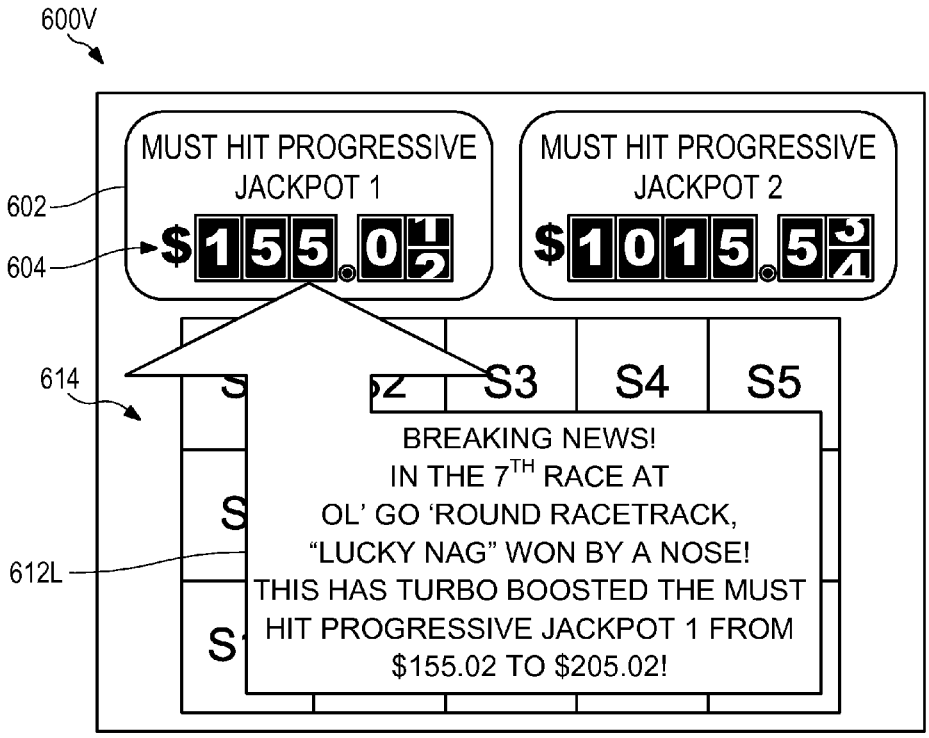
FIG. 6V is another illustration of turbo boost progressive game play on a gaming device, according to one embodiment.
Figure 6W:
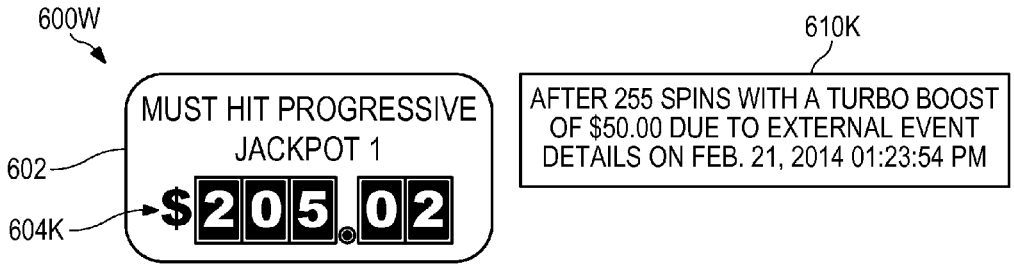
FIG. 6W is another illustration of turbo boost progressive game play on a gaming device, according to one embodiment.

In FIG. 6V, another illustration of turbo boost progressive game play on a gaming device is shown, according to one embodiment. In this example, an external event may trigger one or more turbo boosts for one or more progressives. In this example, the results of a horse race may trigger one or more turbo boosts for one or more progressives. These external events may be special events tied to a player. For example, the external event may be a Phillies baseball game because the player is from philly. Further, the external event may be a Falcons football game because that is the player's favorite team. In addition, the external event can be a high school football game because the player attended that high school and/or a college football game because the player's son goes to that school. In another example, an external event message may state "BREAKING NEWS! IN THE 7$^{TH}$ RACE AT OL' GO 'ROUND RACETRACK, "LUCKY NAG" WON BY A NOSE! THIS HAS TURBO BOOSTED THE MUST HIT PROGRESSIVE JACKPOT 1 FROM $155.02 TO $205.02!" A first history area 610K may include the details of the external event (see FIG. 6W).

Figure 6X:
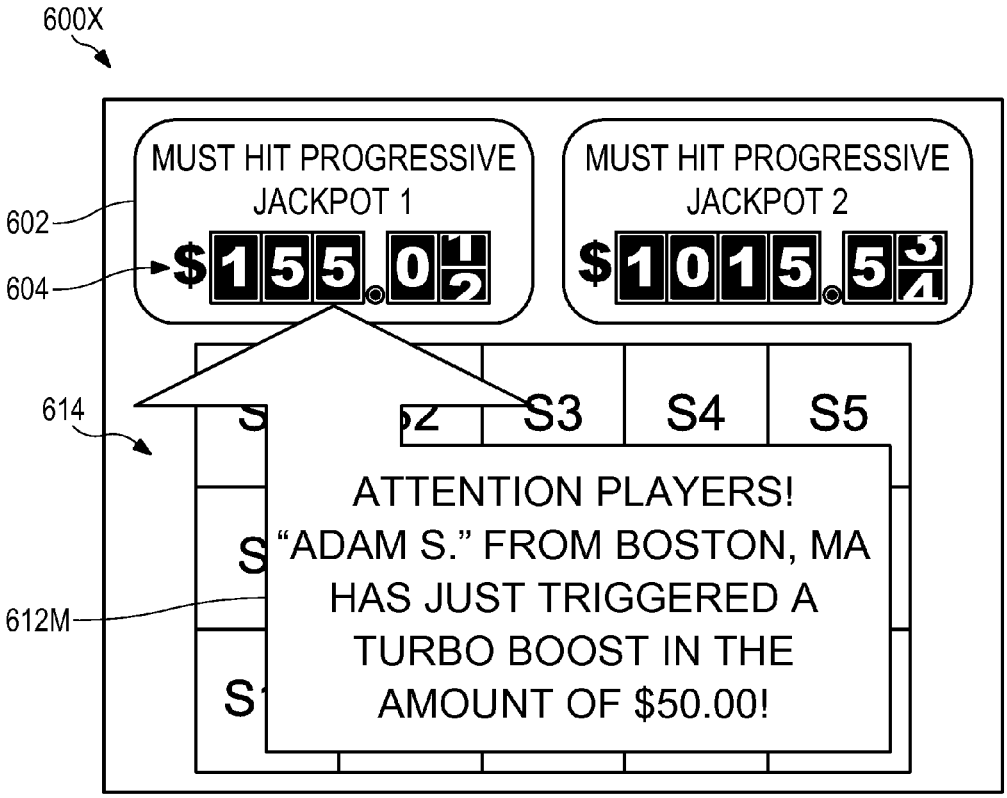
FIG. 6X is another illustration of turbo boost progressive game play on a gaming device, according to one embodiment.

In FIG. 6X, another illustration of turbo boost progressive game play on a gaming device is shown, according to one embodiment. In this example, a player playing on another machine who triggered a turbo boost bonus may be identified. In this example, a message area 612M may state "ATTENTION PLAYERS! "ADAM S." FROM BOSTON, Mass. HAS JUST TRIGGERED A TURBO BOOST IN THE AMOUNT OF $50.00!"

Figure 6Y:
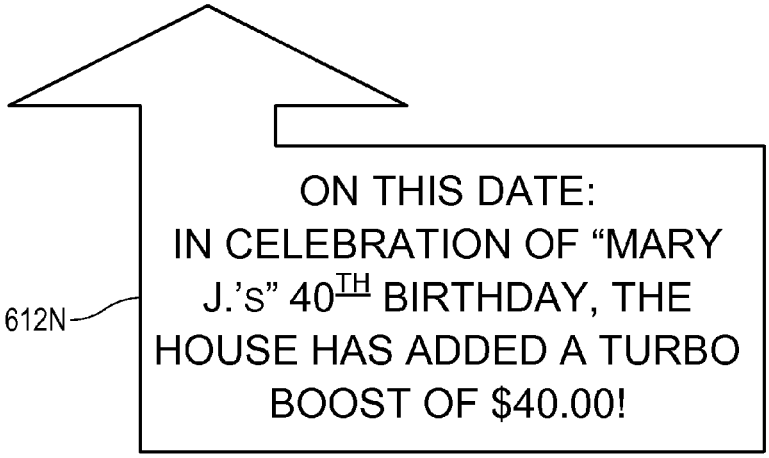
FIG. 6Y is another illustration of turbo boost progressive game play on a gaming device, according to one embodiment.

In FIG. 6Y, another illustration of turbo boost progressive game play on a gaming device is shown, according to one embodiment. In this example, a turbo boost award may be generated to celebrate a player. For example, a message 612N may state "ON THIS DATE: IN CELEBRATION OF "MARY J.'S 40$^{TH}$ BIRTHDAY, THE HOUSE HAS ADDED A TURBO BOOST OF $40.00!"

Turbo boost progressive game play may increase the progressive jackpot by the turbo boost award for gaming device 500 the player is on. Turbo boost progressive game play may increase the progressive jackpot across the entire progressive system (i.e., all gaming devices can benefit from the turbo boost balance increase). Turbo boost progressive game play may increase the progressive jackpot by the turbo boost award for any subset of gaming devices on the progressive system. Turbo boost progressive game play may increase the progressive jackpot by the turbo boost for just a period of time (i.e., next 20 minutes, next 20 spins, when player that earned the increase stops playing, etc.), may increase the progressive balance until the progressive is won, or may increase until a different turbot boost is earned and/or any other preset threshold is obtained.

By way of an example, a player on gaming device A may achieve an outcome that increases Must Hit Progressive Jackpot 1 by $30, a message may then display on message screen 566 saying how long the increase will be in effect. For example message screen 566 may display: "Must Hit Progressive Jackpot 1 increased by $30 on this gaming device for next 10-minutes." In another example message screen 566 may display: "Must Hit Progressive Jackpot 1 increased by $30 on this gaming device for next 40-spins." In another example, message screen 566 may display: "Must Hit Progressive Jackpot 1 increase by $30 system wide for next 10-minutes." In another example, message screen 566 may display: "Must Hit Progressive Jackpot 1 increased by $30 system wide for next 40-spins."

In another example, a player may trigger two or more turbo boost progressive awards. Gaming device 500 may include a process to determine how to handle two or more turbo boost progressive awards. Gaming device 500 may accept the highest turbo boost progressive awards earned, gaming device 500 may combine all the turbo boost progressive awards earned, gaming device 500 may take only a set percentage of each turbo boost progressive awards earned, and/or some other method of combination may be used.

For example, gaming device A may produce an outcome by which a first turbo boost in earned based on the presentation of turbo boost symbols and a second turbo boost is earned based on it being the player's birthday and both turbo boosts may be added to the progressive amount available to win on gaming device 500.

In another example, gaming device A may produce an outcome by which a first turbo boost is earned based on the presentation of turbo boost symbols and a second turbo boost is earned based on it being the player's birthday and both turbo boosts may be added to the progressive amount available to win by anyone playing on a gaming device connected to the same system and/or progressive as gaming device A.

In this example, gaming device A may produce an outcome by which a first turbo boost is earned based on the presentation of turbo boost symbols and a second turbo boost is earned based on it being the player's birthday and only the turbo boost providing the player with the greatest benefit may be added to the progressive amount available to win on gaming device A.

In this example, gaming device A may produce an outcome by which a first turbo boost is earned based on the presentation of turbo boost symbols and a second turbo boost is earned based on it being the player's birthday and only the turbo boost providing the player with the greatest benefit may be added to the progressive amount available to win by anyone playing on a gaming device connected to the same system and/or progressive as gaming device A.

In another example, gaming device A may produce an outcome by which a first turbo boost is earned based on the presentation of turbo boost symbols and a second turbo boost is earned based on it being the player's birthday and provide a turbo boost to the progressive based on a percentage of the amount for one or each of the turbo boosts earned (i.e., 50% of first turbo boost and 50% of second turbo boost, 100% of first turbo boost and 50% of second turbo boost, 75% of first turbo boost and 50% of second turbo boost, or any other combination of the two) may be added to the progressive amount available to win on gaming device A.

In another example, gaming device A may produce an outcome by which a first turbo boost is earned based on the presentation of turbo boost symbols and a second turbo boost is earned based on it being the player's birthday and provide a turbo boost to the progressive based on a percentage of the amount for one or each of the turbo boosts earned (i.e., 50% of first turbo boost and 50% of second turbo boost, 100% of first turbo boost and 50% of second turbo boost, 75% of first turbo boost and 50% of second turbo boost, or any other combination of the two) may be added to the progressive amount available to win by anyone playing on a gaming device connected to the same system and/or progressive as gaming device A.

In another example, a player may currently have a turbo boost progressive award earned being added to the Must Hit Progressive Jackpot 1 when the player may earn another turbo boost progressive (i.e., a $2^{nd}$ turbo boost). Gaming device 500 may then determine what to do with the $2^{nd}$ turbo boost (i.e., add to or replace the current turbo boost). Gaming device 500 may accept the highest turbo boost progressive awards earned, gaming device 500 may combine all the turbo boost progressive awards earned, gaming device 500 may take only a set percentage of each turbo boost progressive awards earned, and/or some other method of combination may be used.

By way of an example, a player, on their first spin, on gaming device A may achieve an outcome that increases Must Hit Progressive Jackpot 1 by $30, on a later additional spin (still during the time outlined for the first turbo boost progressive), the player may earn a $2^{nd}$ turbo boost which increases Must Hit Progressive Jackpot 1 by $50. Gaming device 500 may include a process to determine how $2^{nd}$ turbo boost will be treated as related to Must Hit Progressive Jackpot 1.

For example, the two turbo boost progressives could be additive and message screen 566 may display "Must Hit Progressive Jackpot 1 increased by an additional $50 for a total turbo boost of $80."

In another example, gaming device 500 may determine that $2^{nd}$ turbo boost is better than the $1^{st}$ and message screen 566 may display "Must Hit Progressive Jackpot 1 turbo boost increased by $20 due to the replacement of previously earned turbo boost of $30 with new turbo boost of $50."

In another example, gaming device 500 may give a portion of credit for each additional turbo boost earned and message screen 566 may display "Must Hit Progressive Jackpot 1 turbo boost increase by $25 based on 50% of $2^{nd}$ turbo boost."

Figure 7A:
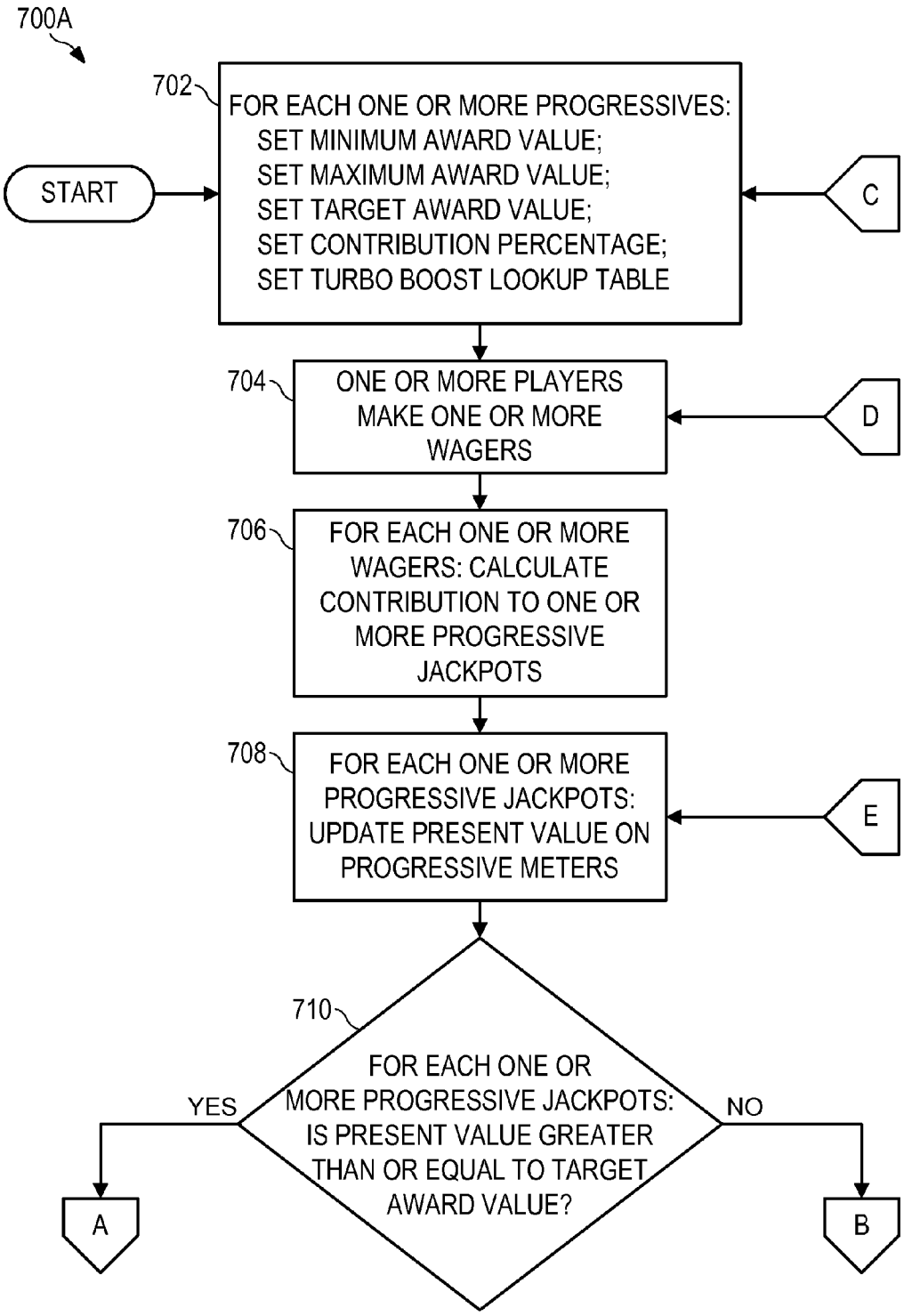
FIG. 7A is a game play flow diagram, according to one embodiment.
Figure 7B:
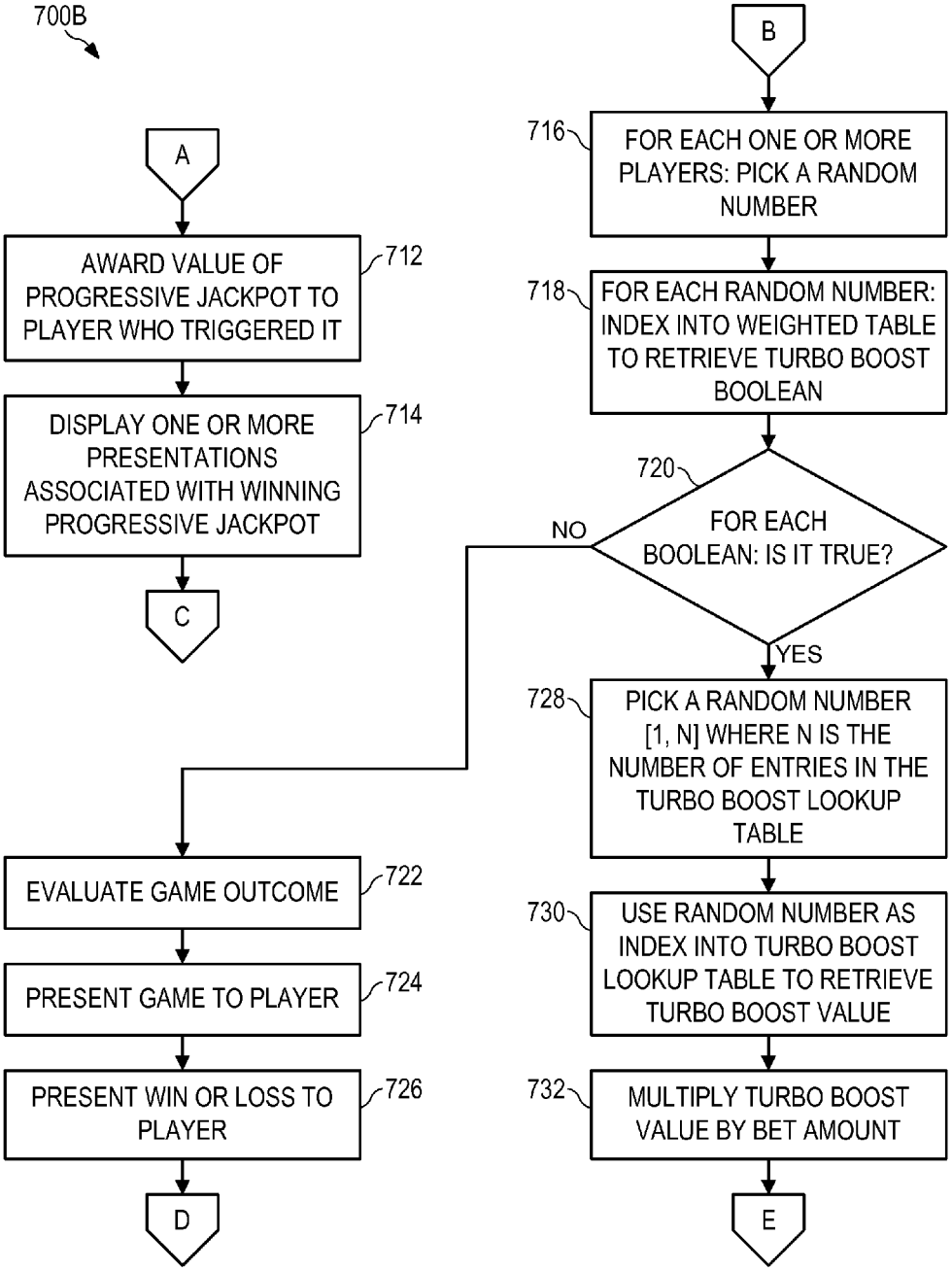
FIG. 7B is a game play flow diagram, according to one embodiment.

In FIGS. 7A-7B, a game play flow diagram 700A is shown, according to one embodiment. The method may include for each of the one or more progressives: setting one or more minimum award values; setting one or more maximum award values; setting one or more target award values; setting one or more contribution percentages; and/or setting one or more turbo boost lookup tables (step 702). The method may include one or more players making one or more wagers (step 704). The method may include for each of the one or more wagers: calculating one or more contribution amounts to one or more progressive jackpots (step 706). The method may include for each of the one or more progressive jackpots: updating one or more present values on the progressive meters (step 708). The method may include via one or more processors determining for each of the one or more progressive jackpots is the present value greater than or equal to the one or more target award values (step 710). If the present value is not greater than or equal to the one or more target award values, the method may include for each of the one or more players picking a random number (step 716). The method may include for each random number indexing into a weighted table to retrieve one or more turbo boost Boolean (step 718). The method may include via one or more processors determining for each Boolean is it true (step 720). If for each of the Booleans an untrue status is generated, then the method may include evaluating one or more game outcomes (step 722). The method may include presenting one or more games to the player (step 724). The method may include presenting win or loss information to the player (step 726). The method may return to step 704.

If for each of the Booleans a true status is generated, then the method may include picking a random number [1, N] where N is the number of entries in the turbo boost lookup table (step 728). The method may include using the random number as an index into turbo boost lookup table to retrieve turbo boost value (step 730). The method may include multiplying the turbo boost value by the bet amount (step 732). The method may return to step 708.

If the present value is greater than or equal to the one or more target award values, the method may include awarding the value of the progressive jackpot to the player (and/or EGM) who triggered it (step 712). The method may include displaying one or more presentations associated with the one or more winning progressive jackpots (step 714). The method may then move back to step 702.

Figure 7C:
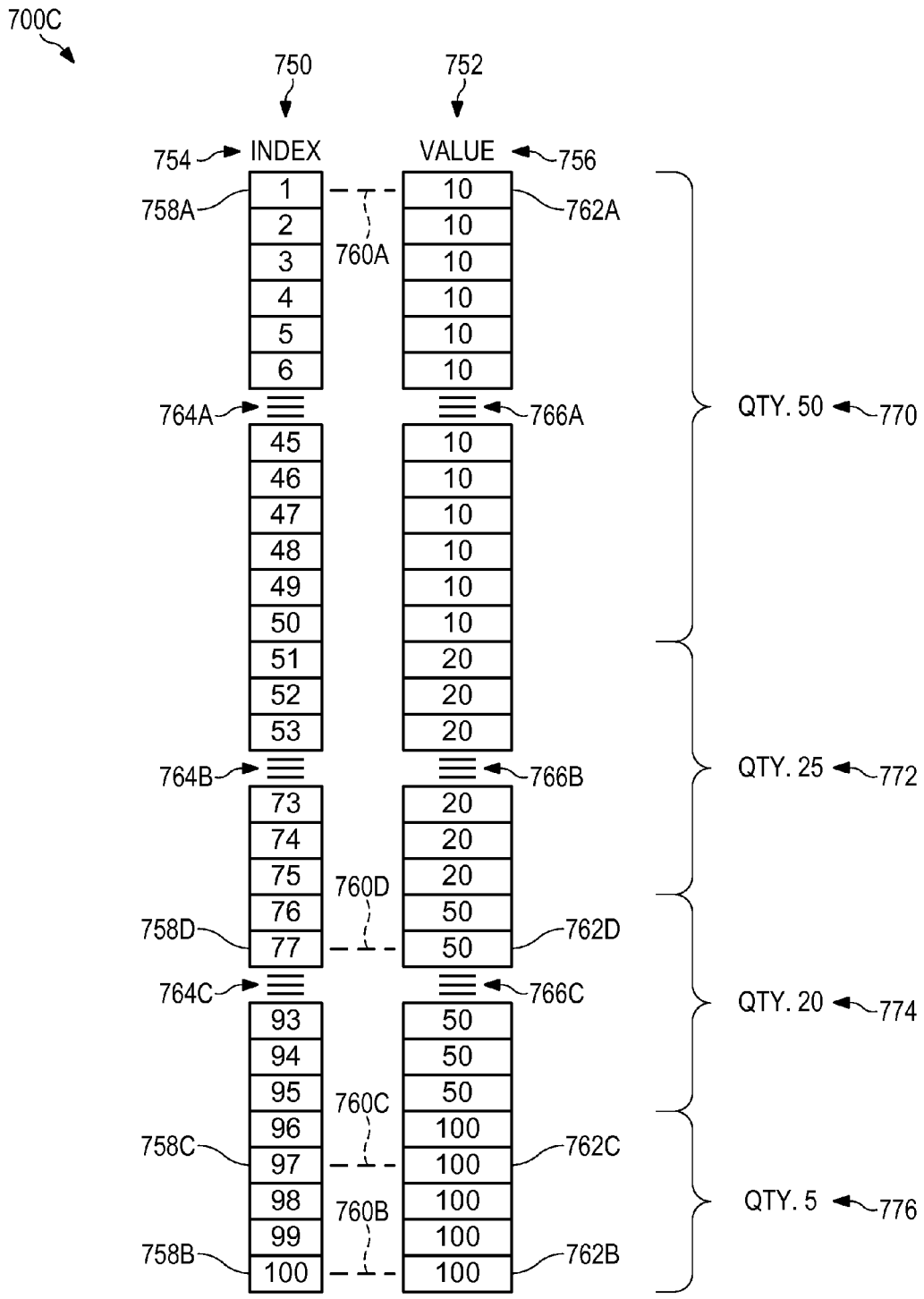
FIG. 7C is a weighted chart utilized with a turbo boost progressive, according to one embodiment.

In FIG. 7C, a weighted chart utilized with a turbo boost progressive is shown, according to one embodiment. A third image 700C may include an index column 750 and a value column 752. The index column 750 may include an index title 754 (e.g., Index) and the value column 752 may include a value title 756 (e.g., Value). In one example, the index numbers may include any numbers (e.g., 1-N). In this example, the index numbers may include 1 to 100. In one example, the value numbers may include any numbers (e.g., 1-N). In this example, the value numbers may be 10, 20, 50, and 100 but any other number may also be utilized. In one example, a first index number 758A (e.g., 1) may be linked via a first link 760A with a first value 762A (e.g., 10). One or more index numbers may be linked to one or more values. Further, a first break area 764A may include the numbers 7-44 but for brevity have been excluded. In addition, a second break area 764B may include the numbers 54-72 but for brevity have been excluded. Further, a third break area 764C may include the numbers 78-92 but for brevity have been excluded. In addition, the values in a fourth break area 766A, a fifth break area 766B, and a sixth break area 766C have been omitted for brevity and clarity purposes.

In this example, a second index number 758B (e.g., 100) may be linked via a second link 760B to a second value 762B (e.g., 100). In addition, a third index number 758C (e.g., 97) may be linked via a third link 760C to a third value 762C (e.g., 100). In addition, a fourth index number 758D (e.g., 77) may be linked via a fourth link 760D to a fourth value 762D (e.g., 50).

In one example, a first quantity area 770 includes 50 units, whereas, a second quantity area 722 includes 25 units. In this example, a third quantity area 774 includes 20 units, whereas, a fourth quantity area 776 includes 5 units. In this example, since there are 100 units the probability for: the first quantity area 770 is 50%; the second quantity area 772 is 25%; the third quantity area 774 is 20%; and the fourth quantity area 776 is 5%. In one example, the RNG generated an index value of 6 which relates to a value of 10. Therefore, the turbo boost award would be based on the value of 10.

Figure 8:
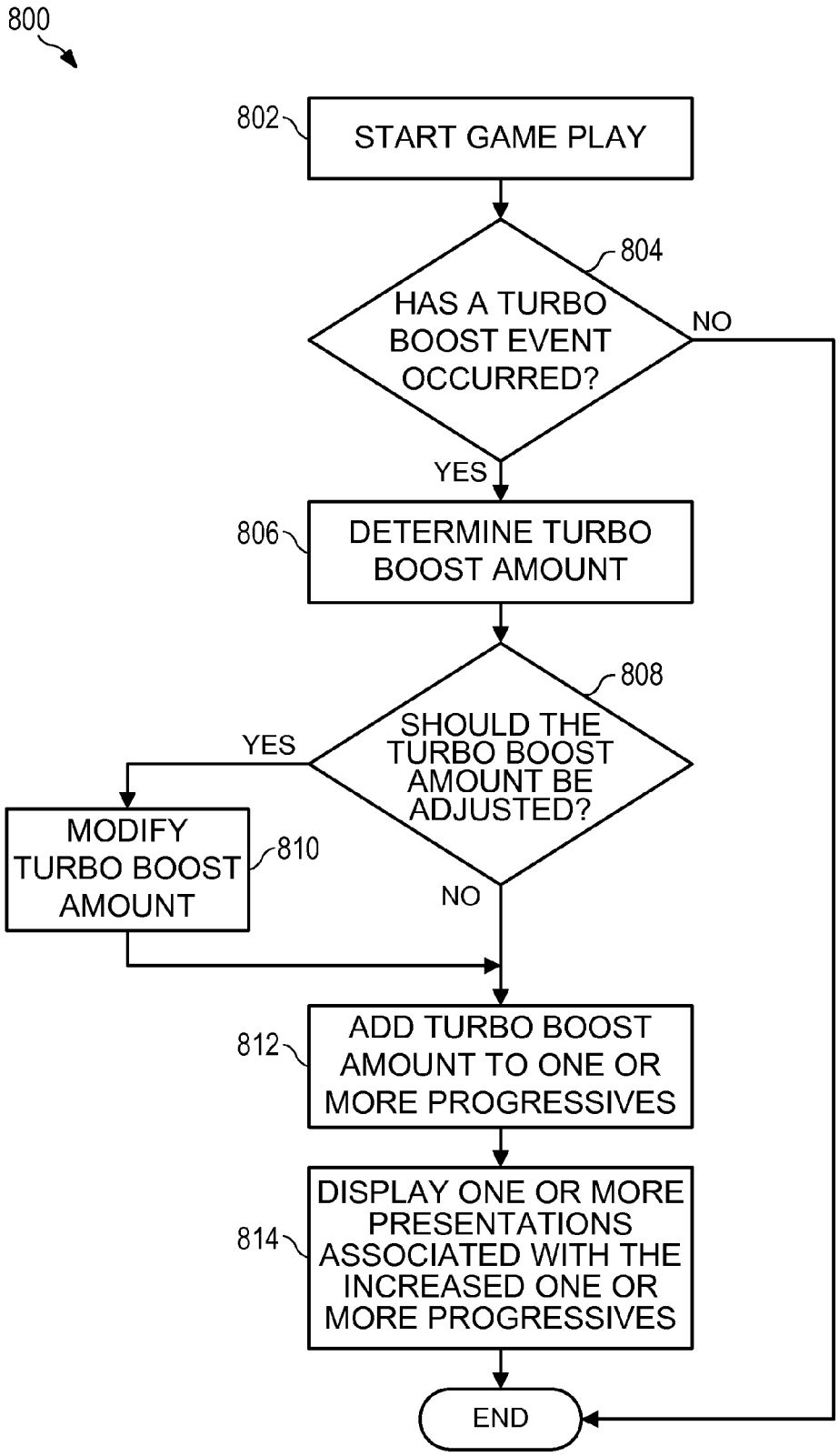
FIG. 8 is a game play flow diagram, according to one embodiment.

In FIG. 8, a game play flow diagram is shown, according to one embodiment. The method may include starting game play (step 802). The method may include one or more processors determining whether a turbo boost event has occurred (step 804). If no turbo boost event has occurred, then the method may end. If a turbo boost event has occurred, then the method may include determining one or more turbo boost amounts (step 806). The method may include one or more processors determining whether the one or more turbo boost amounts should be adjusted (step 808). If the one or more turbo boost amounts should be adjusted, then the method may modify one or more turbo boost amounts (step 810). In either case, the method may include adding the one or more turbo boost amounts (e.g., either adjusted and/or non-adjusted) to one more progressives (step 812). The method may include displaying the one or more presentations associated with the increased one or more progressives (step 814). In one example, the turbo boost amount may be adjusted based on the size of the player's wager, a sponsorship contribution, a sponsorship payment, a step function, other gaming entity events, and/or other external events. For example, a turbo boost amount may be $5 if the player wagered one credit; however, the turbo boost amount may be $10 if the player wagered two credits. Further, the turbo boost amount may be $25 if the player wagered five credits, etc.

Figure 9A:
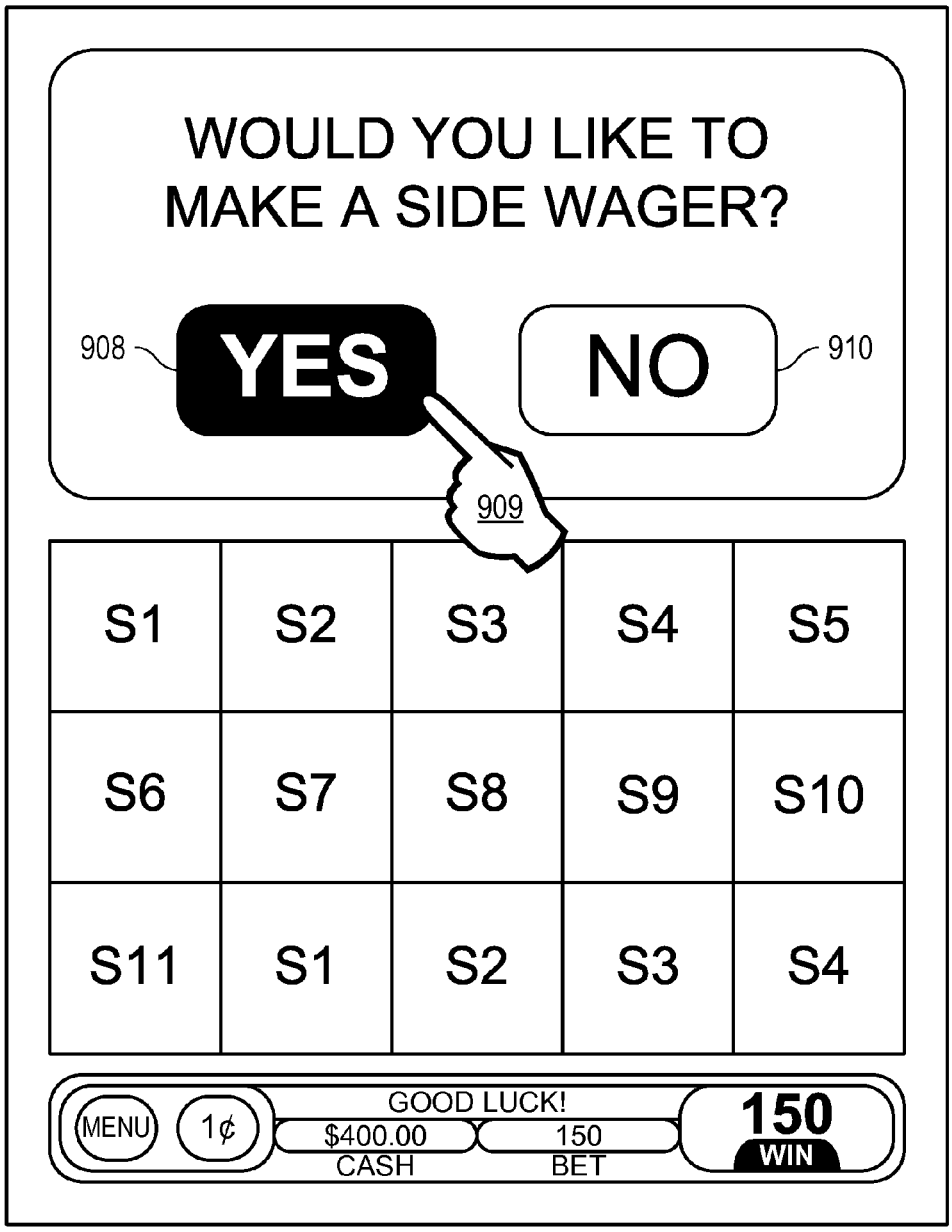
FIG. 9A is an illustration of pseudo game play on a gaming device, according to one embodiment.

In FIG. 9A, an illustration of pseudo game play on a gaming device 900A is shown, according to one embodiment. A first image 900A may include a display screen, a message area, a message, a first selection option 908, a second selection option 910, an Nth selection option (not shown), a reel area, one or more reels, a game data area, a menu button, a bet increment button, a game data message area, a balance area, a bet amount area, and an outcome area.

In an example, message may request the player to select whether the player would like to make a side and/or pseudo gaming wager. Message may state "WOULD YOU LIKE TO MAKE A SIDE AND/OR PSEUDO WAGER?" In one example, a player may select a pseudo wagering option by selecting first selection option 908 (e.g., Yes). In another example, the player may select to decline making a pseudo wager and/or side bet (e.g., No).

In one example, a pseudo gaming wager is a wager on an event outcome which is a derivate of slot machine play and/or a monetary game play. For example, a wager may be placed on the number of red symbols which will stop on one or more reels during a specific spin (e.g., next spin, third spin from now, etc.). In this example, the electronic gaming machine would not determine how many red symbols are going to stop on the one or more reels during this specific spin before the wager is accepted and/or the odds are generated. Therefore, in this example, this pseudo wager is not based on normal slot machine outcomes (e.g., has a bonus been generated, do the symbols generate a winning payline, winning combinations are based on the random number generator, are regulated outcomes, etc.). For example, a player may make a pseudo wager that the next spin will have at least three winning outcomes (e.g., three winning events, three winning paylines, two winning paylines and one winning scatter, etc.).

In another example, a pseudo gaming wager is a wager on an event outcome which is not related to slot machine play and/or a monetary game play. For example, a pseudo wager may be based on the outcome of a football game, a horse race, and/or any other trackable and verifiable event outcome. The tracking and the verifying may be implemented via one or more electronic devices and/or one or more processors. In one example, a player may wager $100 that the Atlanta Falcons will cover the 7½ point spread versus another team. In this example, as long as the game has not ended (e.g., the final outcome being known), a player may complete this wager. In one example, the wager may pay 1 to 1 (minus any fees) if the game has not started yet. In another example, the wager may pay 10 to 1 if the game only has 2 minutes left and Atlanta is losing by 10 points. In this example, the Falcons would have to score 11 points in 2 minutes. Therefore, if a player wants to initiate this wager at this time, the odds reflect the probability (e.g., extremely low) that Atlanta will be able to score 11 points in the last 2 minutes of the game. In another example, if Atlanta is up by 20 points with 2 minutes left in the game which insures (e.g., 99.9999999999999% probability) that Atlanta will cover the spread, no new bets picking Atlanta may be initiated. Further, pseudo wager may be cashed in as a winner before the event is over. In one example, cashing in the pseudo wager before the event outcome is completed may be discounted in the cash in value. For example, in the case where $100 was bet on Atlanta to win by the 7½ spread (e.g., the odds where 1 to 1) and Atlanta is up by 20 points with 2 minutes to go in the game a player may win $100 at the conclusion of the game assuming Atlanta holds on to win by the point spread. However, the player may be able to cash in the winning ticket with 2 minutes to go for $95. In another example, Atlanta may only be up by 10 points with 2 minutes to go, which means a field goal (e.g., 3 points) by the opposing team would mean that Atlanta would not cover and the current winning wager would become a losing wager. Therefore, the player may be able to cash in the pseudo wager in this example for $60 which reflects at least a portion of the probability of Atlanta covering the spread. The pseudo wager's value may fluctuate and/or be automatically updated during the entire event. The player may be able to cash in the pseudo wager at one or more electronic gaming devices, one or more central devices, a cashier's desk, via their hotel room TV, and/or any other electronic gaming device, and/or any other electronic device (e.g., cellphone, etc.).

In another example, a pseudo gaming wager is a wager on an event outcome which is not related to slot machine play and/or a monetary game play, along with an event outcome which is a derivate of slot machine play and/or a monetary game play. For example, a player may initiate a pseudo wager that is based on a horse race (e.g., horse 1 will win race 1) and the next three spins will each have at least one winning outcome.

Figure 9B:
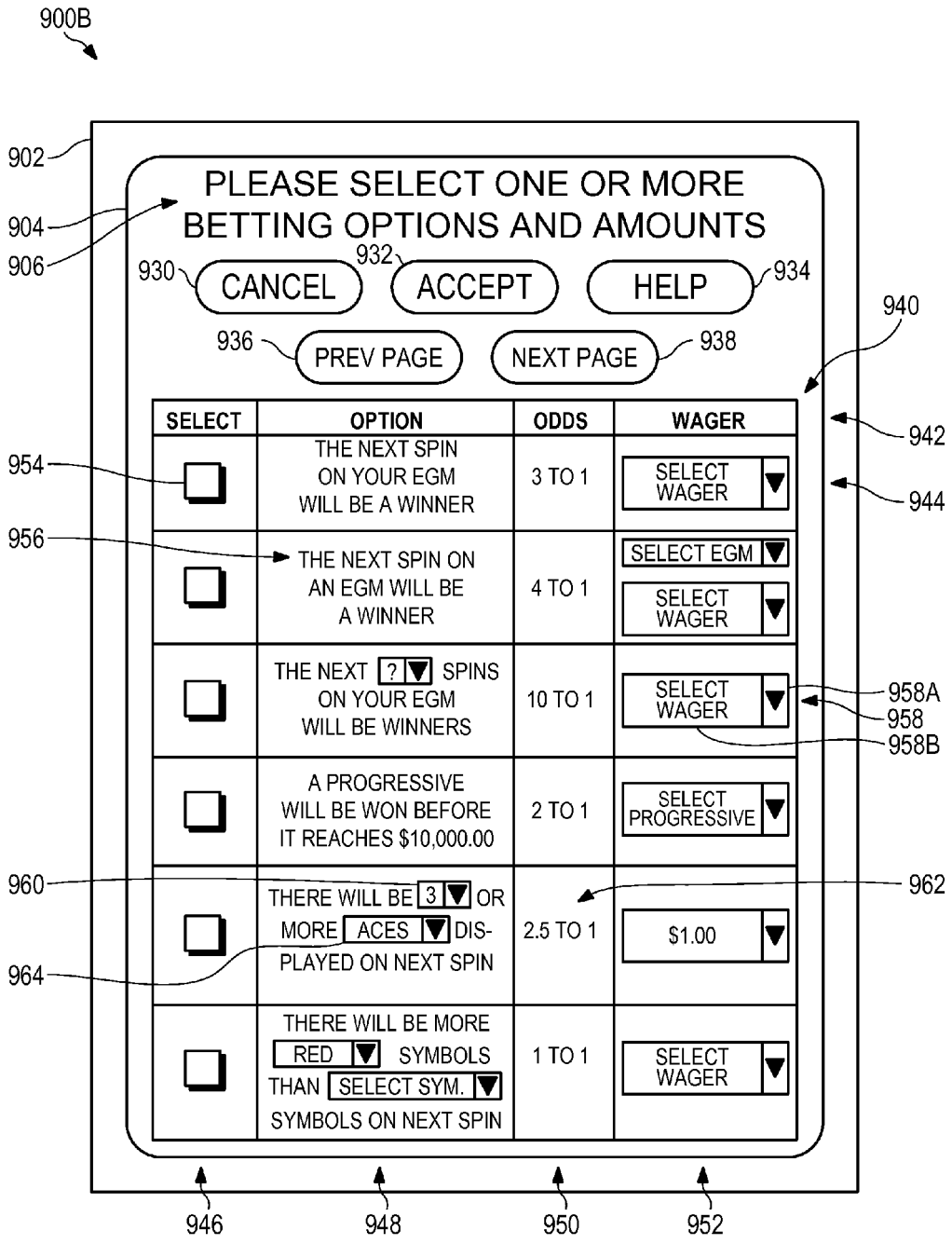
FIG. 9B is another illustration of pseudo game play on a gaming device, according to one embodiment.

In FIG. 9B, another illustration of pseudo game play on a gaming device is shown, according to one embodiment. A second image 900B may include a display screen, a message area, a message, a cancel button 930, an accept button 932, a help button 934, a previous page button 936, a next page button 938, a wager selection area 940, one or more selection options 954, a column header area 942 (e.g., a first selection criteria 946 (e.g., a selection input), a second selection criteria 948 (e.g., an option description), a third selection criteria 950 (e.g., odds—payout rate, etc.), a fourth selection criteria 952 (e.g., a wager), etc.), one or more wagering options 944, one or more wagering option descriptions 956, a drop down selection button 958 (with a drop down arrow 958A and one or more wagering selections 958B, a number selection button 960, a symbol selection button 964, a color selection button, a person selection button, a comparison symbol selection button, and an odds description 962.

In one example, cancel button 930 may be selected by the player to cancel one or more transactions. In another example, accept button 932 may be selected by the player to confirm one or more transactions. In another example, a player may select help button 934 to obtain information and/or obtain a live help function (e.g., a live operator to assist in completing one or more transactions, to provide information, and/or to trouble shoot one or more problems). In another example, a previous page button may be selected by the player to move back to one or more previous pages. In another example, a next page button may be selected by the player to move forward to one or more pages.

In one example, a pseudo wager option may be whether the next spin on your EGM will be a winner. In this static example, the specific spin may not be able to be changed. The only item the player may change is the wager amount (see the first wagering option in FIG. 9C). In another example, a dynamic mode may be utilized where the player can select a specific future spin to wager on (e.g., the tenth spin from now) (see the third wagering option in FIG. 9C). Further, in the dynamic mode option, the odds, wager limits, and/or any other criteria of the wagering options may be modified based on any selection by the player. For example, the player may change the odds (e.g., only wants 5 to 1 betting options); therefore, only pseudo wagering options with 5 to 1 odds would be displayed. Further, the player may also want to see any pseudo wagering options with at least a certain odds (e.g., 10 to 1). In this example, all wagering options with at least a 10 to 1 odds ratio would be displayed. In another example, there may be wagering limits placed on any pseudo wagering options. For example, a thousand to one odds wagering option may be limited to a maximum bet of $1000 so that no payout is higher than a certain number (e.g., $1,000,000, etc.). In another example, there may be no wagering limitations.

In another example, the player may select any electronic gaming machine ("EGM") to wager on and/or any event relating to this specific EGM (see the second wagering option on FIG. 9C) to wager on. In one example, the EGM may be an EGM identified by a player's card (e.g., the EGM that the husband is currently playing on, the EGM that the son is currently playing on, the EGM that the wife is currently playing on, the EGM that the friend is currently playing on, etc.). In another example, the player may select any EGM (e.g., the one right next to the player, EGM numbered 0129340, EGM numbered 2183048, the EGM that has won the most in the last 5 spins, the EGM that has not won in the last 10 spins, etc.). The player may view any EGM on one or more screens on their EGM. The player may view any EGM before making a wager to try to obtain some gaming history (e.g., the last 5 spins have been winner, during the last 10 spins the winning percentage is 30%, etc.). In another example, the player may view any EGM that the player has made a wager on. Further, the player may obtain historical data (e.g., spin by spin data for X numbers of historical spins, the Average win rate (e.g., ⅓ of the spins are winners, ⅔ of the spins are winners, etc.), the last win over $1,000 was done on X date.

In another example, the player may make a pseudo wager on when one or more progressives will be hit. For example, the player may initiate a pseudo wager that the XYZ progressive will be hit before it reaches $10,000 (see the fourth wagering option on FIG. 9C). In another example, the player may initiate a pseudo wager that the ABC progressive will be hit before 10,000 spins relating to the ABC progressive have be completed. In another example, the player may initiate a pseudo wager that the 123 progressive will be hit before 15,000 spins and before it reaches $50,000.

In another example, the player may initiate a pseudo wager on a specific number of specific symbols stopping in one or more active reels areas during a specific spin. In one example (see the fifth wagering option on FIG. 9D), a pseudo wagering option may be that 3 (and/or any number from 0 to N) Aces (and/or any other symbol and/or combination of symbols (e.g., 3 Aces, 2 Kings, and 3 stars, etc.) are part of the final outcome of a gaming event (and/or any intermediate step (e.g., bonus round, first part of a game play, etc.)).

In another example, a pseudo wagering option may be that there will be more of a first symbol (and/or combination of symbols (e.g., Ace and a King, etc.) than a second symbol (and/or combination of symbols (e.g., Jack and Star) in a final position, an intermediate position, and/or any other position (e.g., bonus game).

Figure 9C:
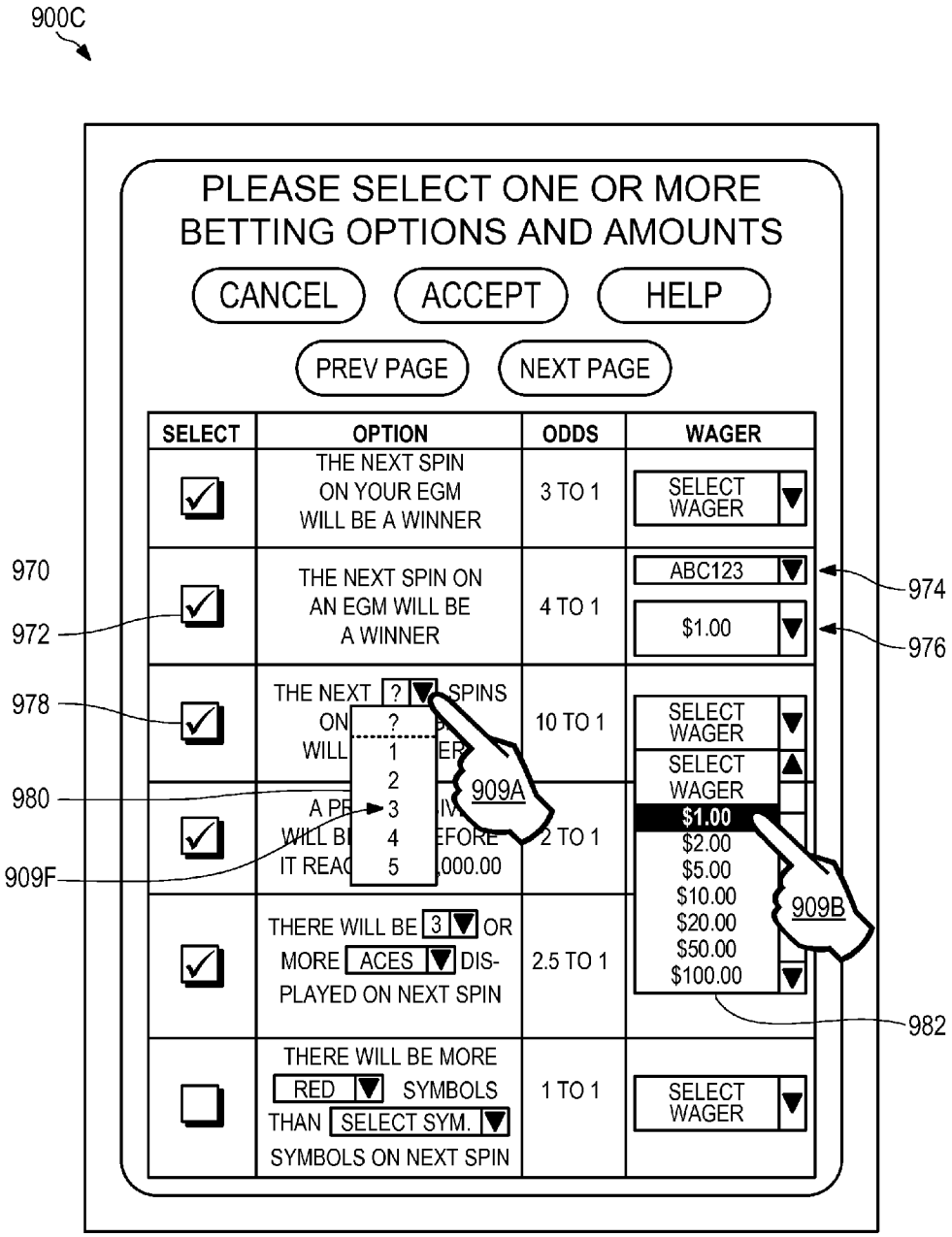
FIG. 9C is another illustration of pseudo game play on a gaming device, according to one embodiment.

In FIG. 9C, another illustration of pseudo game play on a gaming device is shown, according to one embodiment. In an image 900C, the player has selected five wagering options as can be seen by the check marks in the first five selection options (e.g., the next spin on the player's current EGM will be a winner which would pay 3 to 1; the next spin on the ABC123 EGM will be a winner which would pay 4 to 1 and the player bet $1; the next 3 spins on the player's current EGM will be winners which pays 10 to 1 and the player has bet $1; the progressive will be won before the progressive hits $10,000 which pays 2 to 1; and there will be 3 or more Aces displayed on the next spin when the spinning stops). In one selection represented by reference number 972, the player has elected to wager that the next spin on a specific electronic gaming machine ("EGM") will be a winner. The odds are 4 to 1 for this wagering option. Further the player has elected the ABC123 EGM as can be seen by an EGM selection button 974. In addition, the player has elected to wager $1 as shown by a wager selection button 976. Any EGM and/or any wagering amount may be utilized.

In another selection represented by reference number 978, the player has elected to wager that the next 3 spins (via a firsthand movement and a second hand movement) on the EGM that the player is currently playing on will be winners. These selections were on a spin selection drop down menu 980. The odds are 10 to 1 for this wagering option. Further, the player has elected to wager $1 as shown by a drop down wagering window 982.

In another example, the player may elected one or more wagering options via one or more radial buttons. In this example, the player has selected a first wagering option via a first radial button selection. In this example, the player has selected to wager that the next 5 spins on their EGM will be winners. The odds for this wagering selection are 50 to 1. Further the player has wagered $1 on this option.

In one example, a pseudo wager may be that the next 5 spins on the player's current EGM will be winners which pay 50 to 1. In this example, the player had seven bet amount choices (however, any number may be utilized) which were $1, $2, $5, $10, $20, $50, and $100.

In another example, gaming device may include a leaderboard display, a side display, a main game display, a left speaker, a right speaker, one or more output devices (e.g., a ticket in/ticket out device), and/or one or more input devices (e.g., buttons, etc.). In one example, leadership display includes a leadership board sponsor and a ranking of tournament players. In this example, the XYZ company has sponsored the leadership board and the leadership board states "XYZ LEADER BOARD." In another example, leadership display may include data relating to one or more tournaments, such as, the time remaining (e.g., 1 HOUR 31 MINUTES REMAINING). In this example, a side display may display a current mode of operation. For example, a current mode may be a tournament mode, a normal mode, a practice mode, a team mode, an individual mode, any combination thereof, etc.

Figure 9D:
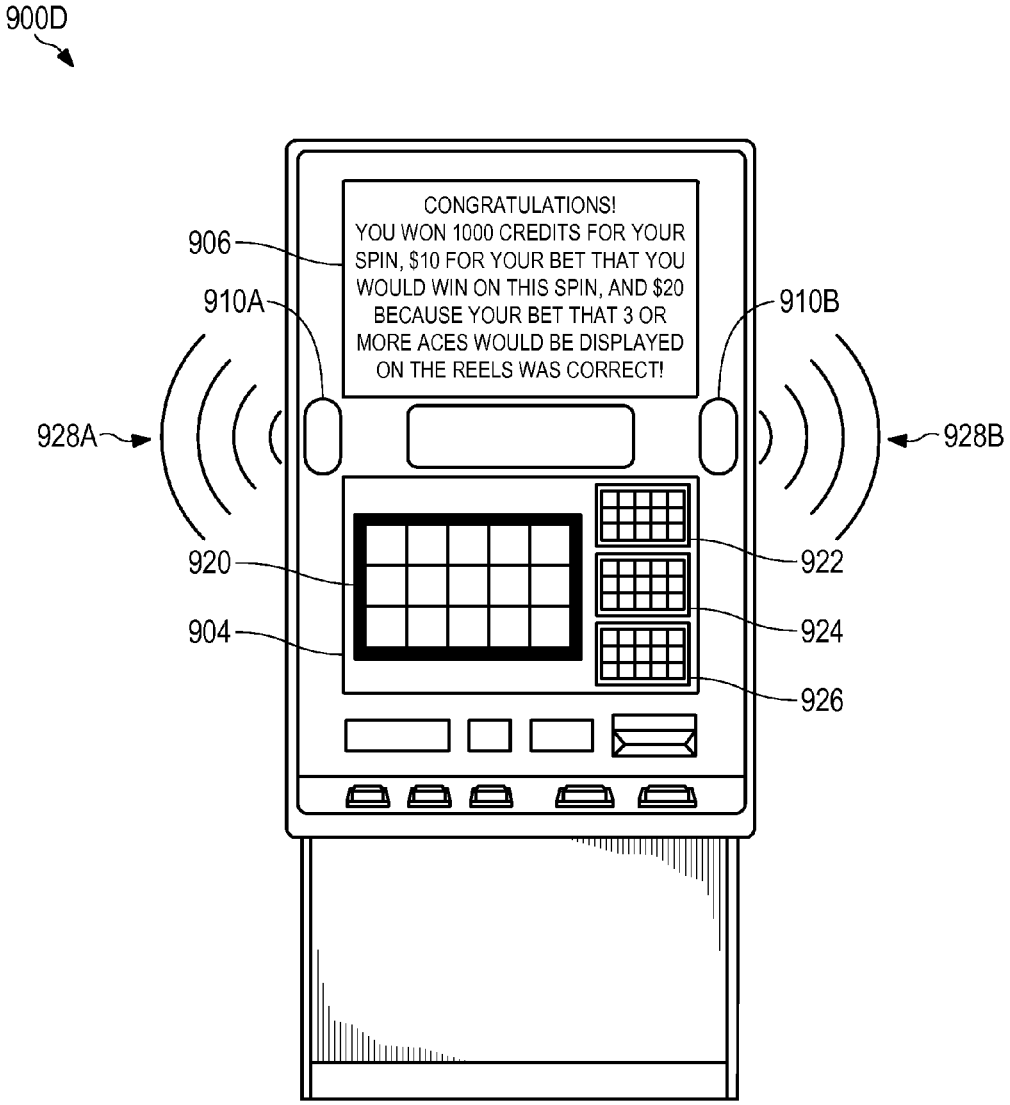
FIG. 9D is another illustration of pseudo game play on a gaming device, according to one embodiment.

In FIG. 9D, another illustration of pseudo game play on a gaming device is shown, according to one embodiment. A pseudo gaming image 900D may include a message area 906, a first sound message 928A, a second sound message 928B, a first gaming area 920, a second gaming area 922, a third gaming area 924, and an Nth gaming area 926.

In one example, a message in message area 906 may state "CONGRADULATIONS! YOU WON 1000 CREDITS FOR YOUR SPIN, $10 FOR YOUR BET THAT YOU WOULD WIN ON THIS SPIN, AND $20 BECAUSE YOUR BET THAT 3 OR MORE ACES WOULD BE DISPLAYED ON THE REELS WAS CORRECT!"

In another example, a pseudo wagering option may be that there will be more of one symbol (e.g., red, warriors, etc.) than another symbol (e.g., black, zombies, etc.). In another example, a pseudo wagering option may be that there will be more of one symbol combination (e.g., warrior and ships) versus another symbol combination (e.g., bases and planes).

In another example, a pseudo wagering option may be that there will be an Ace (and/or any other symbol) in a predetermined location (e.g., first row and first column). In another example, a pseudo wagering option may be that there will be a first Ace (and/or any other first symbol) in a first predetermined location (e.g., first row and second column) and a second Ace (and/or any other second symbol) in a second predetermined location (e.g., third row and fifth column).

In another example, a pseudo wagering option may that a certain number of symbols with one or more specific characteristics (e.g., Turbo Boost symbol, HEARTS, star, male, female, wild, scatter, etc.) will be displayed when the spin is completed. For example, a pseudo wagering option may be that a certain number of wild symbols will be displayed when the spin stops. In another example, a pseudo wagering option may be that a certain number of scatter symbols will be displayed when the spin stops. In another example, a pseudo wagering option may be that a certain number of expanding wild symbols will be displayed when the spin stops In another example, a pseudo wagering option may be that a certain portion of the game (e.g., BONUS GAME, etc.) will be initiated during a certain spin and/or spin duration (e.g., over the next X spins) and/or time duration. In another example, a pseudo wagering option may be that a certain number female players will win during a certain time frame. Further, the pseudo wagering option may be that more female players will win versus male players, or vice versa during a certain spin, range of spins, group of spins, and/or time duration.

In another example, a pseudo wagering option may be that a specific amount and/or an amount range will be won during a specific spin and/or range of spins (e.g., 1 to N). For example, a pseudo wager may be placed that predicts that $0-$5 (or $5.01 TO $10, $10.01 to $20.00, etc.) will be won on the next spin (and/or any spin and/or any time duration). Further, the pseudo wager may be that exactly $5.00 will be won on a spin. In addition, a range of spins may be selected. For example, on spins 3-5, $0-$5 (and/or $4 exactly) will be won. In another example, on spins 3, 5, and 10, $0-$5 (and/or $4 exactly) will be won.

In another example, a pseudo wagering option may be based on a lack of symbols being displayed when the reels stop spinning (e.g., the completion of a spin). In one example, the player may wager that no stars (and/or turbo boost symbols) will be displayed at the completion of a spin. Depending on the frequency of the selected symbol, the odds for these wagers will be adjusted. In another example, the pseudo wagering option may be that there will be no stars and no aces when the reels stop. Any number (1-N) of symbols may be utilized. In another example, a pseudo wagering option may be that there will be no stars and no aces but a bar symbol and a king symbol will be present at the end of the spin. Further, a pseudo wagering option may be that there will be no stars and no aces but 2 bar symbols and 5 king symbols will be present at the end of the spin.

In another example, a pseudo wagering option may be that there will be a special symbol (e.g., scare number) displayed. For example, there may only be one Ace of hearts and the player may wager that this symbol will be displayed at the completion of a spin (and/or a spin range and/or duration period).

In another example, a pseudo wagering option may be that one or more symbols are located in one or more columns and/or rows. For example, a player may wager that an Ace (and/or turbo boost symbols) will be (and/or not located) located in row 1. In another example, the player may wager that an Ace (and/or turbo boost symbols) will be (and/or not located) located in column 4. In another example, the player may wager that an Ace (and/or turbo boost symbols) will be (and/or not located) located in both row 1 and column 4 (and/or any number of aces will be in any number of rows and/or columns). Further, the player may wager that an Ace (and/or turbo boost symbols) will be located (and/or not located) in row 2 and a King will be located in column 4. Further, the player may wager that an Ace (and/or turbo boost symbols) will be located (and/or not located) in row 4, a King will be located (and/or not located) in row 3, and a Queen will be located (and/or not located) in both row 1 and column 1. Any combination of symbols (e.g., 1-N) and any combination of locations (row 1, column 1, row 2, etc.) may be utilized.

In another example, a pseudo wagering option may be based on obtaining X number (e.g., 1-N) of wins on Y EGM (and/or a group of EGMs) on the next spin (and/or a range of spins (e.g., spins 3-5) and/or a grouping of spins (e.g., spin 1, spin 3, and spin 8). In one example, the player may wager that on the next spin of the EGM that there will be 4 winning paylines. In another example, the player may wager that during spin 1, spin 3, and spin 8, 10 winning paylines will be formed (and/or 8 winning paylines and 2 scatter payouts, etc.). In another example, the player may make a pseudo wager that payline number 7 will win on the next spin, will win within the next three spins, will win 3 times during spin 1, spin 3, and spin 8, etc.

In another example, a time element may be utilized and/or combined with any other option. For example, the player may initiate a pseudo wager that the next win on Y EGM will occur within 2 minutes (and/or any other timeframe). In another example, the player may place a pseudo wager that 3 winning paylines will form in the next 2 minutes (and/or any other time period). Further, another wagering option may be that payline 5 will be a winning payline within the next ten minutes. In addition, the player may wager that paylines 1, 4, 5, and Nth will all be winning paylines within the next 10 spins and/or the next 5 minutes. In another example, a player may wager that payline 7 will win more times than payline 5 for one spin, a few spins, a plurality of spins, a range of spins, a group of spins, and/or for any time duration.

In another example, a pseudo wagering option may be when one or more multipliers will be generated, displayed, and/or won. For example, a player may wager that a multiplier will be won on the next spin (and/or a range of spins and/or a grouping of spins). In another example, the player may wager that 2 (and/or any other number) of multipliers will be won on the next X spins (and/or range and/or groupings of spins). In another example, a wager may be placed that a multiplier may not be displayed during a spin, a few spins, and/or a time duration.

In another example, a pseudo wagering option may be that X dollars will be won on the next (or any specific free spin) free spin(s) (and/or range of free spins and/or groupings of free spins). For example, a pseudo wager may be that $10 or more will be won on the next free spin game. In another example, the pseudo wager may be that $10 or less will be won on the next free spin game. In another example, a wager may be placed that $50 will be won during the next three free spin games (e.g., in the first free spin game there may have been 5 free spins, during the second free spin game there may have been 3 free spins, and during the third free spin game there may have been 10 free spins). In another example, the pseudo wager may be that a free spin game will be initiated during the next 10 spins and that $25 or more will be won in this initiated free spin game.

In another example, the pseudo wager may be that the next bonus game will be initiated in the next 7 minutes and the amount won during this bonus game round will be X (any amount, any range, etc.) dollars.

In another example, the pseudo wager may be based on the number of losses and/or number of wins in a row. In one example, the pseudo wager may be that a specific EGM will have 2 losses in a row and/or 2 wins in a row. For example, this EGM will have 2 losses, then 1 win, then 3 loses, and then 5 wins. Any pattern may be the basis for a pseudo wager.

In another example, one or more random elements of game play may be the basis for a pseudo wager. For example, the next song played by the EGM will be X, the third song with be Y, a random character (e.g., a pirate, etc.) will be displayed on an animated screen during the next spin, within 5 minutes, etc.

In another example, the pseudo wager may be based on two or more symbols occurring in a certain order. For example, a pseudo wager may be based on two Aces (and/or turbo boost symbols) occurring adjacent to each other. In another example, the wager may be based on an Ace symbol (and/or turbo boost symbols) being next to a King symbol which is next to a Queen symbol which is next to a Jack symbol which is next to a Ten symbol. These patterns may be horizontal, vertical, in a T shape, an S-shape, an L-shape, an O-shape, and/or any other shape (e.g., X, Z, etc.). In another example, the wager may be based on forming a certain percentage of the formation. For example, in the Ace to Ten example discussed about, a wager may be that 4 out of 5 symbol will occur (or at least 4 symbols, or at least 3 symbols, etc.). In this example, if one of the symbols is missing, the player still wins (e.g., the Ace is adjacent to the King which is adjacent to the Queen, and the Ten is within 2 spots of the Queen, etc.).

In another example, the pseudo wager may be based on no one winning and/or losing for a certain amount of spins (e.g., 1, 2, . . . etc.). In this example, the player may wager that no one in the casino will win on their next slot machine spin and/or that everyone in the casino will win on their slot machine spins. Further, the slot machines may be segregated. For example, a group of slot machines may be utilized (e.g., a first bank, a first row, a second bank, a second row, a first column, etc.). In this example, the player may wager that all of the EGM in the bank and/or row and/or any other segmentation will all win and/or all lose during the next spin (e.g., and/or a group of spins and/or a range of spins and/or during a time period). Further, the wager may be that a certain percentage (e.g., 0 to 100%) of the games of these EGMs will win and/or lose. In one example, the player may wager that 51% (or more) of the EGM will have winning outcomes.

In another example, the pseudo wager may be based on the outcome of another event (e.g., a football game, a soccer game, a horse race, a basketball game, a baseball game). These outcomes may also include point spreads. For example, the Atlanta Falcons will win by 7½ points over another team. In another example, a player may wager that he will win over $100 on one or more EGMs in the next hour and that the Falcons will win and/or cover the spread (e.g., 7½ points) in X football game.

In another example, the pseudo wager may be that the Dow Jones will go up and/or down by 100 points today and/or by a certain percentage. Further, the player may wager that the DOW will go down by 200 points today, a specific stock will go up by 5%, and the player will lose X dollars playing one or more EGM today (and/or in a specific time frame). In this example, the player may be hedging because they own stock and/or are shorting stocks. The player may wager that they will lose $100 today.

In another example, the pseudo wager may be based on X tournament (E.G., POKER, GOLF, ETC.) being won by X. In one example, a player may wager that X will win a golf tournament, a poker tournament, a slot tournament, etc. In another example, the player may wager on themselves winning a slot tournament, a blackjack tournament, a poker tournament, etc.

In another example, the pseudo wager may be based on that the first symbol being X, it will be red, and it will be over a 10. In another example, the exact symbol location and/or range (e.g., four symbol area) may be wagered on.

In another example, the pseudo wager may be based on the first symbol will be X symbol, Y will be the last symbol, and/or any symbol interaction. In another example, X symbol will be four spaces away from Y symbol. In another example, the wager may be based on the first symbol will be an X symbol and the last symbol will not be a Y symbol. This can be utilized with symbol combinations also. The first symbol will be either an A symbol and/or a B symbol while the last symbol will not be a Z symbol, a C symbol, and/or a B symbol.

In another example, the wager may be that there will be no bonus rounds on a specific EGM, a group of EGMs, and/or all EGMs for a certain amount of spins (e.g., 1-N) and/or within a certain time period (e.g., 1 second to 10 years).

In another example, the pseudo wager may be based on no wilds being in column X, Row Y, and/or any other column, row, and/or area. In a blackjack type game, a pseudo wager may be that I will not bust for X hands.

In various examples, the value of the pseudo wager may be automatically undated and/or vary over time. For example, when a player wagers that the next 3 spins (at 10 to 1 odds) will be winners the initial value of the wager is $1. After the first winning spin, the value of the wager may now be $2. After the second winning spin is a winner, the value of the wager may now be $4. After the third winning spin is a winner, the value of the wager may now be $10. If the third winning spin was a loser, then the value of the wager would have been reduced to $0.

In one example, this may be a system based game that can be on any media (e.g., a Pizza box, a piece of paper, a primary game window, a secondary game window, any electronic device, etc.). The pseudo wagering vehicle can accept additional wagers on the primary game and/or on any other events.

Figure 10:
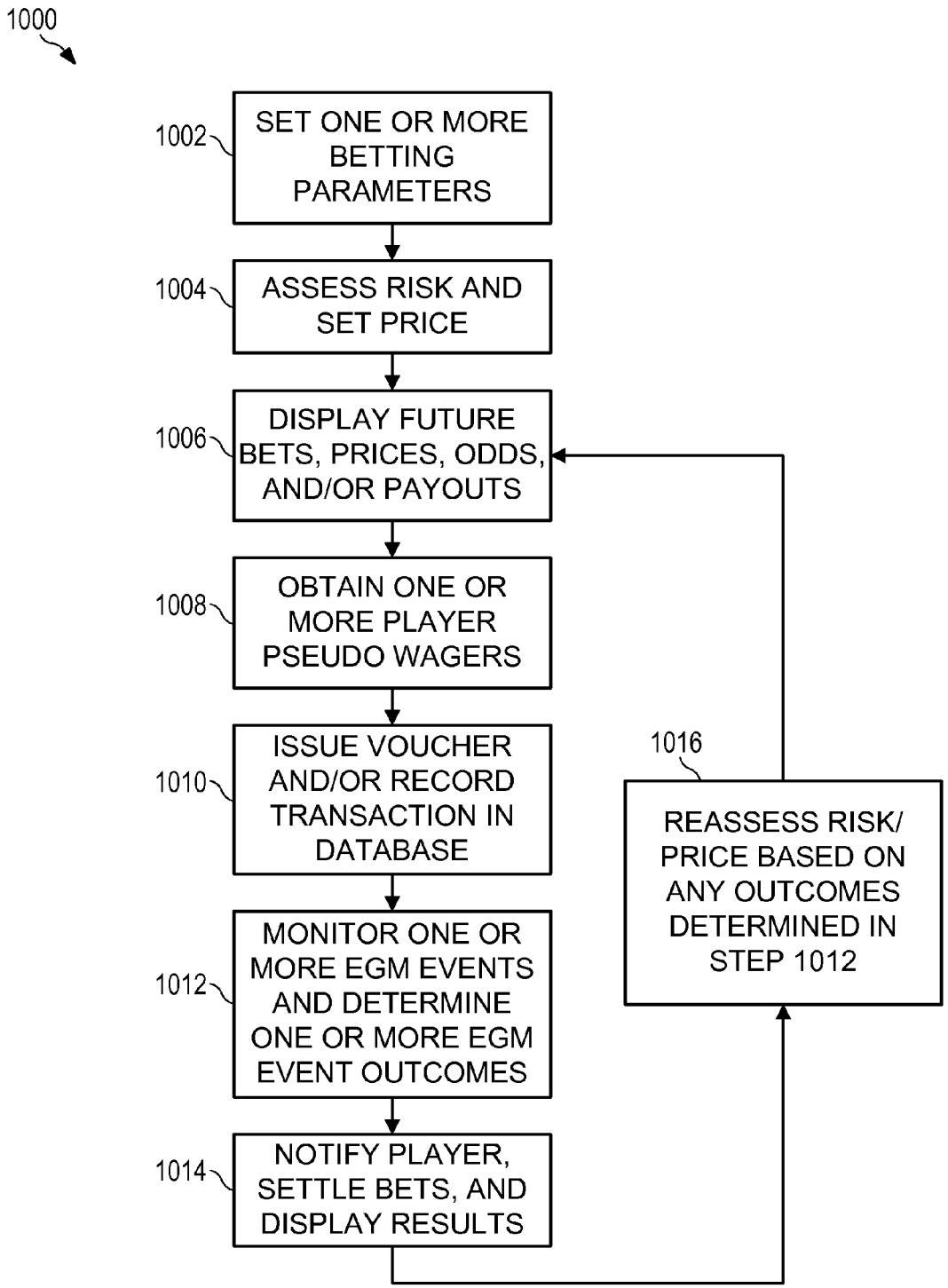
FIG. 10 is a pseudo game play flow diagram, according to one embodiment.

In FIG. 10, a game play flow diagram is shown, according to one embodiment. The method may include setting one or more betting parameters (step 1002). The method may include assessing the risk and setting one or more prices (step 1004). The method may include displaying one or more future bets, prices, odds, and/or payouts (step 1006). The method may include obtaining one or more player pseudo wagers (step 1008). The method may include issuing one or more vouchers and/or recording one or more transactions in a database (step 1010). The method may include monitoring one or more electronic gaming machine ("EGM") events and/or determining one or more EGM event outcomes (step 1012). The method may include notifying one or more players, settling one or more bets, and displaying one or more results (step 1014).

In another example, the method may include reassessing one or more risks and/or prices based on one or more outcomes determined in step 1014. The method may then return to step 1006.

Figure 11:
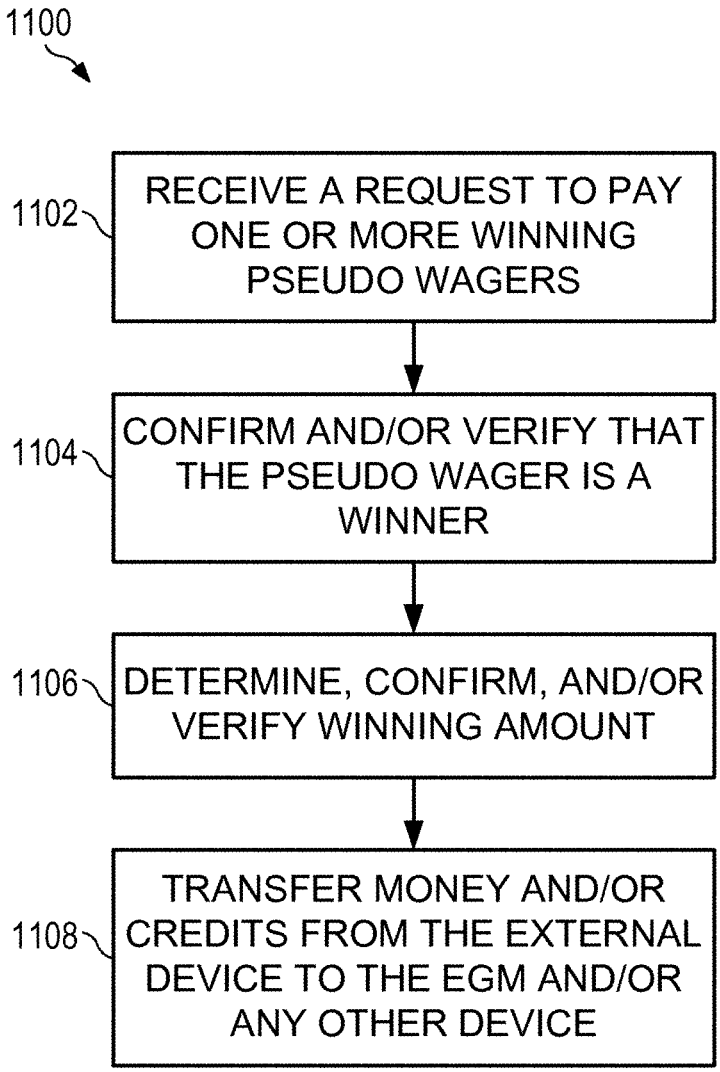
FIG. 11 is another pseudo game play flow diagram, according to one embodiment.

In FIG. 11, a flow diagram for game play 1100 is shown, according to one embodiment. The method may include receiving a request to pay one or more winning pseudo wagers (step 1102). The method may include confirming and/or verifying that the pseudo wager is a winner (step 1104). The method may include determining, confirming, and/or verifying winning amounts (step 1106). The method may include transferring money and/or credits from the external device to the EGM and/or any other device (step 1108).

In another example, a player outside (or inside) of the casino and/or online gaming environment may utilize a mobile device and/or any other device (e.g., computer, etc.) to log into an account on the system and/or a social media interaction system, and/or any other interconnecting system to place a wager, a side bet, and/or a pseudo bet on the game another individual is playing online, at a casino (e.g., Wynn in Vegas, etc.), and/or at any other gaming entity.

Figures 12A, 12B:
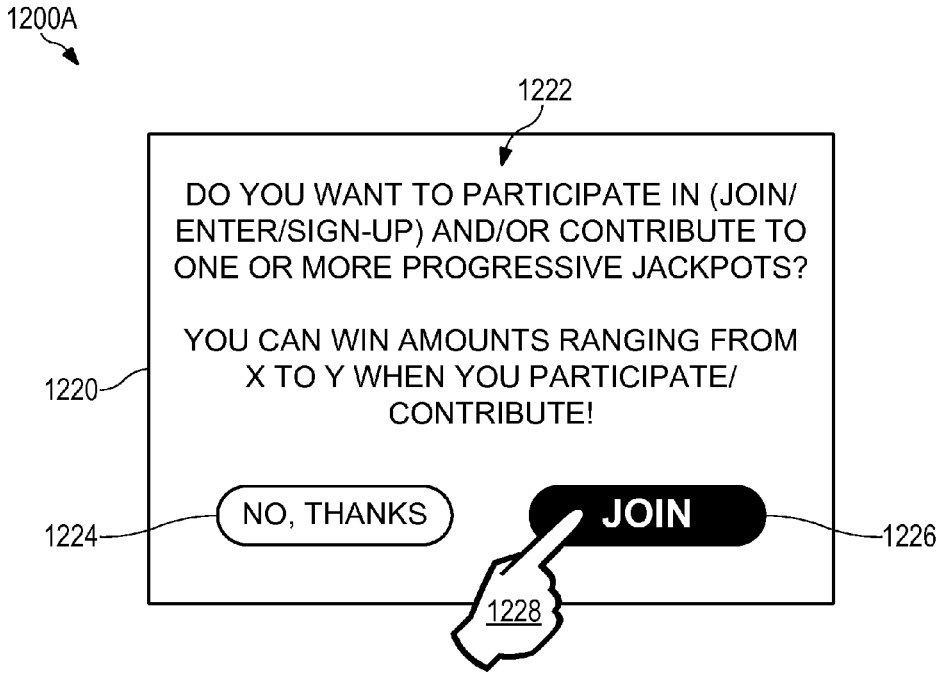
FIG. 12A is an illustration of subscription based progressive game play on a gaming device, according to one embodiment.
FIG. 12B is another illustration of subscription based progressive game play on a gaming device, according to one embodiment.

In FIG. 12A, an illustration of subscription based progressive game play on a gaming device is shown, according to one embodiment. In this example, a message box 1220 may be displayed on one or more screens of a gaming device. Message box 1220 may include a message area 1222, a first selection option 1224, a second selection option 1226, and an Nth selection option (not shown). Message area 1222 may include a description of the subscription based progressive and/or any other data relating to one or more subscription based progressive options. For example, message area 1222 may display the message of "DO YOU WANT TO PARTICIPATE IN (JOIN/ENTER/SIGN-UP) AND/OR CONTRIBUTE TO ONE OR MORE PROGRESSIVE JACKPOTS? YOU CAN WIN AMOUNTS RANGING FROM X TO Y WHEN YOU PARTICIPATE/CONTRIBUTE!" In one example, first selection option 1224 may be an option to decline participation in the subscription based progressive program. In this case, first selection option 1224 may state "NO, THANKS." In another example, second selection option 1226 may be an option to accept/request participation in the subscription based progressive program. In this case, second selection option 1226 may state "JOIN." In various examples, "JOIN" may be replaced by any similar word (e.g., accept, yes, participate, etc.).

In FIG. 12B, another illustration of subscription based progressive game play on a gaming device 1200B is shown, according to one embodiment. In one example, a first image 1200B may include an options area 1230. Options area 1230 may include a selection option area 1232, a name of the option area 1234, a cost of the option area 1236, and a prize of the option area 1238. In one example, selection option area 1232 is titled "JOIN", name of the option area 1234 is called "NAME", cost of the option area 1236 is titled "COST", and prize of the option area 1238 is titled "JACKPOT". In one example, name of the option area 1234 may include any number of names for any number of options. In this case, a first option is named "PROGRESSIVE JACKPOT 1", a second option is named "PROGRESSIVE JACKPOT 2", a third option is named "PROGRESSIVE JACKPOT 3", a fourth options is named "PROGRESSIVE JACKPOT 4", and an Nth option is named "PROGRESSIVE JACKPOT NTH."

In one example, PROGRESSIVE JACKPOT 1 has a cost of 1 credit and a potential jackpot of $1,000. In another example, PROGRESSIVE JACKPOT 2 has a cost of $1 and a potential jackpot of $10,000. In another example, PROGRESSIVE JACKPOT 3 has a cost of 5 credits and a potential jackpot of $50,000. In a further example, PROGRESSIVE JACKPOT 4 has a cost of $1.50 and a potential jackpot of $1,000,000. In another example, PROGRESSIVE JACKPOT NTH has a cost of 10 credits and a potential jackpot of $10,000,000. In this example, the player has elected to participate in PROGRESSIVE JACKPOT 2 AND PROGRESSIVE JACKPOT 4 which is indicated by a checked box 1242. Whereas, the player has elected to not participate in PROGRESSIVE JACKPOT 1, PROGRESSIVE JACKPOT 3, AND PROGRESSIVE JACKPOT NTH which is indicated by a blank box 1240. In various examples, the player may select none of the progressives, one progressive, a few progressives, a plurality of the progressives, and/or all of the progressives. In various examples, the cost for a progressive may be constant (e.g., 10 credits) and/or may vary (e.g., 10 credits for the first entry and then 5 credits for the second entry and then 1 credit for the third entry, etc.). In another example, the system and/or method may require a first payment of 10 credits (e.g., any number) and then a lesser payment (e.g., 5 credits, etc.) to continue to be eligible for the progressive. In another example, the payment requirement to remain eligible may go up. This increase in payment may be related to the number of participates in the progressive pool, the prize size of the jackpot, and/or any other factor. In another the example, the payment to remain eligible in a progressive may be decreased based on a player entering more than one progressive subscription. In another example, the payment may be decreased based on the length of time a player has subscribed to one or more progressive jackpot options.

In one example, an image includes a plurality of electronic gaming devices. In this example, a first electronic gaming device may have three subscription progressive options. In this example, the three subscription progressive options are a PROGRESSIVE JACKPOT 1, PROGRESSIVE JACKPOT 5, and PROGRESSIVE JACKPOT 15. It should be noted that any electronic gaming device may have one, a few, and/or a plurality of non-subscription based progressive options in combination with subscription based progressive options and/or as a stand-alone function. Further, it should be noted that any electronic gaming device may have one, a few, and/or a plurality of subscription based progressive options. In addition, electronic gaming device on a gaming entity's floor may have constant subscription progressive based options, varying subscription progressive based options, and/or a combination of both depending on the time of day, floor configuration, special event, and/or any other reason.

In another example, a second electronic gaming device may have four subscription progressive options. In this example, the four subscription progressive options are a PROGRESSIVE JACKPOT 1, PROGRESSIVE JACKPOT 10, PROGRESSIVE JACKPOT 22, and PROGRESSIVE JACKPOT 50. In another example, a third electronic gaming device may have two subscription progressive options. In this example, the two subscription progressive options are a PROGRESSIVE JACKPOT 1 and PROGRESSIVE JACKPOT N. In another example, an X electronic gaming device 550 may have seven subscription progressive options. In this example, the seven subscription progressive options are a PROGRESSIVE JACKPOT 1, PROGRESSIVE JACKPOT 3, PROGRESSIVE JACKPOT 35, PROGRESSIVE JACKPOT 47, PROGRESSIVE JACKPOT 101, PROGRESSIVE JACKPOT 1000, and PROGRESSIVE JACKPOT N-1.

In FIG. 12C, another illustration of subscription based progressive game play on a gaming device 1200C is shown, according to one embodiment. In one example, an image may include an options area 1230. Options area 1230 may include a selection option area 1232, a name of the option area 1234, a prize of the option area 1236, and a payout algorithm area 1238. In one example, selection option area 1232 is titled "JOIN", name of the option area 1234 is called "NAME", and prize of the option area 1238 is titled "JACKPOT". In one example, name of the option area 1234 may include any number of names for any number of options. In this case, a first option is named "PROGRESSIVE JACKPOT 1", a second option is named "PROGRESSIVE JACKPOT 2", a third option is named "PROGRESSIVE JACKPOT 3", a fourth options is named "PROGRESSIVE JACKPOT 4", and an Nth option is named "PROGRESSIVE JACKPOT NTH."

In one example, the cost associated with the selection of one or more of PROGRESSIVE JACKPOT 1, PROGRESSIVE JACKPOT 2, PROGRESSIVE JACKPOT 3, PROGRESSIVE JACKPOT 4, and/or PROGRESSIVE JACKPOT NTH is imbedded in modifying the payout algorithm. For example, when no subscription based progressive options are selected the system has a payout algorithm which equals alpha. However, when a player selects one or more subscription based progressive options the payout algorithm is modified. For example in FIG. 6B, the player has selected to participate in PROGRESSIVE JACKPOT 2 AND PROGRESSIVE JACKPOT 4, which generates a new payout algorithm beta. In this example, payout algorithm beta may generate a reduce payout rate (e.g., 90%) versus the payout rate (e.g., 91%) for payout algorithm alpha. In this example, payout algorithm beta may be based on two subscription based progressives being selected. In another example shown in FIG. 12D, three subscription based progressives were selected (e.g., PROGRESSIVE JACKPOT 2, PROGRESSIVE JACKPOT 4, and PROGRESSIVE JACKPOT N). In this example, a new payout algorithm lambda may be utilized to reduce the payout rate (e.g., 89.8%) versus the payout rates (e.g., 91% and 90%) for payout algorithm alpha and payout algorithm beta, respectively.

Figure 13:
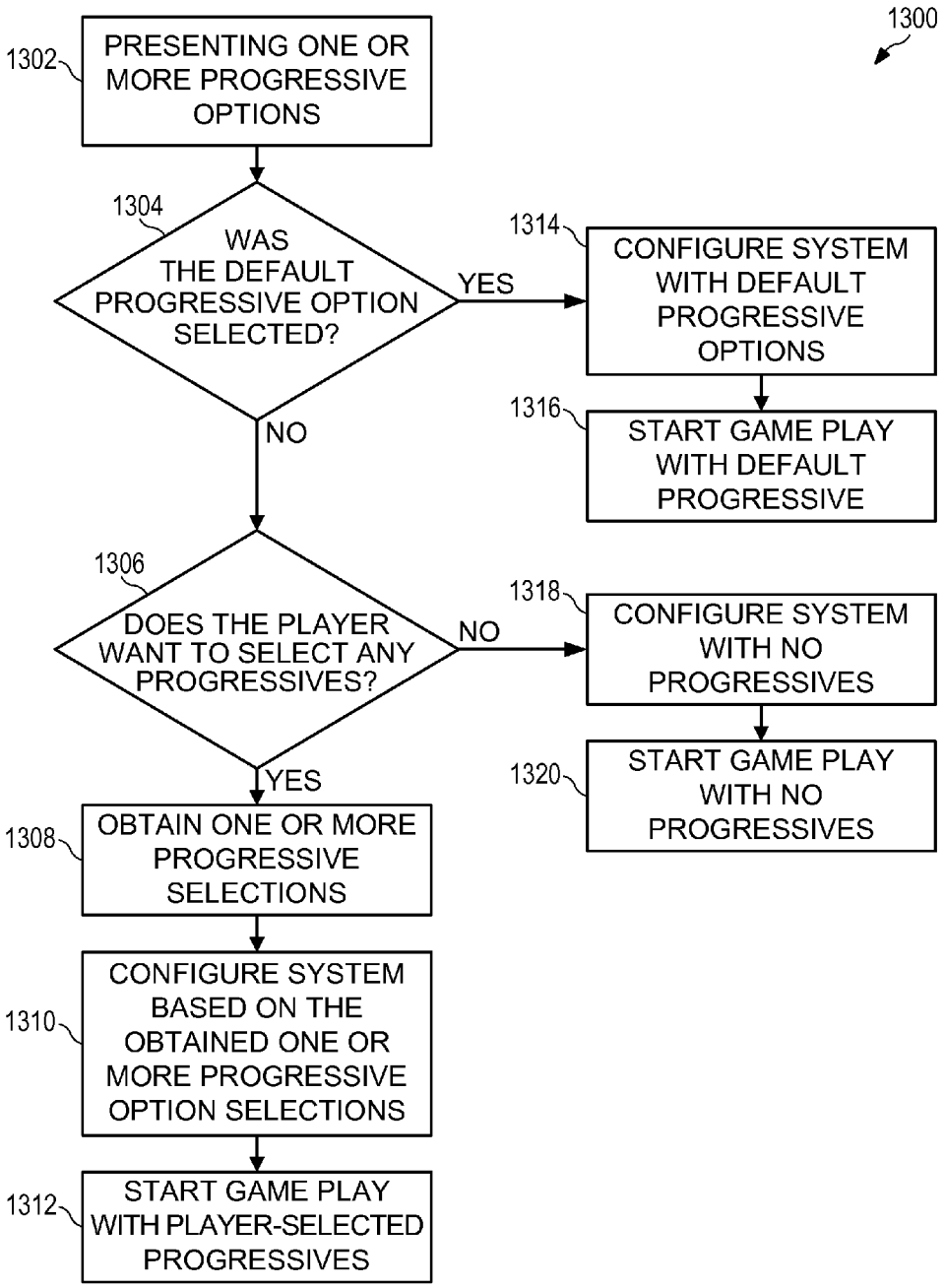
FIG. 13 is a flowchart for subscription based progressive game play on a gaming device, according to one embodiment.

In FIG. 13, another flowchart for subscription based progressive game play on a gaming device 1300 is shown, according to one embodiment. The method may include presenting one or more progressive options (step 1302). The method may include one or more processors (via electronic gaming device 100 and/or electronic gaming system 200) determining whether the default progressive option was selected (step 1304). If the default progressive option was selected, then the method may include configuring the system with the default progressive options (step 1314). The method may then include starting game play with the default progressive functionality (step 1316). If the default progressive option was not selected, then the method may include one or more processors (via electronic gaming device 100 and/or electronic gaming system 200) determining whether the player wants to select any progressive options (step 1306). If the player does not want to select any progressive options, then the method may include configuring the system with no progressive options (step 1318). Further, the method may include starting game play with no progressive options (step 1320). If the player does want to select one or more progressive options, then the method may include obtaining one or more progressive selections (step 1308). The method may further include configuring the system based on the obtained one or more progressive option selections (step 1310). The method may include starting game play with player-selected progressive functionalities (step 1312). For example, a player may be prompted before game play as to whether the player would like to utilize a default subscription progressive option. In this example, the default subscription progressive option may be PROGRESSIVE JACKPOT 1 which cost 5 credits and/or modifies the payout algorithm. If the player declines this default option, the gaming device may ask the player whether the player would like to select one or more subscription based progressive options. If the player declines this selection request, then the gaming system implements game play without any subscription based progressive options.

Figure 14:
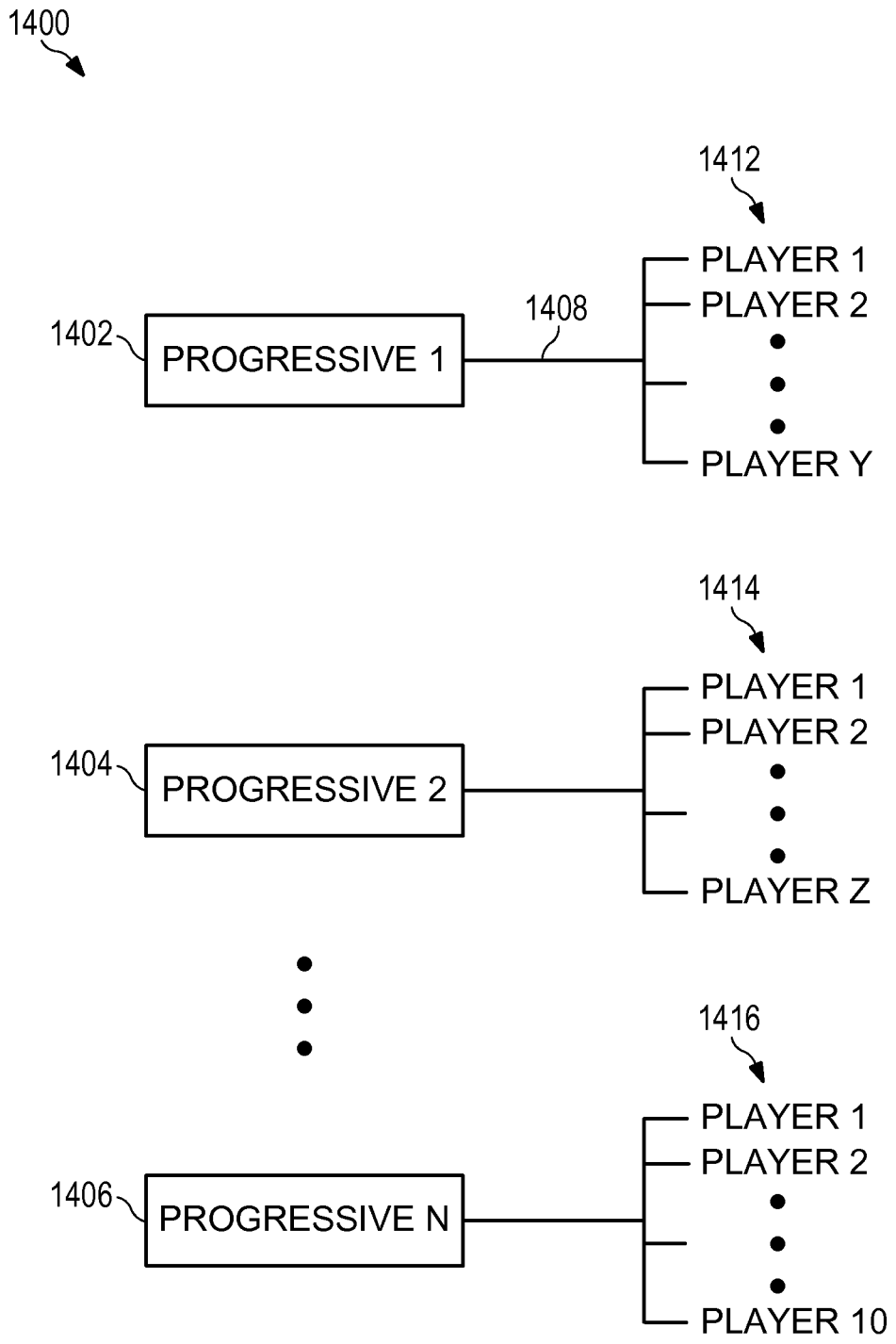
FIG. 14 is another illustration of subscription based progressive game play on a gaming device, according to one embodiment.

In FIG. 14, another illustration of subscription based progressive game play on a gaming device 1400 is shown, according to one embodiment. In various examples, one or more subscription based progressive may be related to one or more players. In one example, a first subscription progressive 1402 may have a pool of participating players which includes player 1, player 2, . . . , and player Y. Whereas, a second subscription progressive 1404 may have a pool of participating players (e.g., the player eligible to win second subscription progressive) of player 1, player 2, . . . , and player Z. Further, an Nth subscription progressive 1206 may have a pool of participating players which includes player 1, player 2, . . . , and player 10. In these examples, the pool of participating players may include identical players, a constant number of players, independent players (e.g., no overlapping players), a varying number of players, a random number of players, players paying for a subscription, players not paying for a subscription (e.g., loyalty program), and/or any combination thereof.

Figure 15:
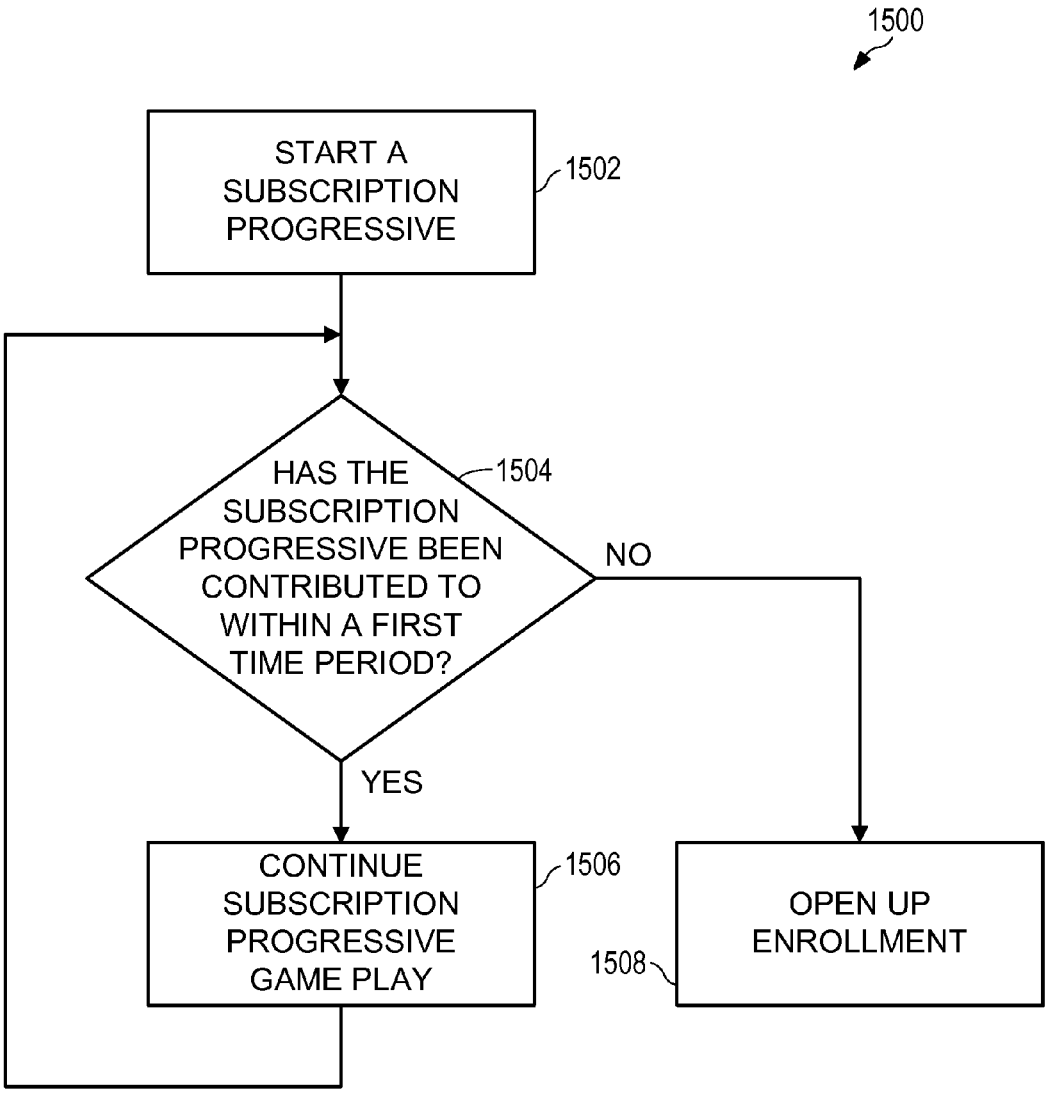
FIG. 15 is a flow diagram for subscription based progressive game play, according to one embodiment.

In FIG. 15, a flow diagram for game play 1500 is shown, according to one embodiment. The method may include starting a subscription progressive (step 1502). The method may include one or more processors (via electronic gaming device 100 and/or electronic gaming system 200) determining whether the subscription progressive has been contributed to within a first time period (step 1504). If the subscription progressive has not been contributed to within a first time period, then the method may open up enrollment to the subscription progressive (step 1508). If the subscription progressive has been contributed to within the first time period, then the method may continue the subscription progressive game play (step 1506) and return to step 1504. For example, a subscription based progressive must be contribute to within a predetermined period (e.g., 5 days, etc.) by one or more of the eligible players and if it is not contributed to within that time frame by one or more of the eligible players, then the eligible players may be removed from enrollment and the enrollment procedure is restarted. In another example, only the players that have not contributed to the progressive are removed, and the enrollment procedure is restarted for any open spaces (e.g., the spaces opened up by the players which were removed).

In one embodiment, the electronic gaming device may include a plurality of reels, one or more memory devices, and one or more processors. The plurality of reels may include one or more areas. The memory may include one or more subscription based progressive structures. The processor may generate one or more symbols to be located in the one or more areas.

In another example, the processor may register a first player for a first subscription based progressive. Further, the processor may charge the first player a first fee for participation in the first subscription based progressive. In addition, the processor may initiate a first modification of a payout algorithm based on participation in the first subscription based progressive. In another example, the processor may register a second player for a second subscription based progressive. Further, the processor may charge the second player a second fee for participation in the second subscription based progressive. In another example, the processor may initiate a second modification of a payout algorithm based on participation in the second subscription based progressive. Further, the processor may store one or more subscription based progressive structures based on a game registration procedure.

In another embodiment, the method of providing game play via an electronic gaming device may include: determining a number of player in a first subscription based progressive; comparing the number of players versus a subscription based progressive capacity; displaying a request for a first player to participate in the first subscription based progressive; and/or enrolling the first player in the first subscription based progressive based on a player input.

In addition, the method may include: determining whether a first progressive payout has been awarded within a predetermined time period and resetting the first progressive payout and reopening enrollment in the first subscription based progressive based on the first progressive payout not being award within the predetermined time period; determining whether the first subscription based progressive has been contributed to within a predetermined time period; continuing the first subscription based progressive based on a contribution being implemented within the predetermined time period; and/or reopening enrollment in the first subscription based progressive based on a lack of a contribution being implemented within the predetermined time period.

In another embodiment, the electronic gaming system may include a server including a server processor and a server memory and a display device including a plurality of reels. The plurality of reels may include one or more areas. The server memory may include one or more subscription based progressive structures. The server processor may generate one or more symbols to be located in the one or more areas.

In addition, the server processor may register a first player for a first subscription based progressive. Further, the server processor may charge the first player a first fee for participation in the first subscription based progressive. In another example, the server processor may initiate a first modification of a payout algorithm based on participation in the first subscription based progressive. Further, the server processor may register a second player for a second subscription based progressive. In addition, the server processor may charge the second player a second fee for participation in the second subscription based progressive. In another example, the server processor may initiate a second modification of a payout algorithm based on participation in the second subscription based progressive.

In various examples, subscriptions based progressives may be where a patron can select which progressives he/she wants to contribute to as well as eligible to win. Further, the subscription based progressives may be where a casino can subscribe to multiple wide area progressives ("WAP") configurations from different servers. In a casino, a non-subscription based progressive is configured for an EPS and a patron is forced to contribute to the non-subscription based progressive by playing the game. In various examples, a patron may choose not to contribute to the non-subscription based progressive and/or the patron wants to contribute to a different progressive pool. In another example, a server can handle different WAP progressives from different WAP servers. In another example, a patron may choose not to contribute to a progressive that is configured for the game. In this example, the payback of the game may be dynamically adjusted to account for this decision. Further, N number of progressives may be associated with a gaming device. In addition, a patron may choose (or subscribe to) N number of progressives at any time. In another example, N number of patrons may subscribe to N number of progressives exclusively and no other patron may be allowed to participate in those progressives. Further, the subscribed progressive may be made available to all patrons across different casinos using server based WAP subscription. In addition, one or more progressives that a patron subscribes to may follow the patron from one game to another game as well as from casino to casino. In another example, when N number of patrons subscribe to a progressive exclusively, the progressive may be required to be won by a specified period (e.g., for mystery WAP, mystery LAP, etc.). In another example, when N number of patrons subscribes to a progressive exclusively, and the progressive has not been contributed to within a specified period of time, the progressive may become void and other patrons can subscribe to the progressive, without the amount being reset. In another example, a bonus game may be associated with winning one or more progressives. In another example, a patron can pay extra (e.g., monthly fee, fee per spin, etc.) to buy into one or more progressives. In another example, the contributions to the subscribed progressives may be configured to come out of the payback of the game. In another example, a patron may subscribe to one or more of a LAP, a WAP, a mystery LAP, and/or a mystery WAP. Further, the payback percentages of the game may be dynamically adjusted to account for when a patron is subscribed to and contributing to a progressive.

Figure 16A:
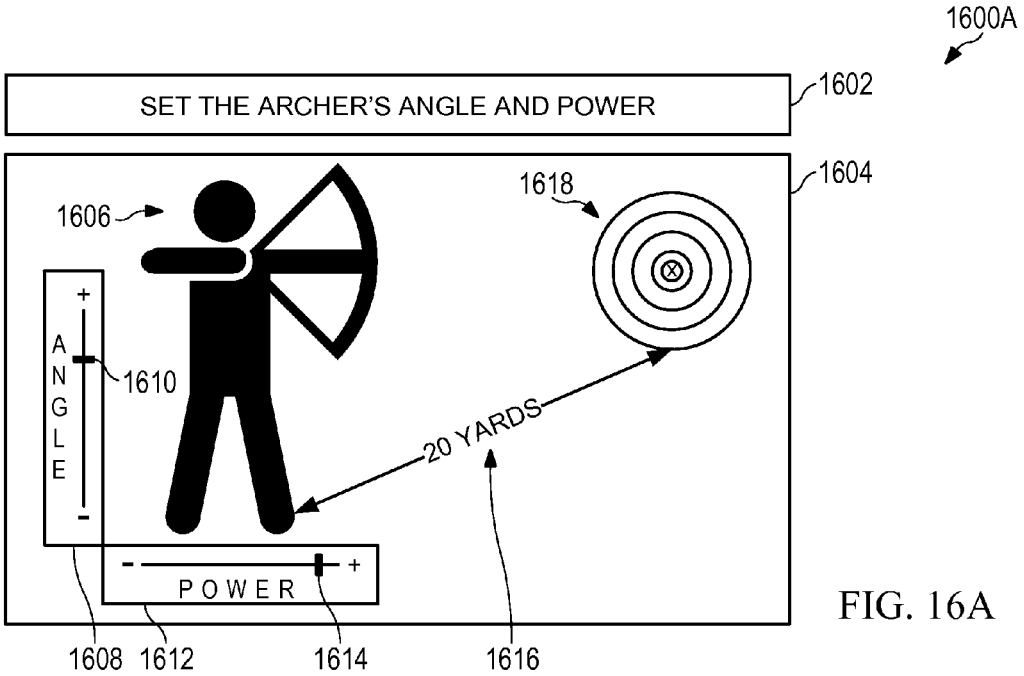
FIG. 16A is an illustration of skill-based tournament game play, according to one embodiment.

In FIG. 16A, an illustration of skill-based tournament game play 1600A is shown, according to one embodiment. In this example, the display image may include a message area 1602 and a gaming area 1604. Message area 1602 may include any data relating to tournament game play and/or tournament skill-based game play. For example, message area 1602 may include instructions, such as, "Set The Archer's Angle and Power Settings." In another example, a tournament title may be displayed. In an example, the time period remaining in the tournament game play and/or the tournament skill-based game play may be shown. Leader board information and/or other game data and/or player ranking data may be displayed.

In another example, gaming area 1604 may include a player icon 1606, an angle setting area 1608, an angle input indicator 1610, a power setting area 1612, a power input indicator 1614, a distance-to-target indicator 1616, and/or a target area 1618. In one example, angle setting area 1608 is where a player inputs via angle input indicator 1610 the angle to utilize to launch an object (e.g., an arrow, etc.). In various examples, the angle input may be modified and/or replaced with a speed input, a strength input, a height input, a length input, a weight input, any other object characteristic input, and/or any combination thereof. In another example, power setting area 1612 is where a player inputs via power input indicator 1614 a power unit to be utilized with an object (e.g., bow and arrow, etc.). In various examples, the power input may be modified and/or replaced with a distance input, a strength input, a weight input, a range input, a speed input, any other object characteristic input, and/or any combination thereof.

Figure 16B:
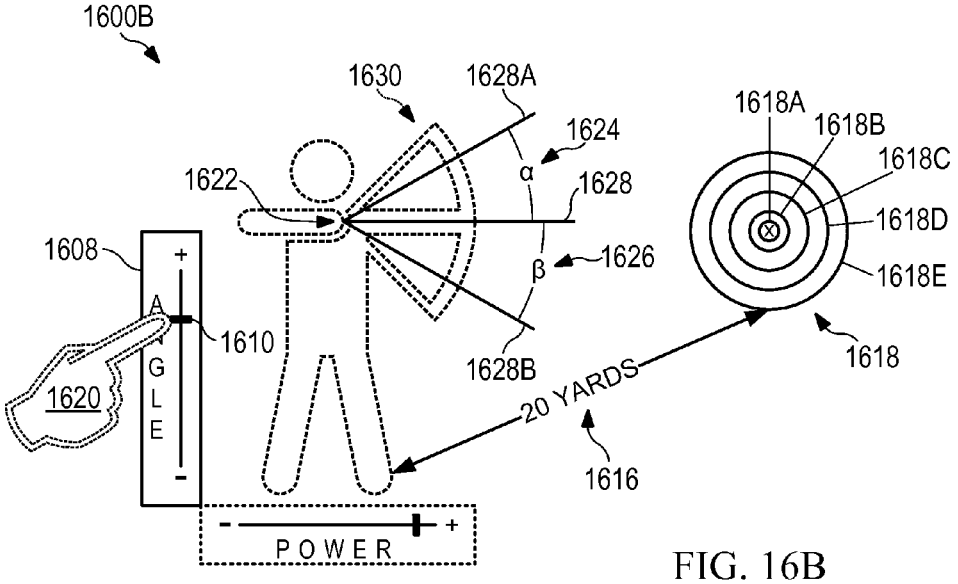
FIG. 16B is another illustration of skill-based tournament game play, according to one embodiment.

In FIG. 16B, another illustration of skill-based tournament game play 1600B is shown, according to one embodiment. In one example, player icon 1606 may include a reference point 1622 along with a bow and arrow image 1630. Reference point 1622 may be a virtual origin point utilized with player icon 1606 and/or any other object utilized with player icon 1606. In one example, a representative horizontal line 1628 may be utilized with player icon 1606 and/or any other object to indicate when an object is horizontal (e.g., at the mid-point of a range, aligned with reference point 1622, etc.). In one example, an incline angle 1624 indicates that an object is aimed above the horizontal line 1628. Whereas, a decline angle 1626 indicates that an object is aimed below the horizontal line 1628. These angles may be selected via a hand 1620 where sliding angle input indicator 1610 up may increase the angle and sliding angle input indicator 1610 down may decrease the angle. In one example, a maximum incline angle 1628A and/or a maximum decline angle 1628B may be utilized. In various examples, hitting a bulls eye area 1618A may achieve a first award, hitting a first ring area 1618B may achieve a second award, hitting a second ring area 1618C may achieve a third award, hitting a third ring area 1618D may achieve a fourth award, and/or hitting a fourth ring area 1618E may achieve a fifth award on a target 1618. The first award may be higher than any other award. The second award may be higher than any other award except the first award. The third award may be higher than any other award except the first award and the second award. The fourth award may only be higher than the fifth award and the fifth award may be the lowest award. Any number of targets and/or award areas may be utilized.

Figure 16C:
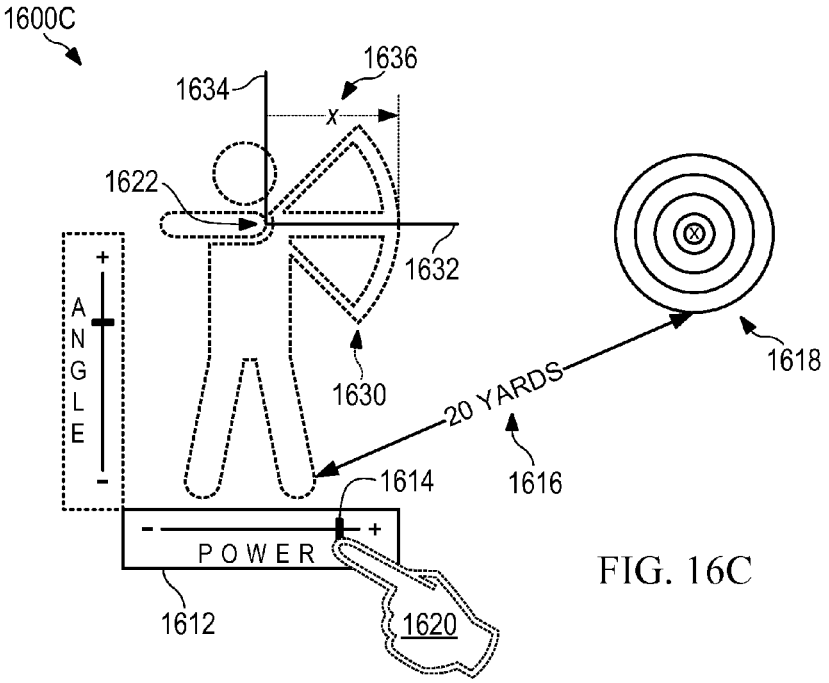
FIG. 16C is another illustration of skill-based tournament game play, according to one embodiment.

In FIG. 16C, another illustration of skill-based tournament game play 1600C is shown, according to one embodiment. In one example, a player via hand 1620 moves the arrow back to a drawn position length 1636 by inputting a power setting in power setting area 1612. The combination of the power setting (e.g., amount of power utilized) and the angle setting (e.g., the launch angle) may determine the length, the trajectory, etc. the object (e.g., an arrow, etc.) will travel.

Figure 16D:
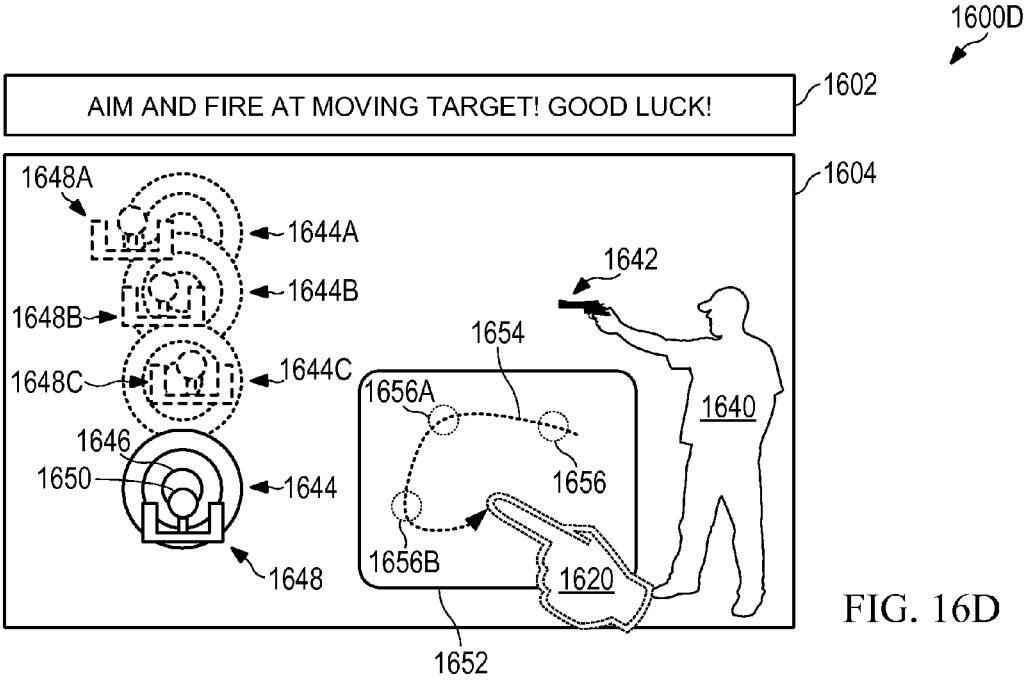
FIG. 16D is another illustration of skill-based tournament game play, according to one embodiment.

In FIG. 16D, another illustration of skill-based tournament game play 1600D is shown, according to one embodiment. In this example, message area 1602 may state "AIM AND FIRE AT MOVING TARGET! GOOD LUCK!" In this example, a player image 1640 may aim a weapon (e.g., gun, tank, bow and arrow, etc.) via an aiming device 1642 (e.g., sight of pistol) to hit one or more moving targets (e.g., 1644). In this example, one or more targets 1644 may have a bull's eye area 1646. In this example, a front sight (e.g., a bead type) 1650 of the pistol may be utilized to track one or more targets 1644. In this example, as the one or more targets move the positions of the one or more targets move (e.g., a first position 1644A, a second position 1644B, a third position 1644C, etc.). In another example, one or more past positions of the sight may also be shown (e.g., a first sight position 1648A, a second sight position 1648B, a third sight position 1648C, etc.). In another example, a virtual touch pad 1652 may be utilized. In one example, a player via hand 1620 may move from a first position 1656 to a second position 1656A and then to a third position 1656B to control either the position (e.g., alignment) of the sights 1648 and for firing the pistol. In one example, the firing is initiated by double tapping within virtual touch pad 1652 and/or lifting one or more fingers.

Figure 17:
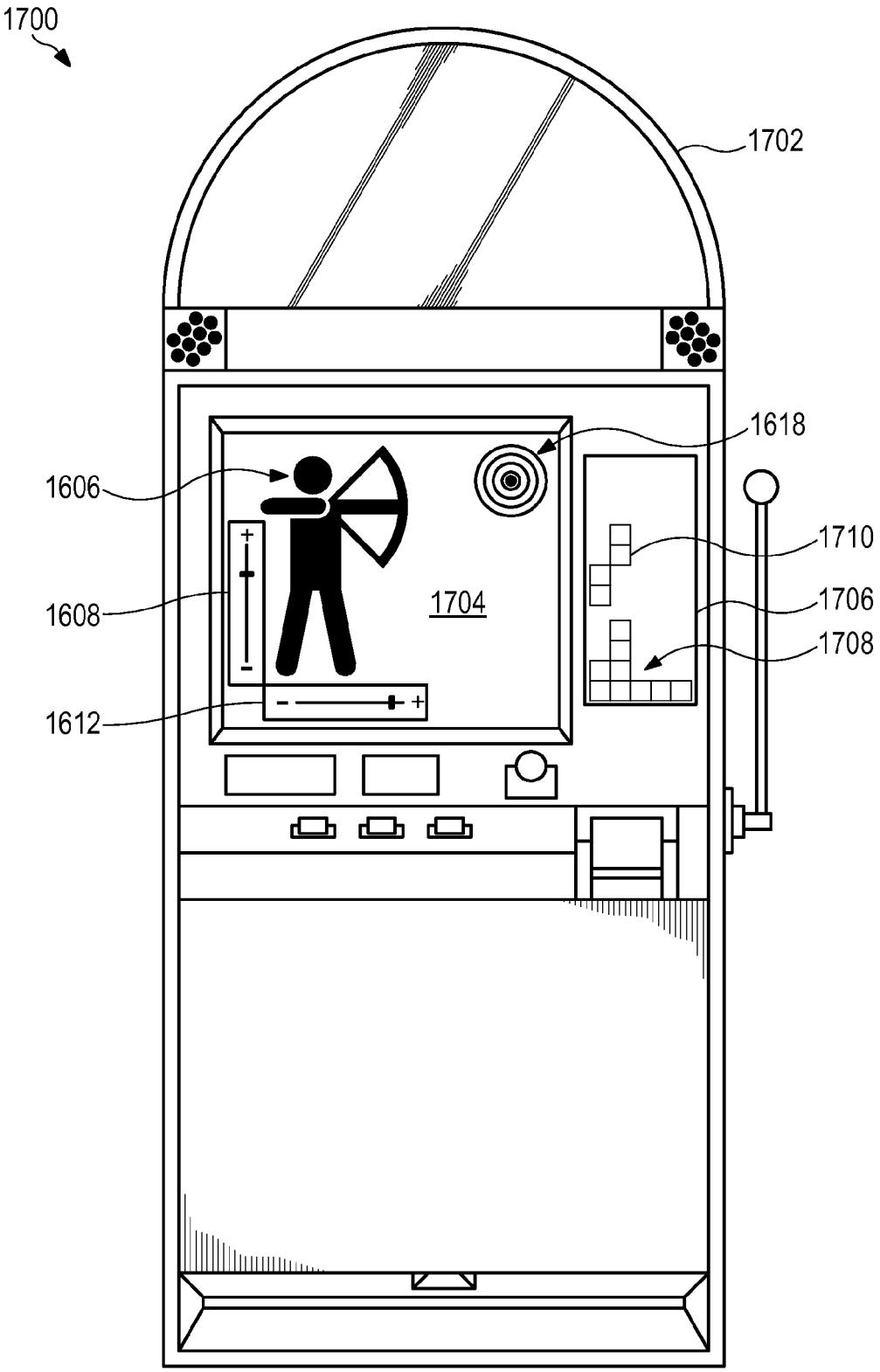
FIG. 17 is an illustration of skill-based tournament game play, according to one embodiment.

FIG. 17 shows an illustration of skill-based tournament game play, according to one embodiment. In this example, player icon 1606, angle setting area 1708, and power setting area 1712 for a first skill-based game play are shown on a first display 1704. Further, a second skill-based game play is shown on a second display. Second skill-based game has a first block piece 1710 which may interrelate with base blocks 1708. In another example, player icon 1606 may aim at one or more targets. The one or more targets may be of different sizes (e.g., very small, small, medium, above average, big, very big, etc.). Based on the size and/or location a target may be more difficult to hit than another target. In other words, the size, location, movement pattern, speed of movement, and/or any other characteristic of the target may increase the difficulty of hitting the target which may increase the prize size for any particular target. In various examples, a first target may be of a medium size and in an above-average difficulty-to-hit position. Whereas, a second target may be a very small size in an average difficulty-to-hit position. In another example, a third target may have an average size and be in a high difficulty-to-hit position. Further, a fourth target may have a very big size and an easy-to-hit position. In another example, an easy-to-hit target may be very big and have an easy-to-hit location.

In another example, a first terrain is shown with a first threat. In this example, a player moves the player icon from a first position via a first path to a launch position to try to jump via a second path (e.g., on a rope) to a safe location.

In another example, a virtual touch pad may be utilized to control the bow, the angle, the draw length, release functions, and/or any other functionality. Further, the angle may be controlled by an up/down movement and a release may be initiated by a double click (e.g., tap) within the present area. In another example, the virtual touch pad may control an icon's (e.g., Dirk, etc.) speed, jump-off point, aim, etc. Speed may be controlled by the velocity/acceleration of a left-to-right movement, and a jump-off point (and/or a grasping for the rope movement, etc.) may be initiated by a double tap motion.

Figure 18:
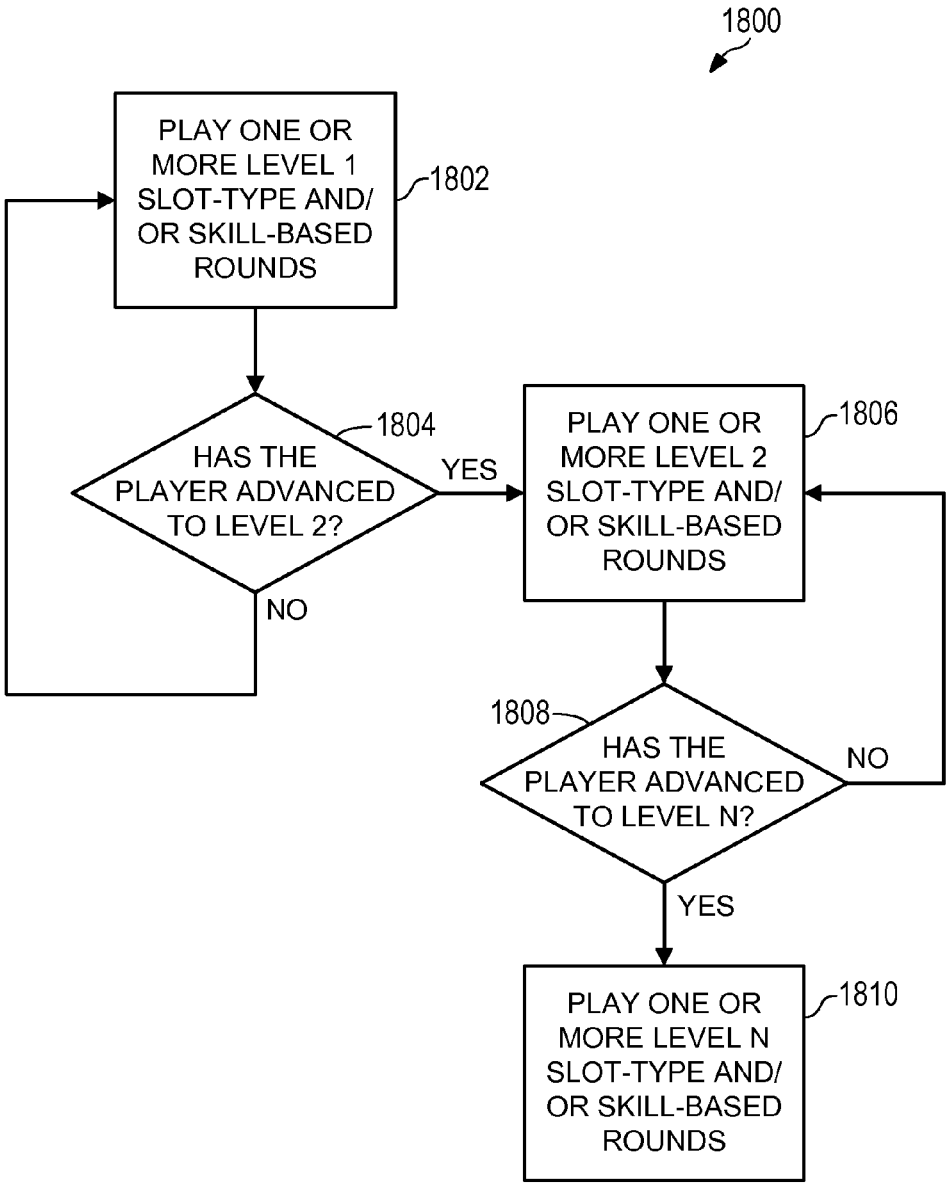
FIG. 18 is a flow diagram for skill-based tournament game play, according to one embodiment.

In FIG. 18, a flow diagram for skill-based tournament game play 1800 is shown, according to one embodiment. The method may include playing one or more level one slot-type and/or skill-based rounds (step 1802). The method may include electronic gaming device 100 and/or electronic gaming system 200 determining whether one or more players have advanced to level two game play (step 1804). If no players have advanced to level two game play, then the method moves back to step 1802. If one or more players have advanced to level two game play, then the method may include playing one or more level two slot-type and/or skill-based rounds (step 1806). The method may include electronic gaming device 100 and/or electronic gaming system 200 determining whether one or more players have advanced to level N game play (step 1808). If no players have advanced to level N game play, then the method may move back to step 1806. If one or more players have advanced to level N game play, then the method may include playing one or more level N slot-type and/or skill-based rounds (step 1810).

Figure 19:
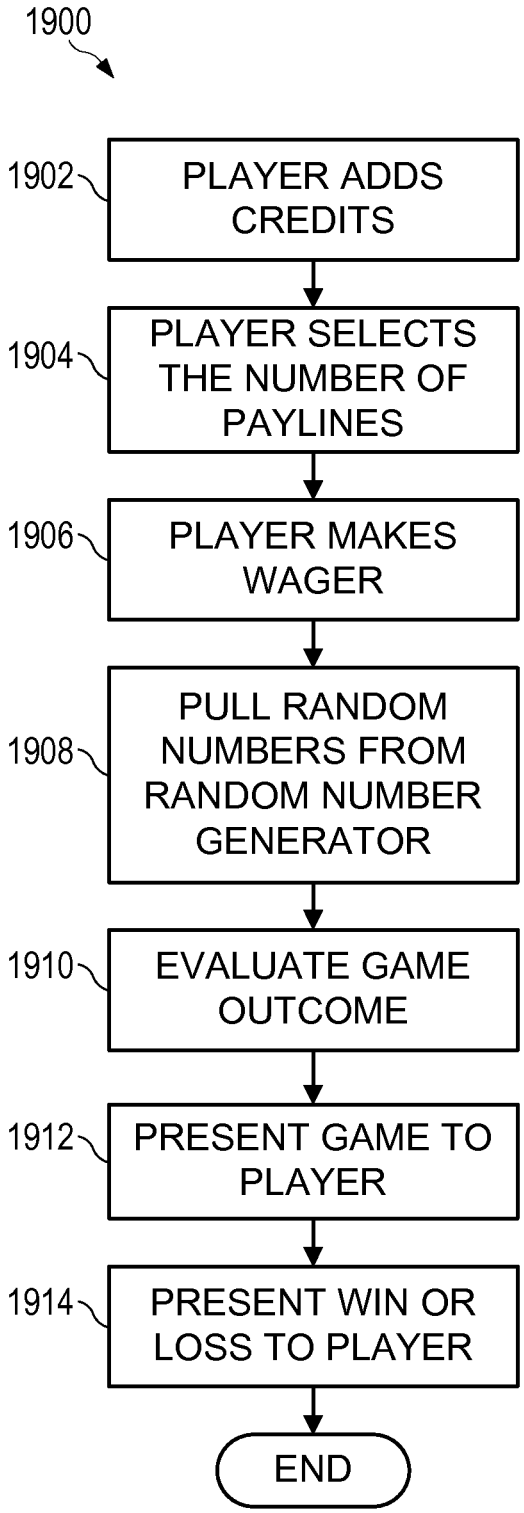
FIG. 19 is a flow diagram for game play, according to one embodiment.

In FIG. 19, a process flowchart of one example of a primary game play 1900 on an electronic gaming system is shown, according to one embodiment. The method may include the step of a player adding credit to the electronic gaming system (step 1902). It is contemplated that a player can do this by inserting cash, coins, a ticket representative of a cash value, a credit card, a player card, requesting an electronic funds transfer ("EFT"), otherwise requesting access to an account having monetary funds, and/or any combination thereof.

At step 1904, the player selects the number of paylines to play. In one embodiment, the player can select from a plurality of different paylines to play. In a further embodiment, the player can only play a predetermined number of paylines. An example of this embodiment may be the instance where the gaming system only allows a player to play forty paylines, and cannot select to play more or less paylines. In another embodiment, the gaming system does not offer paylines, but rather offers a different way to evaluate the game play. One example of a different way may be sometime referred to as a 243-ways evaluation, where symbols may be evaluated based on the existence of like-symbol clusters on adjacent reels, starting with the left-most reel and continuing right, instead of how many paylines run through the like-symbol clusters.

At step 1906, the player makes a wager on the game. In one embodiment, the wager may be a multiple of the number of paylines selected at step 1904. In another embodiment, the wager may not be a multiple of the number of paylines selected at step 1904. In a further embodiment, the wager may include a side-wager (e.g., ante bet), which may, in one example of such an embodiment, be used to make the player eligible to be awarded the extra functionality discussed above. It should be appreciated that in some embodiments, the order of steps 1904 and 1906 may be not critical, and so for example, a player can select the wager they wish to place, and then select the number of paylines they want it applied to, and that these embodiments are expressly contemplated as being within the scope of the present disclosure.

Continuing to step 1908, the gaming system pulls random numbers from a random number generator ("RNG"). In one embodiment, the system pulls one random number for each reel. In another embodiment, the system pulls one random number which may be utilized to determine the stop positions for each reel. In another embodiment, the random numbers determined by the RNG may be based on the time that the numbers may be pulled. In another embodiment, the random numbers determined by the RNG may be based on the prior numbers pulled.

At steps 1910 and 1912, the gaming system utilizes the random numbers pulled at step 1908 to determine the primary game symbols to display in the play of the primary game, which in turn both determines the presentation of the game to the player and evaluates the game outcome. In one embodiment, the random numbers pulled determine the stopping positions for the reels, which may be then caused to stop at those associated positions, and then the gaming system evaluates the displayed primary game symbols to determine the game outcome. In another embodiment, the gaming system determines the game outcome based on the pulled random numbers, and then causes the game to present an associated outcome to the player.

At step 1914, the win or loss outcome may be identified for the player. In one embodiment, this step can include additional messaging, which provides information related to the win or loss, such as why the player won or lost. In another embodiment, this step can include identification of the amount of any award earned by the player.

Figure 20:
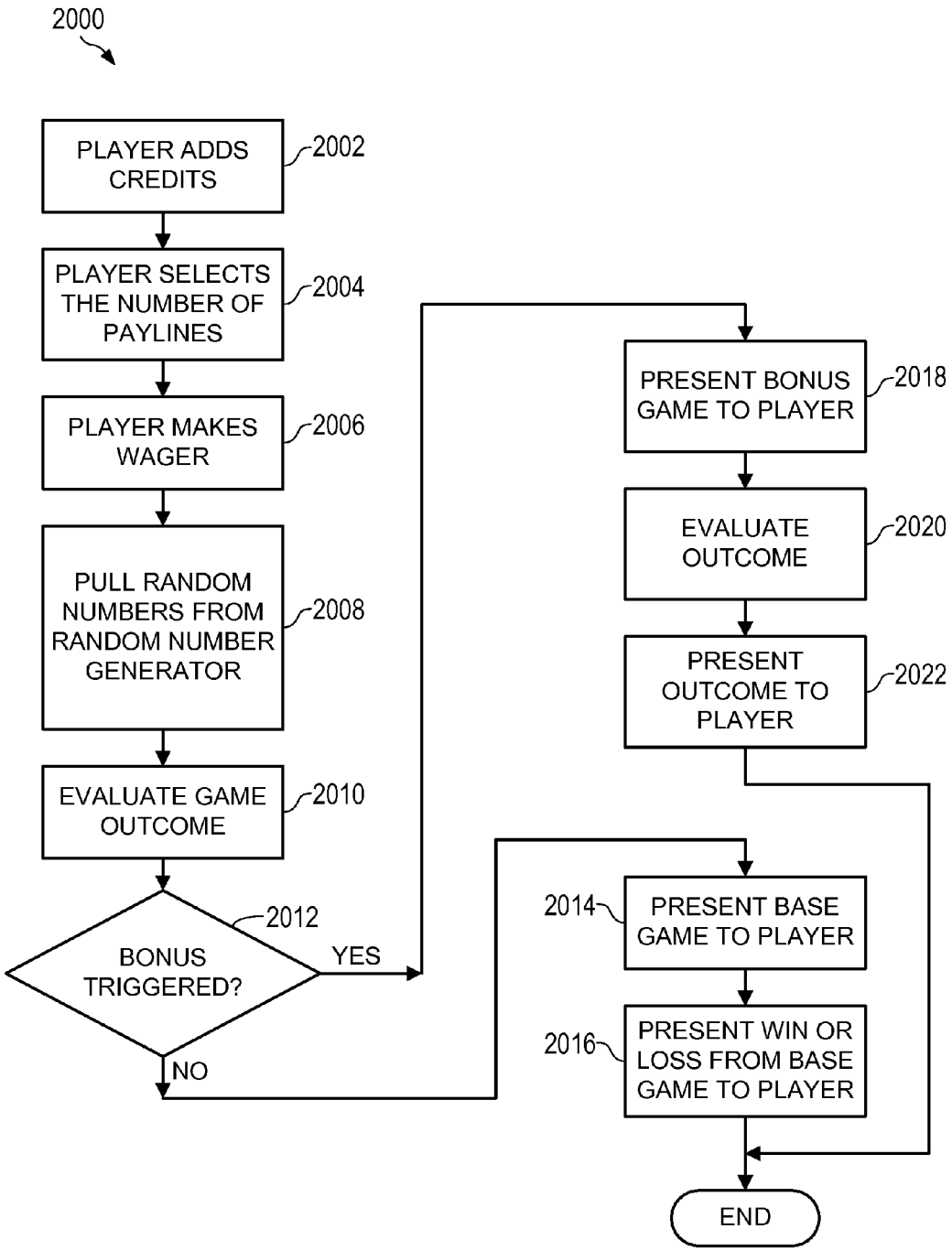
FIG. 20 is a flow diagram for game play, according to one embodiment.

FIG. 20 is a process flowchart of one example of a combined primary and secondary game play 2000 on an electronic gaming system, according to one embodiment. The method may include the step of a player adding credit to the electronic gaming system (step 2002). It is contemplated that a player can do this by inserting cash, coins, a ticket representative of a cash value, a credit card, a player card, requesting an electronic funds transfer ("EFT"), otherwise requesting access to an account having monetary funds, and/or any combination thereof.

At step 2004, the player selects the number of paylines to play. In one embodiment, the player can select from a plurality of different paylines to play. In a further embodiment, the player can only play a predetermined number of paylines. An example of this embodiment may be the instance where the gaming system only allows a player to play forty paylines, and cannot select to play more or less paylines. In another embodiment, the gaming system does not offer paylines, but rather offers a different way to evaluate the game play. One example of a different way may be sometime referred to as a 243-ways evaluation, where symbols may be evaluated based on the existence of like-symbol clusters on adjacent reels, starting with the left-most reel and continuing right, instead of how many paylines run through the like-symbol clusters.

At step 2006, the player makes a wager on the game. In one embodiment, the wager may be a multiple of the number of paylines selected at step 2004. In another embodiment, the wager may not be a multiple of the number of paylines selected at step 2004. In a further embodiment, the wager may include a side-wager, which may, in one example of such an embodiment, be used to make the player eligible to be awarded the extra functionality discussed above. It should be appreciated that in some embodiments, the order of steps 2004 and 2006 may be not critical, and so for example, a player can select the wager they wish to place, and then select the number of paylines they want it applied to, and that these embodiments may be expressly contemplated as being within the scope of the present disclosure.

Continuing to step 2008, the gaming system pulls random numbers from a random number generator "RNG". In one embodiment, the system pulls one random number for each reel. In another embodiment, the system pulls one random number which may be utilized to determine the stop positions for each reel. In another embodiment, the random numbers determined by the RNG may be based on the time that the numbers may be pulled. In another embodiment, the random numbers determined by the RNG may be based on the prior numbers pulled.

At step 2010, the gaming system utilizes the random numbers pulled at step 2008 to evaluate the game outcome. In one embodiment, the random numbers pulled determine the stopping positions for the reels, which may be then caused to stop at those associated positions, and then the gaming system evaluates the displayed primary game symbols to determine the game outcome. In another embodiment, the gaming system determines the game outcome based on the pulled random numbers, and then causes the game to present an associated outcome to the player.

At step 2012, the gaming system determines if a secondary or bonus game may be triggered. In one embodiment, the bonus game is triggered by the display of a plurality of matching symbols at a plurality of predetermined symbol positions within a play of the primary game. In one example, the bonus game may be triggered if a plurality of matching symbols is displayed on the $2^{nd}$, $3^{rd}$ and $4^{th}$ reel. In another example, the bonus game may be triggered if matching symbols are displayed on the $1^{st}$, $2^{nd}$ and $3^{rd}$ reels. In a further example, the bonus game may be triggered if matching symbols occur at predetermined symbol positions that include consecutive and non-consecutive reels. In another example, a bonus game (e.g., secondary game) may be triggered in any way (e.g., one special symbols in any locations, one special symbol in one or more predetermined locations, two special symbols in any locations, two special symbols in one or more predetermined locations, three special symbols in any locations, three special symbols in one or more predetermined locations, etc.).

If it is determined that a bonus or secondary game was not triggered, the process continues to step 2014, where the base game may be fully presented to the player. As discussed above, the orders of step 2010, 2012, and 2014 can be changed without affecting the novel concepts disclosed herein.

At step 2016, the win or loss outcome of the primary game may be identified for the player. In one embodiment, this step can include additional messaging, which provides information related to the win or loss, such as why the player won or lost. In another embodiment, this step can include identification of the amount of any award earned by the player If it is determined at step 2012 that a bonus or secondary game was triggered, then process 2000 continues to step 2018, where the secondary game may be presented to the player. As discussed above, there are numerous ways to present the secondary or bonus game to the player.

At steps 2020 and 2022, the outcome of the secondary game may be evaluated and presented to the player. In one embodiment, the outcome of the bonus game will always be a winning outcome. In another embodiment, the outcome of the secondary game will cause a significant award to be provided to the player. In one example of such an embodiment, the award may not be provided by the gaming system, as a casino operator may need to verify tax information before allowing such an award to be provided to the player. In one embodiment, instead of the process 2000 ending after step 2022, the process continues to step 2014 so as to finalize the primary game outcome presentation to the player.

In another example, a progressive is a special prize, usually prominently advertised to the player which grows in value over time. The progressive is typically funded by a small portion of each player's bet; the more the player's bet in dollars, the faster the progressive prize grows. At some point, a triggering event awards the progressive value to the player, and the progressive is reset, usually to a pre-defined fixed starting amount. There are two different types of progressive games (e.g., mystery progressives and must hit-by progressives). In one example, a mystery progressive is a progressive that is awarded randomly without a visible triggering event (such as a combination of symbols, or some threshold of game points obtained, etc.) A mystery progressive is advantageous for game manufacturers because the mystery progressive feature can be added on top of existing game themes without changing the underlying game's math. This offers a quick-and-simple deployment strategy for mystery progressive games. In one example, a must hit-by progressive is a progressive with a pre-determined range of values—say between $10.00 and $25.00. Using this example, the progressive starts at $10.00, and grows via player funding, and is awarded at some point before it reaches $25.00. This type of progressive is advantageous to the player because he can immediately see how close a particular progressive is to hitting. When the progressive is awarded, the value resets to the $10.00 start-up value. In another example, a turbo boost progressive may boost the progressive amount on some spins by an amount that is substantial compared to the rate of normal progressive jackpot growth. In various examples, the turbo boost can be awarded randomly, through the appearance of symbols, based on a player's bet, a step function with constant ranges (e.g., at $100, then at $125, then at $175 but then the same pattern repeats ($100, $125, $175 then again at $100, $125, and $175) and/or varying ranges ($100, $125, $175 then at $110, $122, $140, and then $180), the award of free spins, the award of one or more multipliers, the number of winning paylines, the amount of aggregate wagers of the player's bets, the aggregate wagers of the group's bets, and/or any combination thereof.

In another example, a progressive has a start-up value of $100 and a maximum value of $500. The progressive will be awarded on or before it reaches $500. The progressive grows at a rate of 1% of the player's bet on each spin. In this example, the award value is chosen. In this example, it is $375, which means that when the progressive reaches, or surpasses the $375 value, the award is given to the player and the progressive is reset to $100. In one example, the player wagers $1. In this case, the incremental rate of 1% of the $1 is applied to the progressive. Thus, $0.01 is added to the current value of $100. In one example, a random number is used to determine if the turbo boost is to be awarded to the player. In this example, a turbo boost is not awarded to the player. The turbo boost aspect of the game has been concluded for this spin. The player makes another $1 wager which utilizing the 1% of the $1 is applied to the progressive. Thus, $0.01 is added to the current value which generates a value of $100.01. Further, a random number is used to determine if a turbo boost is awarded to the player. In this example, a turbo boost is awarded to the player. In this example, there is a 50% chance the player will be awarded a $10 boost, a 25% chance an award of $20 boost, a 20% chance the player will be awarded a $50 boost, and a 5% chance the award will be a $100 boost. In this example, a random number is used to determine that the player has won a $50 boost. This $50 boost is added to the current meter and the turbo boost play has concluded. Further the player now places another wager of $3. The incremental rate of 1% is applied to the $3. Thus, $0.03 is added to the current value ($150.05). In this example, a random number is used to determine if the turbo boost is to be awarded. Further, in this example, the turbo boost is awarded to the player at the same relative frequencies as above, with the dollar amount multiplied by 3 since the player is wagering $3 instead of $1. In this example, a $300 turbo boost is awarded to the player. After the turbo boost is given to the player, the current progressive value reads $450.05, which exceeds the $375 hit value, so the progressive is awarded to the player. The amount actually awarded to the player via the turbo boost is $375 and/or the actual value of $450.05. In this example, the turbo boost progressive value is reset to $100 and a new award value (e.g., any number from 100.01 to $500 in this example) is selected. The process then repeats.

In one embodiment, the electronic gaming device may include a plurality of reels, a memory, and a processor. The plurality of reels may include one or more areas. The memory may include one or more turbo boost progressive feature structures. The processor may generate one or more symbols to be located in the one or more areas. The processor may increase a progressive jackpot amount by a first amount where the first amount is a portion of a wager. The processor may increase the progressive jackpot amount by a second amount based on a turbo boost triggering event.

In various other examples, the second amount may not be based on being a wager portion. Further, the turbo boost triggering event may be based on data from a random number generator. In addition, the turbo boost triggering event may be based on a predetermined step function relating to the progressive jackpot amount. In another example, the turbo boost triggering event may be based on one or more turbo boost symbols. Further, the turbo boost triggering event may be based on a number of winning paylines generated. In addition, the turbo boost triggering event may be based on a number of free spins generated. In one example, the turbo boost triggering event may be based on a multiplier generated. In addition, the turbo boost triggering event may be based on a winning amount generated. Further, the turbo boost triggering event may be based on a winning pseudo wager. In addition, the turbo boost triggering event may be based on a winning skill-based event. In another example, the turbo boost triggering event may be based on an external event. Further, the turbo boost triggering event may be based on a sponsor contribution.

In another embodiment, the method of providing game play via an electronic mobile device may include: initiating via the one or more processors a turbo boost progressive game; determining one or more outcomes associated with the turbo boost progressive game; increasing a progressive jackpot amount by a first amount where the first amount is a portion of a wager; and/or increasing the progressive jackpot amount by a second amount based on a turbo boost triggering event.

In various other examples, the method may include that the second amount is not based on being a wager portion. Further, the turbo boost triggering event may be based on data from a random number generator. In addition, the turbo boost triggering event may be based on a predetermined step function relating to the progressive jackpot amount.

In another embodiment, the electronic gaming system may include a server which includes a server processor and a server memory. The system may include a display device which includes a plurality of reels where the plurality of reels includes one or more areas. The server memory may include one or more turbo boost progressive feature structures. The server processor may generate one or more symbols to be located in the one or more areas. The server processor may increase a progressive jackpot amount by a first amount where the first amount is a portion of a wager and the server processor may increase the progressive jackpot amount by a second amount based on a turbo boost triggering event.

In another example, the second amount is not based on being a wager portion. In another example, the turbo boost triggering event is based on data from a random number generator.

Gaming system may be a "state-based" system. A state-based system stores and maintains the system's current state in a non-volatile memory. Therefore, if a power failure or other malfunction occurs, the gaming system will return to the gaming system's state before the power failure or other malfunction occurred when the gaming system is powered up.

State-based gaming systems may have various functions (e.g., wagering, payline selections, reel selections, game play, bonus game play, evaluation of game play, game play result, steps of graphical representations, etc.) of the game. Each function may define a state. Further, the gaming system may store game histories, which may be utilized to reconstruct previous game plays.

A state-based system is different than a Personal Computer ("PC") because a PC is not a state-based machine. A state-based system has different software and hardware design requirements as compared to a PC system.

The gaming system may include random number generators, authentication procedures, authentication keys, and operating system kernels. These devices, modules, software, and/or procedures may allow a gaming authority to track, verify, supervise, and manage the gaming system's codes and data.

A gaming system may include state-based software architecture, state-based supporting hardware, watchdog timers, voltage monitoring systems, trust memory, gaming system designed communication interfaces, and security monitoring.

For regulatory purposes, the gaming system may be designed to prevent the gaming system's owner from misusing (e.g., cheating) via the gaming system. The gaming system may be designed to be static and monolithic.

In one example, the instructions coded in the gaming system are non-changeable (e.g., static) and are approved by a gaming authority and installation of the codes are supervised by the gaming authority. Any change in the system may require approval from the gaming authority. Further, a gaming system may have a procedure/device to validate the code and prevent the code from being utilized if the code is invalid. The hardware and software configurations are designed to comply with the gaming authorities' requirements.

As used herein, the term "mobile device" refers to a device that may from time to time have a position that changes. Such changes in position may comprise of changes to direction, distance, and/or orientation. In particular examples, a mobile device may comprise of a cellular telephone, wireless communication device, user equipment, laptop computer, other personal communication system ("PCS") device, personal digital assistant ("PDA"), personal audio device ("PAD"), portable navigational device, or other portable communication device. A mobile device may also comprise of a processor or computing platform adapted to perform functions controlled by machine-readable instructions.

The methods and/or methodologies described herein may be implemented by various means depending upon applications according to particular examples. For example, such methodologies may be implemented in hardware, firmware, software, or combinations thereof. In a hardware implementation, for example, a processing unit may be implemented within one or more application specific integrated circuits ("ASICs"), digital signal processors ("DSPs"), digital signal processing devices ("DSPDs"), programmable logic devices ("PLDs"), field programmable gate arrays ("FPGAs"), processors, controllers, micro-controllers, microprocessors, electronic devices, other devices units designed to perform the functions described herein, or combinations thereof.

Some portions of the detailed description included herein are presented in terms of algorithms or symbolic representations of operations on binary digital signals stored within a memory of a specific apparatus or a special purpose computing device or platform. In the context of this particular specification, the term specific apparatus or the like includes a general purpose computer once it is programmed to perform particular operations pursuant to instructions from program software. Algorithmic descriptions or symbolic representations are examples of techniques used by those of ordinary skill in the arts to convey the substance of their work to others skilled in the art. An algorithm is considered to be a selfconsistent sequence of operations or similar signal processing leading to a desired result. In this context, operations or processing involve physical manipulation of physical quantities. Typically, although not necessarily, such quantities may take the form of electrical or magnetic signals capable of being stored, transferred, combined, compared or otherwise manipulated. It has proven convenient at times, principally for reasons of common usage, to refer to such signals as bits, data, values, elements, symbols, characters, terms, numbers, numerals, or the like. It should be understood, however, that all of these or similar terms are to be associated with appropriate physical quantities and are merely convenient labels. Unless specifically stated otherwise, as apparent from the discussion herein, it is appreciated that throughout this specification discussions utilizing terms such as "processing," "computing," "calculating," "determining" or the like refer to actions or processes of a specific apparatus, such as a special purpose computer or a similar special purpose electronic computing device. In the context of this specification, therefore, a special purpose computer or a similar special purpose electronic computing device is capable of manipulating or transforming signals, typically represented as physical electronic or magnetic quantities within memories, registers, or other information storage devices, transmission devices, or display devices of the special purpose computer or similar special purpose electronic computing device.

Reference throughout this specification to "one example," "an example," "embodiment," and/or "another example" should be considered to mean that the particular features, structures, or characteristics may be combined in one or more examples.

While there has been illustrated and described what are presently considered to be example features, it will be understood by those skilled in the art that various other modifications may be made, and equivalents may be substituted, without departing from the disclosed subject matter. Additionally, many modifications may be made to adapt a particular situation to the teachings of the disclosed subject matter without departing from the central concept described herein. Therefore, it is intended that the disclosed subject matter not be limited to the particular examples disclosed. Further, one or more gaming options may be Internet based gaming options. Therefore, all of the examples and/or embodiments may be utilized via an Internet based gaming system.

The invention claimed is:

1. An electronic gaming device comprising:

a credit device configured to accept a physical item associated with a monetary value;

a user input device configured to enable a player to select a wager amount and initiate a game play where the wager amount is subtracted from a credit balance, the credit balance being funded at least in part via the credit device;

a plurality of display areas, the plurality of display areas including one or more areas;

a memory, the memory including one or more turbo boost progressive feature structures; and a processor configured to generate one or more symbols to be located in the one or more areas, the processor configured to increase a progressive jackpot amount by a first amount where the first amount is a portion of a wager and the processor configured to increase the progressive jackpot amount by a second amount based on a turbo boost triggering event where the progressive jackpot is a turbo-based progressive jackpot and the processor is further configured to increase a non-turbo-based progressive jackpot by a third amount where the third amount is a second portion of the wager, wherein the processor evaluates game results based on the one or more symbols and updates the credit balance according to the game results.

2. The electronic gaming device of claim 1, wherein the second amount is not based on being a wager portion.

3. The electronic gaming device of claim 1, wherein the turbo boost triggering event is based on data from a random number generator.

4. The electronic gaming device of claim 1, wherein the turbo boost triggering event is based on a predetermined step function relating to the progressive jackpot amount.

5. The electronic gaming device of claim 1, wherein the turbo boost triggering event is based on one or more turbo boost symbols.

6. The electronic gaming device of claim 1, wherein the turbo boost triggering event is based on a number of winning paylines generated.

7. The electronic gaming device of claim 1, wherein the turbo boost triggering event is based on a number of free spins generated.

8. The electronic gaming device of claim 1, wherein the turbo boost triggering event is based on a multiplier generated.

9. The electronic gaming device of claim 1, wherein the turbo boost triggering event is based on a winning amount generated.

10. The electronic gaming device of claim 1, wherein the turbo boost triggering event is based on a winning pseudo wager.

11. The electronic gaming device of claim 1, wherein the turbo boost triggering event is based on a winning skill-based event.

12. The electronic gaming device of claim 1, wherein the turbo boost triggering event is based on an external event.

13. The electronic gaming device of claim 1, wherein the turbo boost triggering event is based on a sponsor contribution.

14. A method of providing game play via an electronic mobile device comprising:

receiving via a credit device a physical item associated with a monetary value;

establishing via one or more processors a credit balance based at least in part on the received item;

receiving vii a wager button a wager amount on a play of a game, wherein the wager amount is deducted from the credit balance;

initiating via the one or more processors a turbo boost progressive game; determining one or more outcomes associated with the turbo boost progressive game;

increasing a progressive jackpot amount h a first amount where the first amount is a portion of a wager;

increasing, the progressive jackpot amount by a second amount based on a turbo boost triggering event where the progressive jackpot is a turbo-based progressive jackpot and the processor is further configured to increase a non-turbo-based progressive jackpot by a third amount where the third amount is a second portion of the wager; and evaluating game results and updating the credit balance according to the game results.

15. The method of claim 14, wherein the second amount is not based on being a wager portion.

16. The method of claim 14, wherein the turbo boost triggering event is based on data from a random number generator.

17. The method of claim 14, wherein the turbo boost triggering event is based on a predetermined step function relating to the progressive jackpot amount.

18. An electronic gaming system comprising:

a credit device configured to accept a physical item associated with a monetary value; a user input device configured to enable player to select a wager amount and initiate game play, wherein the wager amount is subtracted from a credit balance funded at least in part via the credit device;

a server including a server processor and a server memory;

a display device including a plurality of reels, the plurality of reels including one or more areas;

the server memory including one or more turbo boost progressive feature structures; and the server processor is configured to generate one or more symbols to be located in the one or more areas, the server processor configured to increase a progressive jackpot amount by a first amount where the first amount is a portion of a wager and the server processor configured to increase the progressive jackpot amount by a second amount based on a turbo boost triggering event where the progressive jackpot is a turbo-based progressive jackpot and the processor is further configured to increase a non-turbo-based progressive jackpot by a third amount where the third amount is a second portion of the wager, wherein the server processor evaluates game results based on the one or more symbols and updates the credit balance according to the game results.

19. The electronic gaming system of claim 18, wherein the second amount is not based on being a wager portion.

20. The electronic gaming system of claim 18, wherein the turbo boost triggering event is based on data from a random number generator.

* * * * *